US006722259B2

(12) United States Patent
Hisanaga et al.

(10) Patent No.: US 6,722,259 B2
(45) Date of Patent: Apr. 20, 2004

(54) FLUID MACHINERY

(75) Inventors: Shigeru Hisanaga, Kariya (JP); Motohiko Ueda, Okazaki (JP); Mikio Matsuda, Okazaki (JP)

(73) Assignee: Denso Corporation, Kariya (JP)

( * ) Notice: Subject to any disclaimer, the term of this patent is extended or adjusted under 35 U.S.C. 154(b) by 49 days.

(21) Appl. No.: 10/013,509

(22) Filed: Dec. 13, 2001

(65) Prior Publication Data

US 2002/0073836 A1 Jun. 20, 2002

(30) Foreign Application Priority Data

Dec. 18, 2000 (JP) ..... 2000-384250
Sep. 14, 2001 (JP) ..... 2001-280049

(51) Int. Cl.[7] ..... F01B 13/04
(52) U.S. Cl. ..... 91/499; 92/71
(58) Field of Search ..... 92/71; 91/499; 417/369; 74/38, 40, 45, 53, 571 L

(56) References Cited

U.S. PATENT DOCUMENTS 4,664,604 A 5/1987 Terauchi
5,960,697 A 10/1999 Hayase et al.
6,092,996 A * 7/2000 Obrist et al. ..... 92/71

FOREIGN PATENT DOCUMENTS

JP B2-4-51667 8/1992

* cited by examiner

*Primary Examiner*—Edward K. Look
*Assistant Examiner*—Michael Leslie
(74) *Attorney, Agent, or Firm*—Posz & Bethards, PL

(57) ABSTRACT

Downsizing a piston stroke dimension in a compressor that reciprocates pistons is accomplished by changing a radial directional component of a shaft of a motion that is transferred to a link from a revolving member revolved by the shaft when transferred to the link attached to the pistons. Thereby, when the revolving member, driven by a shaft, revolves once, a center of a sliding pin appears to reciprocate once in a vertical direction as it goes back and forth on both sides interposing a piston axial line. Thus, when the revolving member revolves once, the piston reciprocates twice in a cylinder bore in a direction parallel to the longitudinal direction of the driving shaft.

25 Claims, 55 Drawing Sheets

270°
109
101
112
105c
108
109a
111b
112a
109a
111b
112a
112a
111b
109a
112a
111b

PISTON AT TOP
DEAD CENTER
112
109
109a
LP
111b

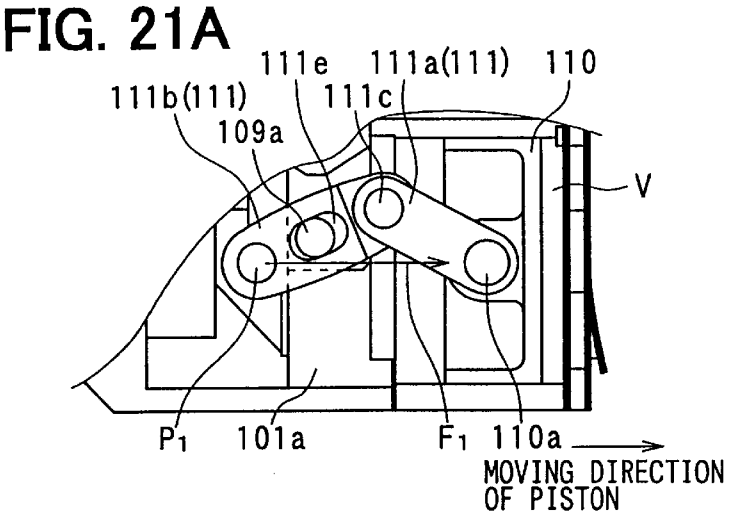
FIG. 21A
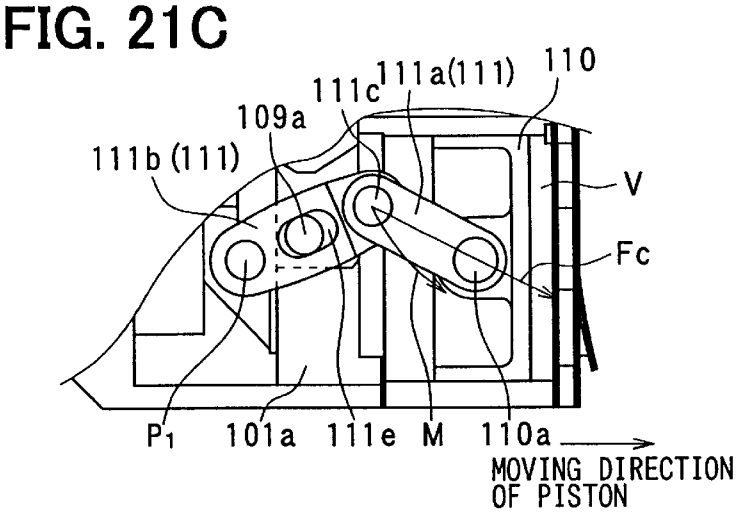
FIG. 21C
FIG. 21B
FIG. 21D

FLUID MACHINERY

CROSS REFERENCE TO RELATED APPLICATION

This application is based on and incorporates herein by reference Japanese Patent Application No. 2000-384250 filed on Dec. 18, 2000, and Japanese Patent Application No. 2001-280049 filed on Sep. 14, 2001.

BACKGROUND OF THE INVENTION

1. Field of the Invention

The present invention relates to fluid machinery that takes in and discharges fluid by reciprocating pistons, and more specifically, to fluid machinery that is applied to a compressor for a vapor compression refrigeration cycle.

2. Description of Related Art

In a compressor disclosed in JP-B No. 4-51667, by revolving a revolution disk around a shaft, pistons reciprocate in a direction orthogonal to a longitudinal direction of the shaft. In the invention disclosed in the above-described publication, because the pistons reciprocate in the direction orthogonal to the longitudinal direction of the shaft, a dimension in a radial direction of the compressor (dimension in a direction orthogonal to the longitudinal direction of the shaft) becomes large. That is, the stroke is large.

SUMMARY OF THE INVENTION

In view of the above, the present invention achieves its object of maintaining a smaller dimension in the direction orthogonal to a longitudinal direction of a shaft in a fluid machine that takes in and discharges fluid by reciprocating pistons.

In order to achieve the above-described object, the present invention has a shaft that rotates, a revolving member that revolves by being driven by the shaft, a piston that reciprocates in a direction parallel to a longitudinal direction of the shaft, and a link having one end movably connected to the piston while another end is movably connected to the revolving member. When the revolving member revolves, the piston reciprocates as the link swings with respect to the piston. Alternatively, when motion is transferred to the link from the revolving member when the revolving member revolves, only a radial directional component of the shaft is transferred to the link. Thereby, it is possible to reduce a dimension orthogonal to the longitudinal direction of the shaft.

In another alternative, a connecting portion of the link swings with respect to the revolving member in a plane parallel to a swinging plane of the link with respect to the piston. Thereby, it is possible to reduce a dimension of the direction orthogonal to the longitudinal direction of the shaft. Further yet, a regulating link may be pivotably connected to the revolving member with one end thereof being fixed to the housing so as to swing only in a surface parallel to a swinging surface of the link, while another end thereof is movable with respect to the revolving member in the direction orthogonal to the swinging surface. Thereby, it is possible to reduce a dimension of the direction orthogonal to the longitudinal direction of the shaft. Moreover, with the regulating link, it is possible to easily prevent the revolving member from rotating.

Continuing with alternate embodiments, there may be a linkage constituted of a first and second link rotatably connected to each other. One end of the first link is swingably connected to the piston and another end thereof is rotatably connected to a connecting portion provided on one end of the second link. Another end of the second link has a swing center fixed to the housing so that the second link can swing in a surface parallel to a swinging surface of the first link with respect to the piston. The second link is also swingably connected to the revolving member with a portion between the swing center and the connecting portion of the second link being movable in a direction orthogonal to the swinging surface. Accordingly, it is possible to reduce a dimension of the direction orthogonal to the longitudinal direction of the shaft.

The present invention may also be constructed so that the link swings with respect to the piston so that a connecting position of the link with the revolving member passes through a center of the piston and reciprocates on both sides of the piston with regard to the piston axial line (Lp) parallel to the longitudinal direction of the shaft. Accordingly, it becomes possible to have the piston reciprocate twice as the shaft rotates once. Thus, for example, in comparison to a swash plate type or a waffle-type compressor whose piston reciprocates once while the shaft thereof makes one rotation, it is possible to obtain an equal discharge amount with half the number of cylinders (a number of pistons). Thus, it is possible to reduce a number of pistons and parts related thereto, thus allowing for a lighter fluid machine as well as reducing manufacturing costs thereof.

Furthermore, the introduction of a rotation prevention mechanism (R) for preventing the revolving member from rotating with respect to the housings comprises a piston that reciprocates in a direction parallel to the longitudinal direction of the shaft, and a link having one end movably connected to the piston while another end is movably connected to the revolving member. The device further requires that when the revolving member revolves, the piston reciprocates by the link swinging with respect to the piston. Accordingly, it is possible to prevent the revolving member from revolving by the rotation prevention mechanism (R), and at the same time, to have the piston reciprocate in the direction parallel to the longitudinal direction of the shaft, and thus, it is possible to downsize a dimension of the direction orthogonal to the longitudinal direction of the shaft.

Additionally, by providing a balancer controlling means for changing an inertial moment of the balancer by interlocking with the operation of a stroke controlling means, it is possible to prevent an amplitude of the fluid machinery from increasing even when the discharge volume is variably controlled. In this case, it is desirable to change the inertial moment of the balancer by displacing a position of a gravity point of a plurality of weights with respect to the shaft.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF DRAWINGS

The invention, together with additional objectives, features and advantages thereof, will be best understood from the following description, the appended claims and the accompanying drawings in which:

FIG. 21A is a diagram illustrating forces acting on a revolving member in a compressor according to Embodiments of the present invention;

FIG. 21B is a diagram illustrating forces acting on a revolving member in a compressor according to Embodiments of the present invention;

FIG. 21C is a diagram illustrating forces acting on a revolving member in a compressor according to Embodiments of the present invention;

FIG. 21D is a diagram illustrating forces acting on a revolving member in a compressor according to Embodiments of the present invention;

DETAILED DESCRIPTION OF PREFERRED EMBODIMENTS

[Embodiment 1]

Figure 1:
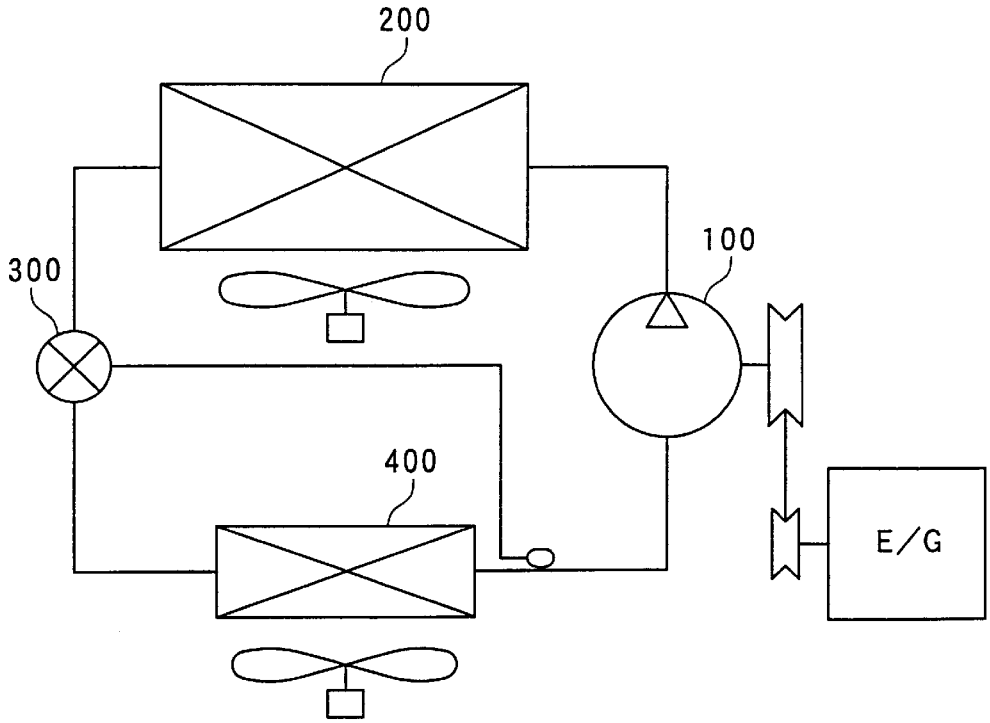
FIG. 1 is a diagram of a vapor compression refrigerator using a compressor according to embodiments of the present invention.

The present embodiment is a fluid machine applied to a compressor of a vehicular air conditioning system (a vapor compression refrigerator), and FIG. 1 is a diagram of a vehicular air conditioning system (a vapor compression refrigerator).

In FIG. 1, reference numeral 100 denotes a compressor (a fluid machine) according to the present embodiment. The compressor 100 takes in and compresses (intake/discharge) coolant by gaining power from a traction engine E/G through a clutching means (not shown) for intermittently transferring motive energy of a electromagnetic clutch and the like. The compressor 100 will be described in detail later.

Reference numeral 200 denotes a radiator (a condenser) for cooling (condensing) the coolant by exchanging heat discharged from the compressor 100 with ambient air. A depressurizer 300 is used for expanding the coolant flowing out from the radiator 200 and a vaporizer 400 is used for blowing cool air into a car room by vaporizing the coolant which is depressurized by the depressurizer 300. The present embodiment employs a, so-called, thermal expansion valve as the depressurizer 300, which controls valve travel so as to heat the coolant on an outlet side of the vaporizer 400 (on an intake side of the compressor 100) to a predetermined temperature.

Figure 2:
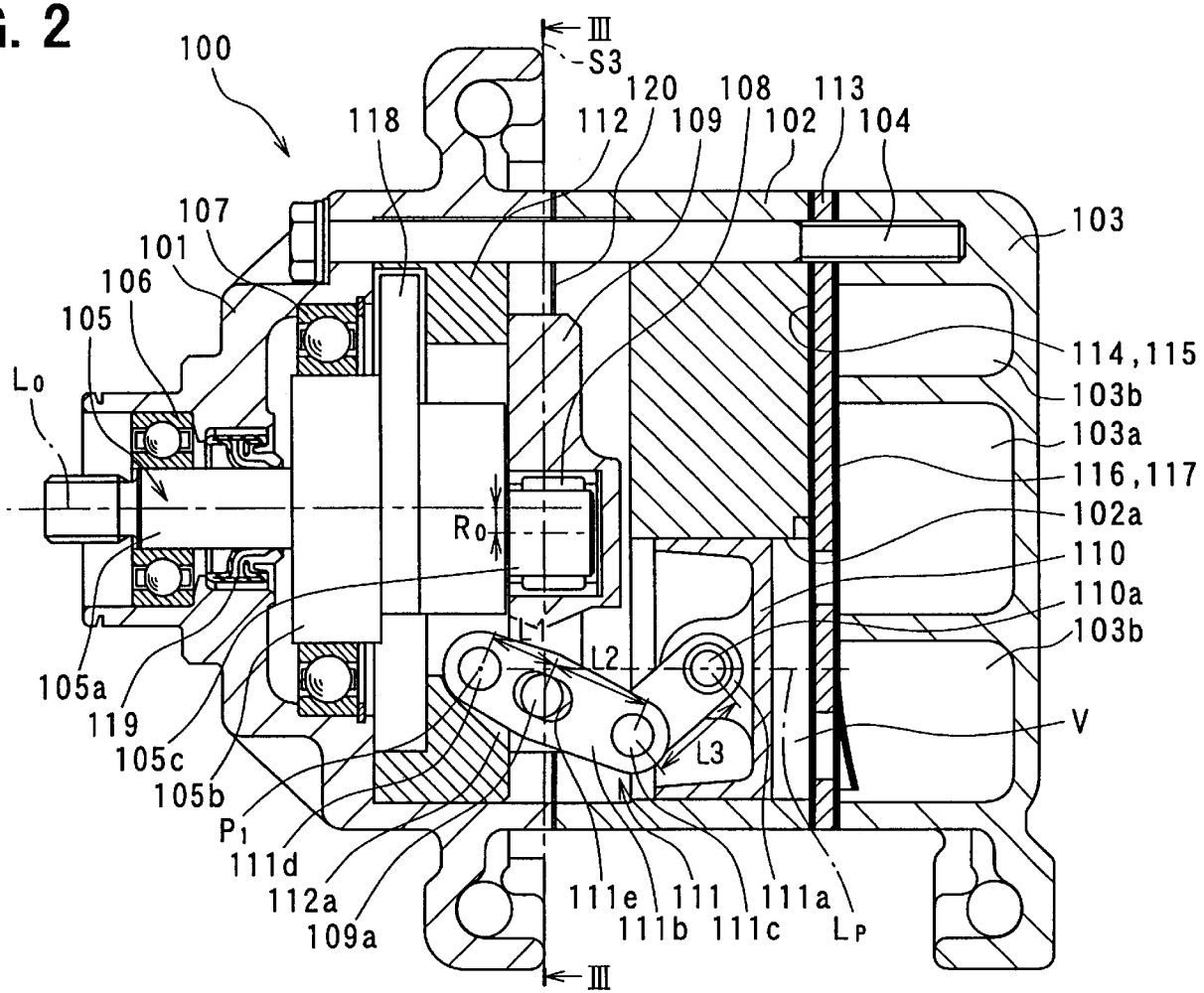
FIG. 2 is a cross-sectional view of a compressor according to Embodiment 2 of the present invention.

Next, the compressor 100 will be described. FIG. 2 shows a cross-sectional view in an axial direction of the compressor 100, in which reference numeral 101 denotes a front housing, 102 denotes a cylinder block (a middle housing), and 103 denotes a rear housing. The housings 101 to 103 are collectively called a housing. The housings 101 to 103 in the present embodiment are made of aluminum, and are fastened (or fixed) by a bolt 104 connecting the front housing 101 to the rear housing 103.

A shaft 105, disposed within the housing, rotates by gaining motive energy from the engine E/G. A rolling radial bearing 106 exists for rotatably supporting the shaft 105 with a first diameter portion 105*a* of the shaft 105, while 107 denotes a rolling radial bearing for rotatably supporting the shaft 105 within a large opening portion 105*b* of the shaft 105.

The rolling radial bearing 106 is attached to the first diameter portion 105*a* of the shaft 105 by transition fit or clearance fit, while the rolling radial bearing 107 is attached to the front housing 101 by being fitted into the large opening portion 105*b*.

A side end portion of the cylinder block 102 of the shaft 105 has a cylindrical crank portion 105*c* (eccentric portion) provided thereon, the crank portion is eccentric to the rotation center Lo of the shaft 105 by a predetermined amount Ro. A revolving member 109 of aluminum is connected to the crank portion 105*c* via a shell-type (a type without a bearing inner ring) needle-like roller bearing (needle bearing) 108.

Reference numeral 110 denotes a hollow aluminum piston that reciprocates in a direction parallel to a longitudinal direction of the shaft 105 within three cylinder bores (cylindrical space) 102*a* formed in the cylinder block 102. A link 111, whose one end is swingably connected with the piston 110 via a piston pin 110*a* while another end is movably connected with the revolving member 109. Expressions "one end" and "the other (another) end" used herein do not strictly mean end portions of the link, and "one end" simply means an opposite side from the other side of the link 111 while "the other end" means an opposite side of the "one end" of the link 111.

The link 111 is comprised of a first link 111*a* of aluminum and a second link 111*b* of iron, the first link 111*a* and the second link 111*b* being rotatably connected to each other. One end of the first link 111 is swingably connected by the piston pin 110*a* made of bearing steel, and another end thereof is rotatably connected to one end of the second link 111*b* by a node pin (connecting portion) 111*c* of bearing steel.

A swing center P1 of the other end of the second link 111*b* is fixed to the housing (front housing 101) via a pivot pin 111*d* of bearing steel in such a manner that the second link 111*b* can swing in a surface S2 (FIG. 3) parallel to a swing surface S1 (FIG. 3) of the first link 111*a* with respect to the housing.

Figure 3:
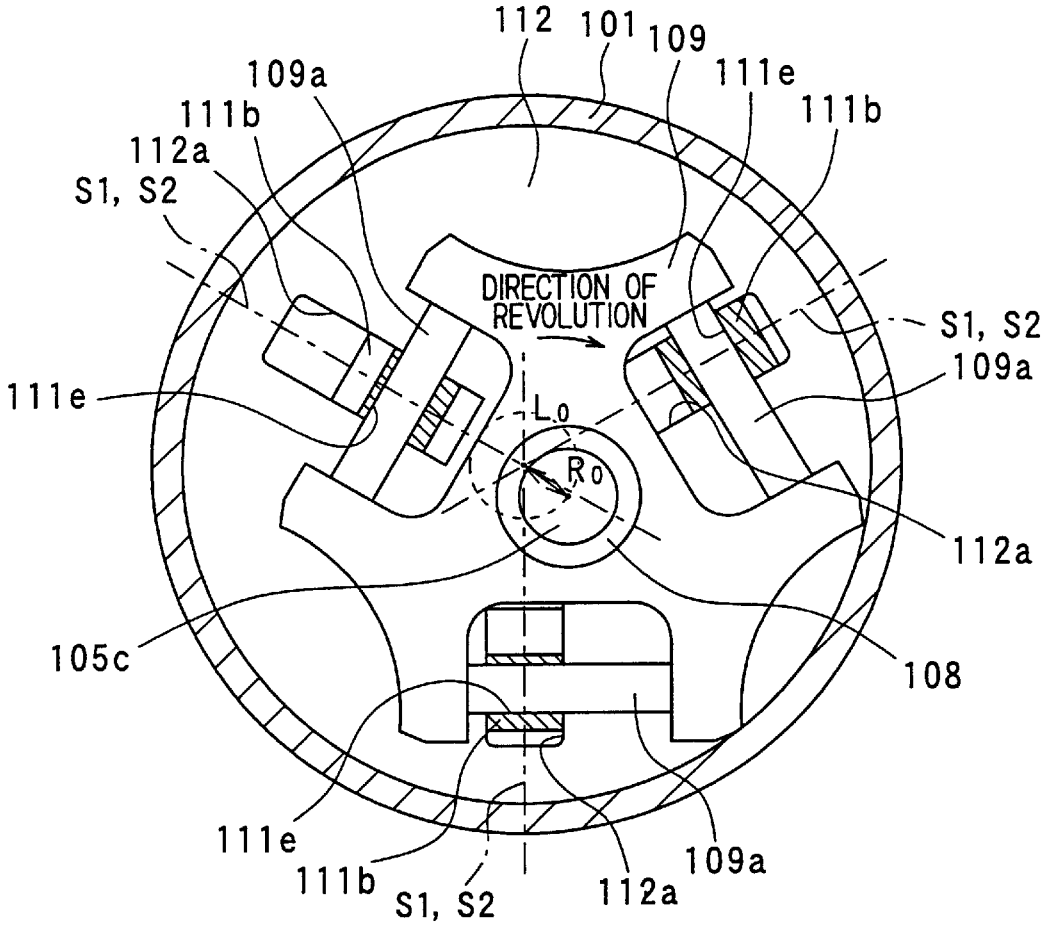
FIG. 3 is a cross-sectional view taken along III—III of FIG. 2.
Figure 4A:
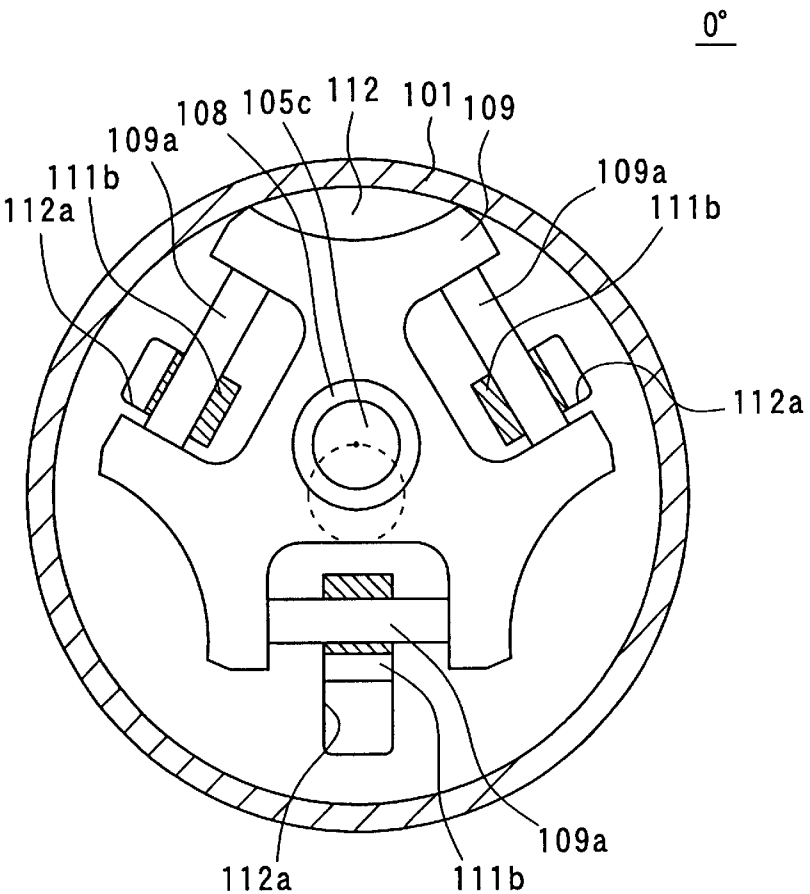
FIG. 4A is a cross-sectional view corresponding to the cross-sectional view taken along III—III of FIG. 2 when a rotation angle is 0°.
Figure 4B:
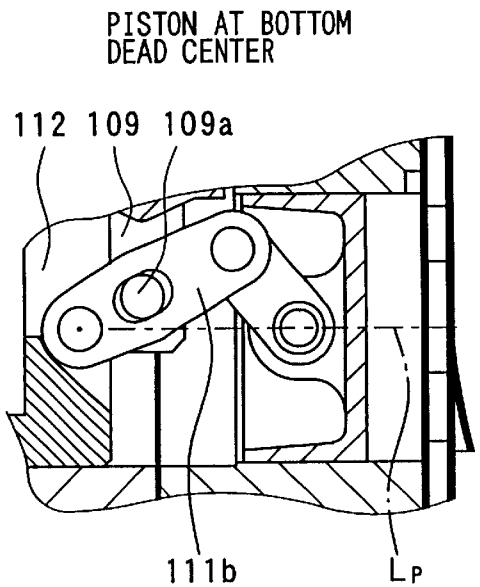
FIG. 4B is an enlarged view of a piston part when the rotation angle is 0°.

In the present embodiment, the pivot pin 111*d* is not fixed directly to the housing (front housing 101), but via a fixed disk 112 of aluminum which is fitted into the front housing 101 so as to be fixed thereon. The swing surface S1 of the first link 111*a* with respect to the piston 110 and the surface S2 parallel to the swing surface S1, mean surfaces in a radial direction passing through the rotating center Lo of the shaft 105 as shown in FIG. 3.

As shown in FIG. 2, the second link 111*b* is swingably connected to a revolving member 109 in such a manner that the second link 111*b* is movable in a direction orthogonal to the surfaces S1 and S2 with respect to the revolving member 109 at a portion between the swing center P1 and the node pin (connecting portion) 111*c*of the second link 111*b*. Specifically, at a connecting portion of the second link 111*b*by connecting with the revolving member 109, a long hole 111*e* having a major axis in a direction generally parallel to the longitudinal direction of the second link 111*b* is formed, while as shown in FIG. 3, the revolving member 109 is provided with a sliding pin 109*a* of bearing steel penetrating the long hole 111*e* while being in sliding contact with an inner wall of the long hole 111*e*. The sliding pin 109*a* is inserted into the revolving member 109 and has a clearance fit so as to be prevented from sliding. A clearance groove 112*a* is used for preventing the second link 111*b* from interfering with the fixed disk when the second link 111*b* swings.

In FIG. 2, reference numeral 113 denotes a valve plate disposed between the cylinder block 102 and the rear housing 103 to block a rear housing 103 side of the cylinder bore 102*a*. Between the valve plate 113 and the cylinder block 102, is a gasket 114 for sealing a space therebetween, and a reed-valve-like inlet valve 115 for preventing the coolant taken in by the cylinder bore 102*a* (actuation chamber V) from the intake chamber 103*a* from flowing back to the intake chamber 103*a*, the intake chamber 103*a* formed on a side of the rear housing 103. On the other hand, between the valve plate 113 and the rear housing 103, there is provided a gasket 116 for sealing a space therebetween, and a reed-valve-like inlet valve 117 for preventing the coolant discharged to a discharge chamber 103*b* from the cylinder bore 102*a* (actuation chamber V) from flowing back to the cylinder bore 102*a* (actuation chamber V), the discharge chamber 103*b* formed on a side of the rear housing 103.

At that time, the valve plate 113, the gaskets 114 and 116, the intake valve 115 and the discharge valve 117 are interposed between the cylinder block 102 and the rear housing 103 and held together by a fastening force by bolt 104 so as to be fixed therebetween.

The rear housing 103 has an inlet (not shown) connected to a vaporizer 400 side communicating with the intake chamber 103, and an outlet (not shown) connected to a radiator 200 side communicating with the discharge chamber 103*b* formed therein. Reference numeral 118 denotes a balance weight for canceling out an eccentric force (centrifugal force) acting upon the shaft 105 when the revolving member 109 rotates around the shaft 105 (rotation center Lo) by rotating along with the shaft 105. Reference numeral 119 denotes a shaft seal of rubber for preventing the coolant from leaking into the housing from the cylinder bore 102*a* (actuation chamber V) and from leaking outside from a space between the shaft 105 and the housing (front housing 101), and 120 denotes a gasket for sealing a space between the front housing 101 and the cylinder block 102.

Next, operation of the compressor according to the present embodiment will be described. When the shaft 105 rotates, as previously described, the second link 111*b* is swingably connected to the revolving member 109 in such a manner that the second link 111*b* and the revolving member 109 are movable with respect to a direction orthogonal to the surfaces S1 and S2. At the same time, the second link 111*b* swings only in the surface S2 parallel to the swing surface S1 because it is regulated by the pivot pin 111*d*. Thus, as shown in FIGS. 4A to 7A, the revolving member 109 does not rotate with respect to the housing (front housing 101) by gaining driving force from the crank portion 105*c*, but revolves around the rotation center Lo in the surface S3 (see FIG. 2) orthogonal to the longitudinal direction of the shaft 105 having the eccentric amount Ro as its revolving radius.

Herein, "the revolving member 109 revolves around the rotation center Lo" does not mean that the entire revolving member 109 revolves around the rotation center Lo, but rather it means "a part of the revolving member 109 corresponding to a center of the crank portion 105*c* revolves around the rotation center Lo".

Figure 5A:
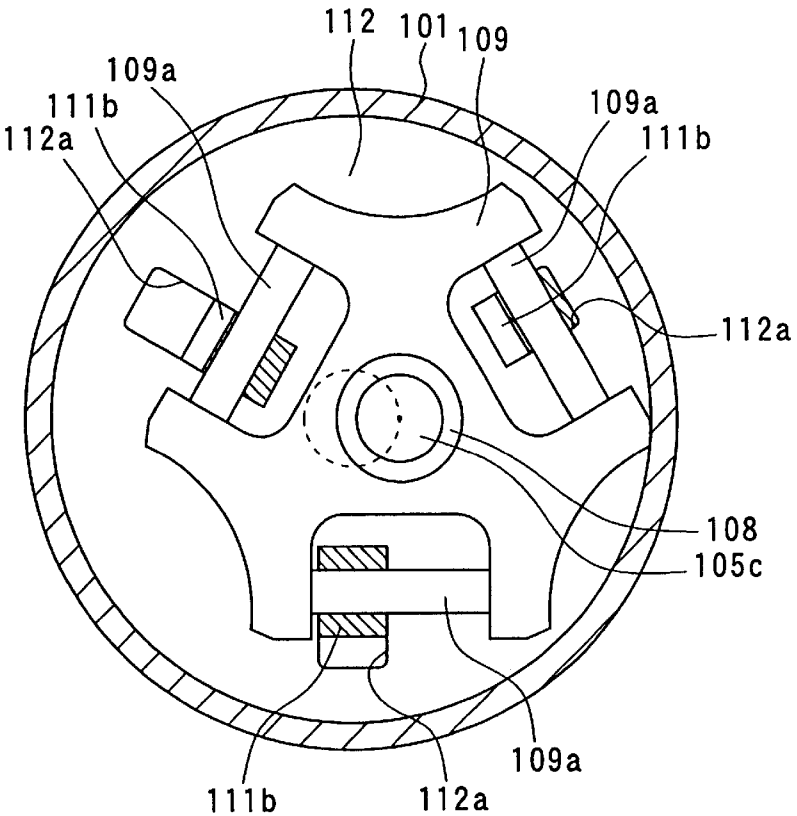
FIG. 5A is a cross-sectional view corresponding to the cross-sectional view taken along III—III of FIG. 2 when a rotation angle is 90°.
Figure 5B:
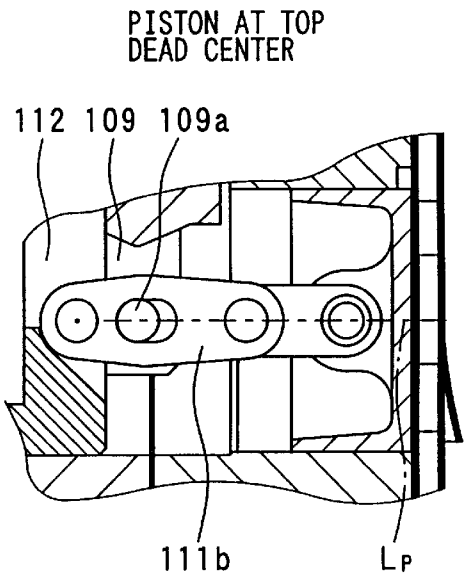
FIG. 5B is an enlarged view of a piston part when the rotation angle is 90°.
Figure 6A:
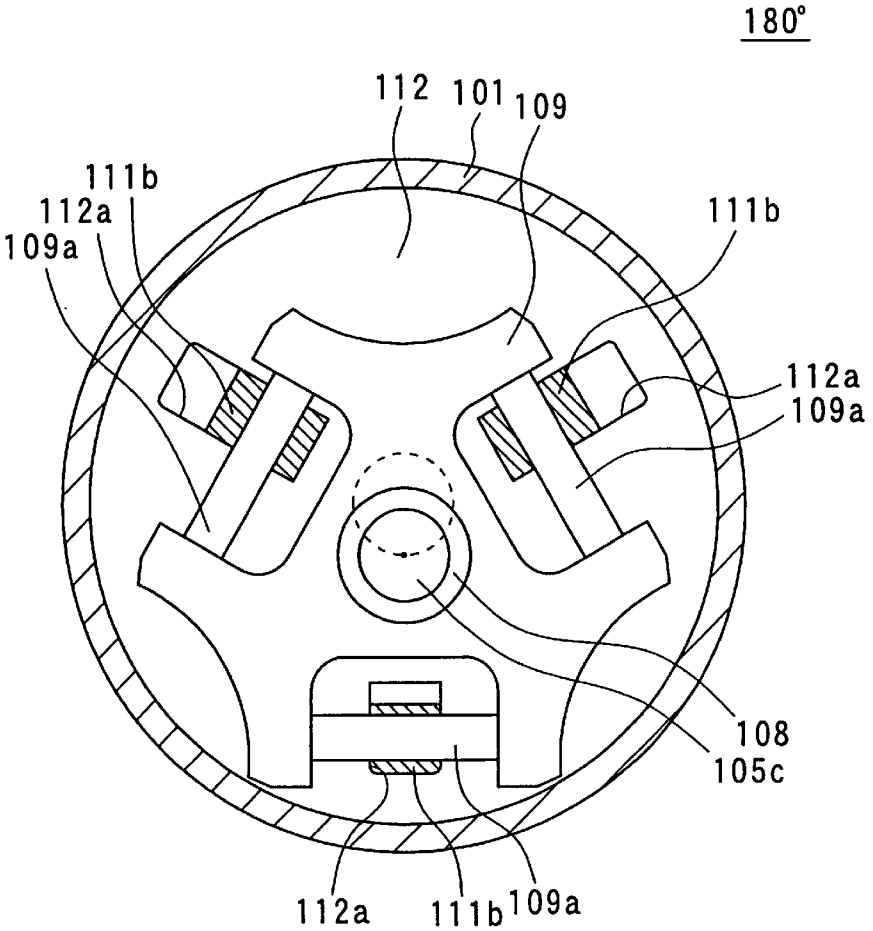
FIG. 6A is a cross-sectional view corresponding to the cross-sectional view taken along III—III of FIG. 2 when a rotation angle is 180°.
Figure 6B:
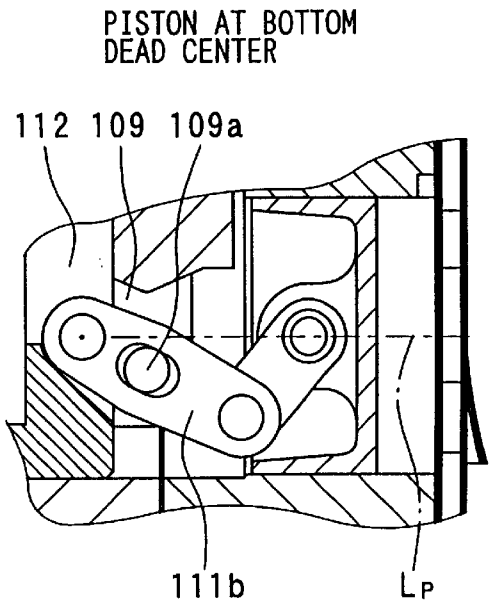
FIG. 6B is an enlarged view of a piston part when the rotation angle is 180°.
Figures 7A, 7B:
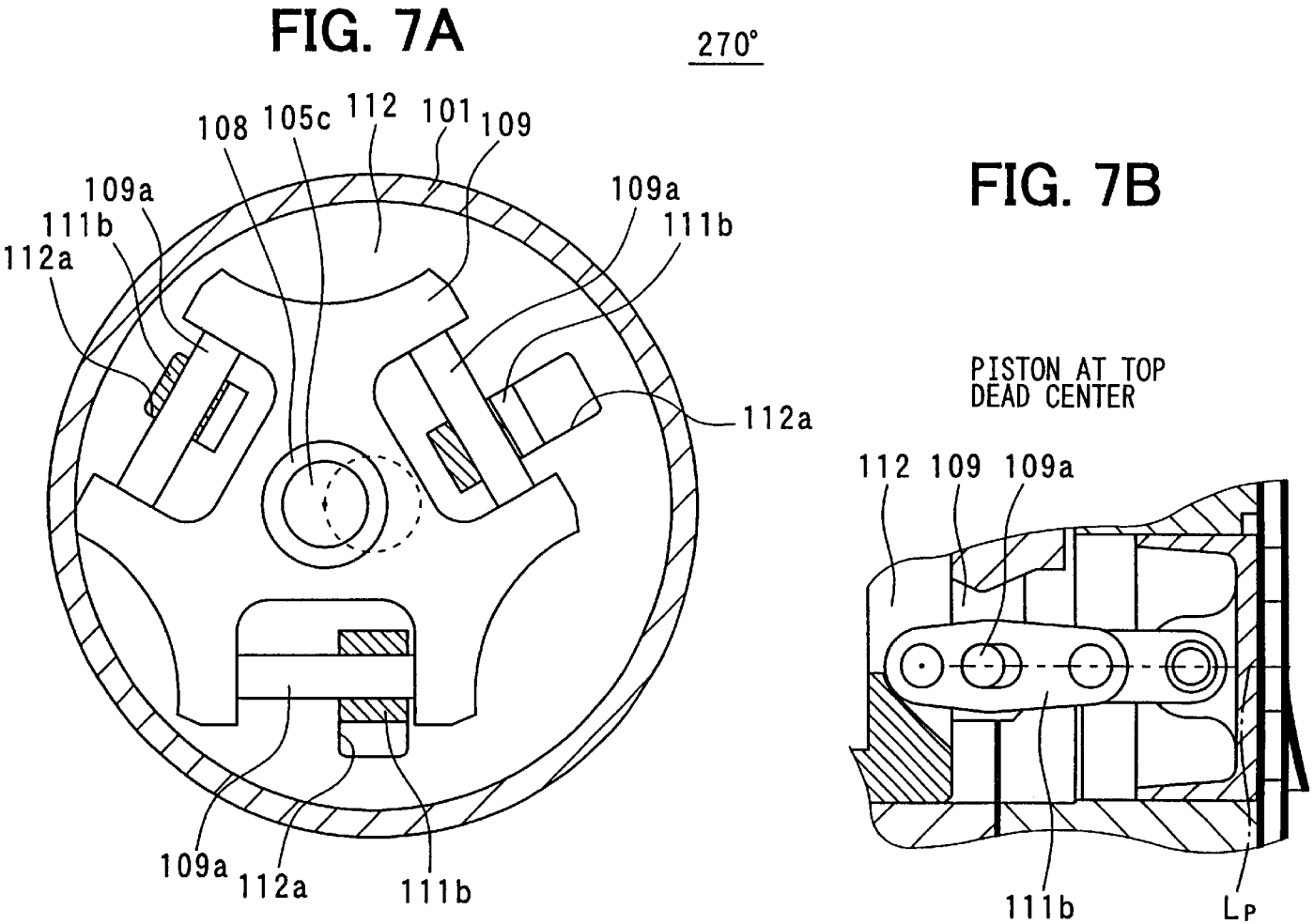
FIG. 7A is a cross-sectional view corresponding to the cross-sectional view taken along III—III of FIG. 2 when a rotation angle is 270°.
FIG. 7B is an enlarged view of a piston part when the rotation angle is 270°.

In the present embodiment, the crank portion 105*c* is constructed to revolve around a shaft core of the shaft 105. However, in a case where the revolving center of the crank portion 105*c* is shifted from the shaft core of the shaft 105 by gears, for example, the revolving center of the crank portion 105*c* acts around the rotating center Lo in the present invention. FIGS. 4 to 7 are showing the following: FIG. 4 shows a reference position (0°) of the shaft 105, and the rest of the figures show a rotation angle of the shaft 105 being shifted by 90° sequentially. Specifically, FIG. 5 shows the rotation angle of the shaft 105 being 90°, FIG. 6 shows the rotation angle thereof being 180°, and FIG. 7 shows the rotation angle thereof being 270°.

Now, the link 111 (the second link 111*b*) is regulated by the pivot pin 111*d* so as to be swingable only in the surface S2 parallel to the swing surface S1, and thus, when the revolving member 109 revolves as the shaft 105 rotates, the sliding pin 109*a* moves with respect to the link 111 (the second link 111*b*) in a direction orthogonal to the longitudinal direction of the link 111 (the second link 111*b*) while being in contact with the inner wall of the long hole 111*e* of the second link 111*b* as shown in FIGS. 4A to 7A.

Specifically, when the revolving member 109 revolves, of a motion transferred from the revolving member 109 to the link 111 (the second link 111*b*) by the long hole 111*e* and the sliding portion 109*a*, only a radial directional component of the shaft 105 is transferred. Therefore, when the revolving member 109 revolves once, in a cross-sectional view shown in FIG. 2, it appears that the center of the sliding pin 109*a* reciprocates one time in an up-to-down direction (the radial direction of the shaft 105).

At that time, in the present embodiment, the link 111 (the first link 111*a*) is constructed so as to swing with respect to the piston 110 in such a manner that the center of the sliding pin 109*a* as a connecting portion with the revolving member 109 of the link 111 (the second link 111*b*) moves both sides centered about a piston axis line Lp parallel to the longitudinal direction of the shaft 105 by passing the center of the piston 110, as shown in FIGS. 4B to 7B. Thus, when the revolving member 109 revolves once, the piston 110 reciprocates twice in the cylinder bore 102*a*.

Specifically, if a position of the piston 110 is at the bottom dead center (i.e., a volume of the actuation chamber V is at its maximum) when the rotation angle of the shaft 105 is 0° (see FIG. 4), then the piston 110 is at the top dead center (i.e., the volume of the actuation chamber V (FIG. 2) is at its minimum) as the rotation angle of the shaft 105 moves to 90° (see FIG. 5).

When the shaft further rotates until the rotation angle thereof becomes 180° (see FIG. 6), the piston 110 goes back to the bottom dead center. Furthermore, when the shaft 105 rotates until the rotation angle thereof becomes 270° (see FIG. 7), then the piston 110 again reaches the top dead center. Thus, when revolving member 108 revolves once, the piston 110 reciprocates twice in the cylinder bore 102*a*. As described above, in the compressor according to the present embodiment, the piston 110 makes reciprocating motion by revolving the revolving member 109, and thus, the compressor according to the present invention is called a revolution plate piston type compressor.

Next, features (effects) of the present embodiment will be described. According to the present embodiment, the piston 110 reciprocates in a direction parallel to the longitudinal direction of the shaft 105, thus enabling a reduction in a direction orthogonal to the longitudinal direction of the shaft 105.

In the present embodiment, when the revolving member 109 revolves once, the piston 110 makes reciprocating motion twice in the cylinder bore 102*a*. Therefore, in comparison to a swash plate type or a waffle-type compressor whose piston reciprocates once while the shaft thereof rotates once, an equal discharge amount can be obtained with half the number of cylinders (a number of pistons). Thus, it is possible to reduce a number of pistons 110 and parts related thereto, thus allowing for a lighter compressor 100 as well as reducing a manufacturing cost thereof.

Moreover, in the present embodiment, the piston 110 is hollowed accounting for a lighter weight of each of the pistons 110. Also, the sliding pin 109*a* of the revolving member 109 is connected to the link 111 (the second link 111*b*) so as to be movable only in the direction orthogonal to the longitudinal direction of the link 111 (the second link 111*b*), thereby providing a rotation prevention mechanism R for preventing rotation of the revolving member 109. Accordingly, it is unnecessary to provide a special mechanism such as a pin-ring type rotation prevention mechanism of the scroll-type compressor. Therefore, it is possible to reduce a number of parts for the compressor 100, thus allowing for a reduction of manufacturing cost of the compressor 100.

Now, as is obvious from FIGS. 4B to 7B, a stroke (travel distance) of the piston 110 is determined by a distance between two positions, one of the two positions being a position of the piston pin 110*a* at a time when the first link 111*a* and the second link 111*b* is aligned linearly, and another position being a position of the piston pin 110*a* at a time when the first link 111*a* and the second link 111*b* are bent or kinked as far as possible.

Therefore, by changing the ratio of dimension L1 (a distance from the center of the pivot pin 111*d* to the center of the long hole 111*e*) to dimension L2 (a distance from the center of node pin 111*c* to the center of the long hole 111*e*), and a link length L3 of the first link 111 (a distance from the center of the node pin 111*c* to the center of the piston pin 110*a*), it becomes possible to easily change the stroke (travel distance) of the piston 110 (i.e., it is possible to make the stroke larger or smaller). Consequently, it is possible to easily design and manufacture compressors having different strokes for the pistons 110 (and therefore different discharge volumes of the compressor 100).

[Embodiment 2]

Figure 8:
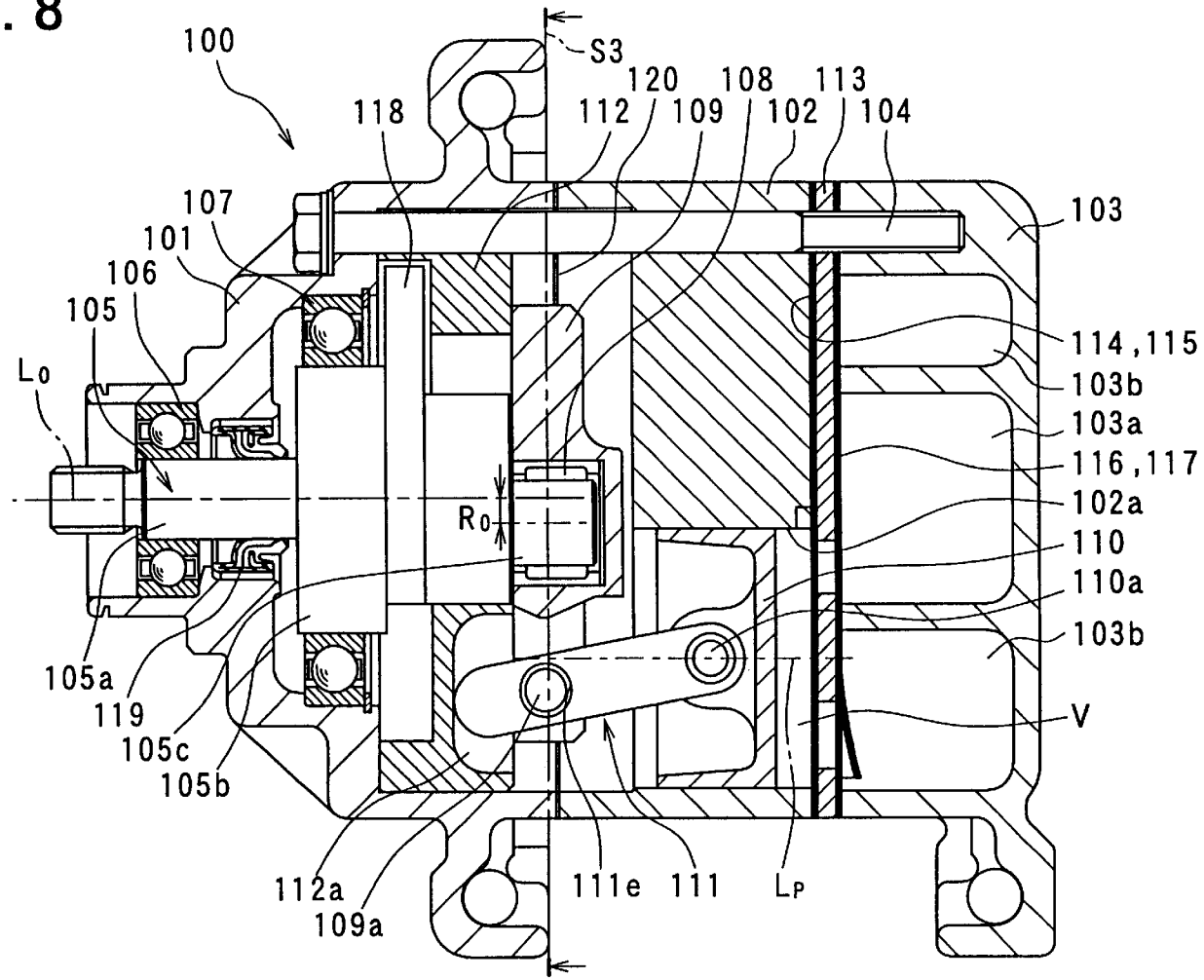
FIG. 8 is a cross-sectional view of a compressor according to Embodiment 2 of the present invention.

In Embodiment 1, the link 111 is comprised of two links (the first and the second links 111*a* and 111*b*, respectively). Alternatively, in the present embodiment, as shown in FIG. 8, the link 111 is constituted of one link member. Specifically, and similar to Embodiment 1, one end of the link 111 is swingably connected to the piston 110 by the piston pin 110*a* while another end thereof is slidably connected to the sliding pin 109*a*, thereby the other end of the link 111 can move in a direction orthogonal to the surfaces S1 and S2 with respect to the revolving member 109 similar to the connecting portion of the second link 111*b* and the revolving member 109 in Embodiment 1. At the same time, the other end of the link 111 can swing with respect to the revolving member 109 (the sliding pin 109*a*).

By extending the other end of the link 111 to the clearance groove 112*a* as well as by having the clearance groove 112*a* serve as the guide groove, the link 111 is regulated so as to swing only on the surface S2 parallel to the swing surface S1. In the Embodiment 1, the hole 111*e* is a long hole. Alternatively, in the present embodiment, the hole 111*e* is a simple round hole.

The link 111 is regulated by the clearance groove (guide groove) 112*a* so as to swing only in the surface S2 parallel to the swing surface S1, and therefore, similarly to Embodiment 1, rotation of the revolving member 109 can be prevented without specially providing the rotation prevention mechanism.

[Embodiment 3]

Figure 9:
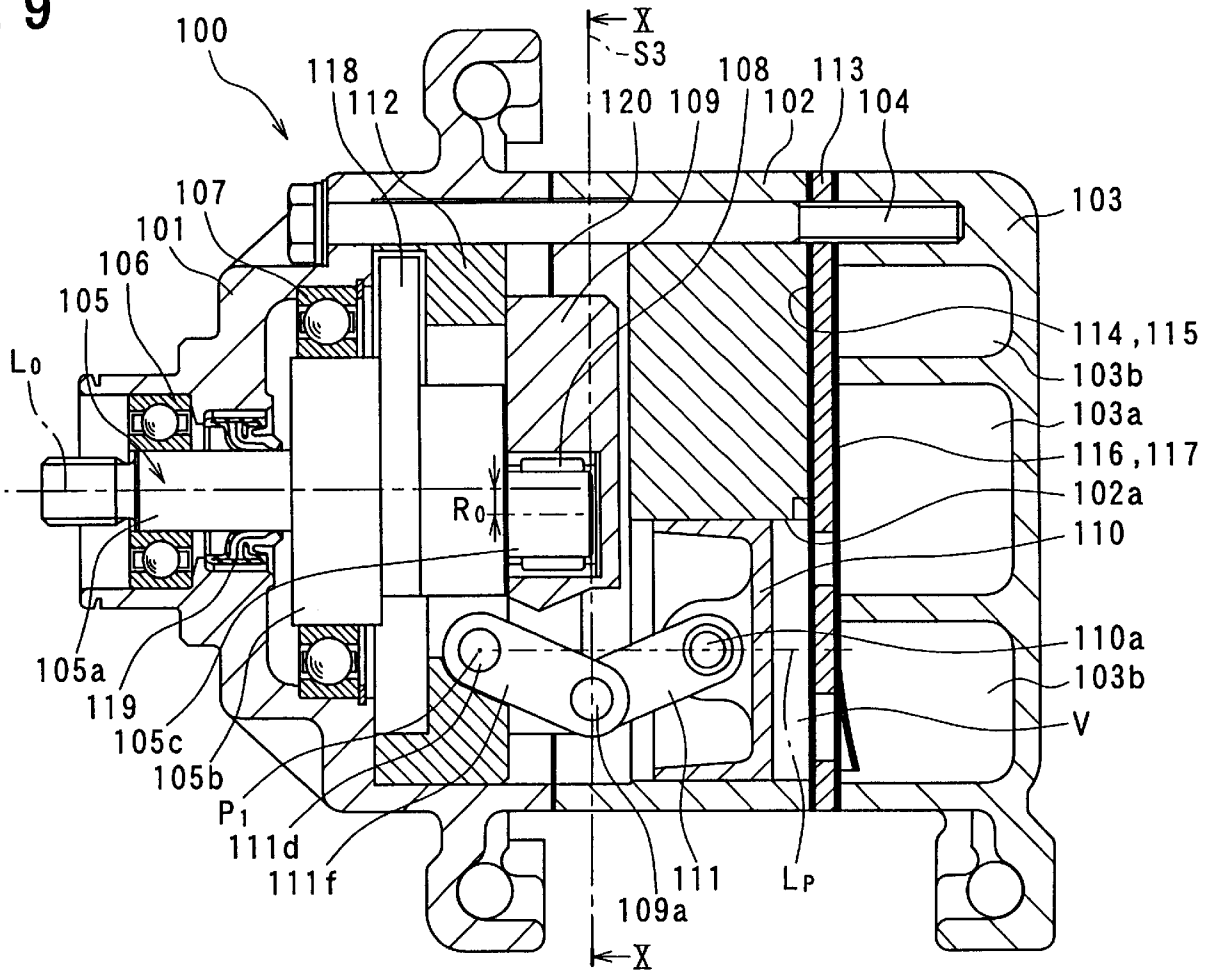
FIG. 9 is a cross-sectional view of a compressor according to Embodiment 3 of the present invention.

In Embodiment 2, the other end of the link 111 is extended to the clearance groove 112*a* which controls the link 111 to swing only in the surface S2 parallel to the swing surface S1 so as to prevent rotation of the revolving member 109. In the present embodiment, as shown in FIG. 9, similarly to the other end of the second link 111*b* according to Embodiment 1, a regulation link 111*f* swingably connected to the revolving member 109 is provided so that the swing center P1 thereof is fixed to the housing (front housing 101) via the pivot pin 111*d* in such a manner that the second link 111*b* can swing only in the surface S2 parallel to the swing surface S1 of the first link 111*a* with respect to the piston 110, while the other end thereof can move and swing in the direction orthogonal to the surfaces S1 and S2 in a similar manner to the connecting portion of the revolving member 109 and the second link 111*b* according to Embodiment 1.

Thereby, similarly to Embodiment 2, it is possible to prevent the revolving member 109 from rotating without specially providing the rotation prevention mechanism.

Figure 10:
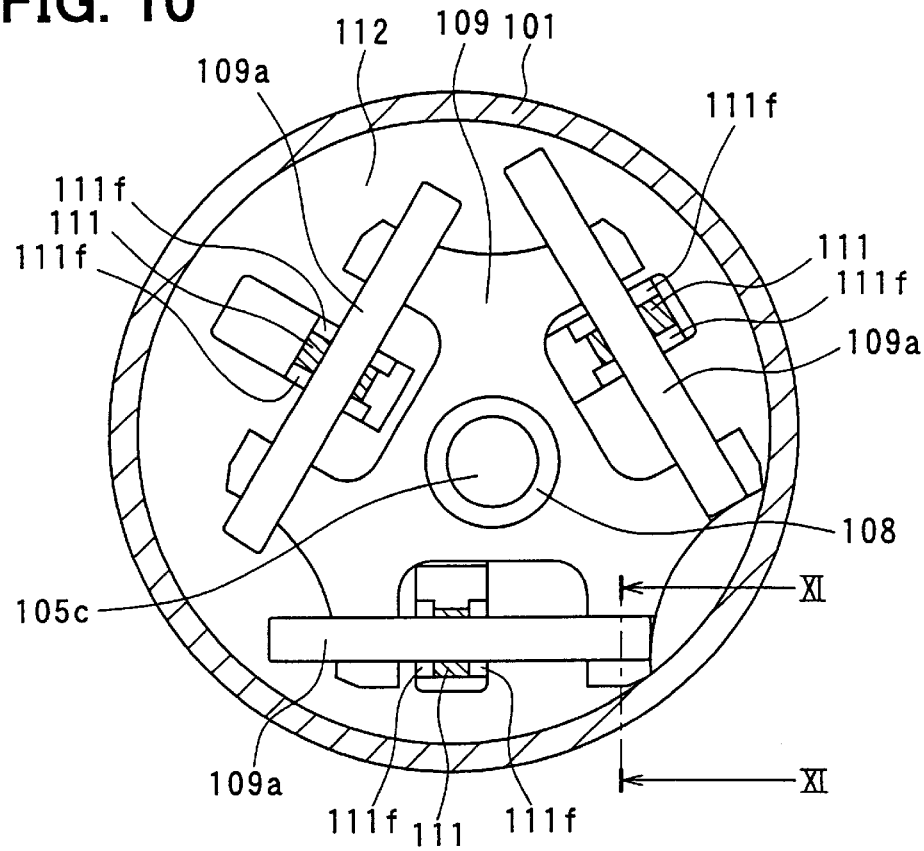
FIG. 10 is a cross-sectional view taken along X—X of FIG. 9.

In the present embodiment, as shown in FIG. 10, the regulation link 111*f* and the link 111 are connected by the sliding pin 109*a* so as to swing relative to each other, but they do not have to be connected as shown in FIG. 10 as long as they are connected in such a manner that the other end of the regulation link 111*f* can move in the direction orthogonal to the surfaces S1 and S2, and is swingably connected to the revolving member 109.

Figure 11:
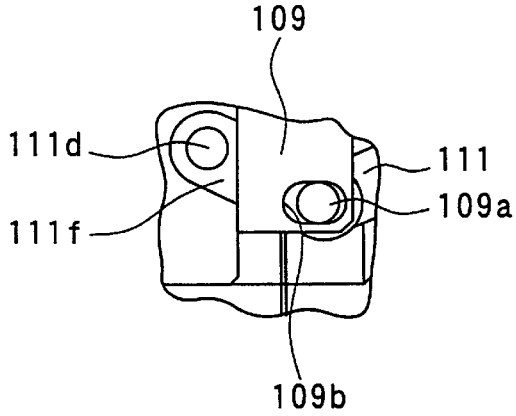
FIG. 11 is a cross-sectional view taken along XI—XI of FIG. 10.

In the present embodiment, the sliding pin 109*a* is fitted into the connecting portion (the link 111 in the present embodiment) of the regulation link 111*f* and the link 111 so as to be fixed thereto, so that the sliding pin 109*a* slides with respect to the revolving member 109. Therefore, as shown in FIG. 11, the aperture 109*b* for inserting the sliding pin 109*a* formed to the revolving member 109 is formed in a long hole shape.

[Embodiment 4]

Figure 12:
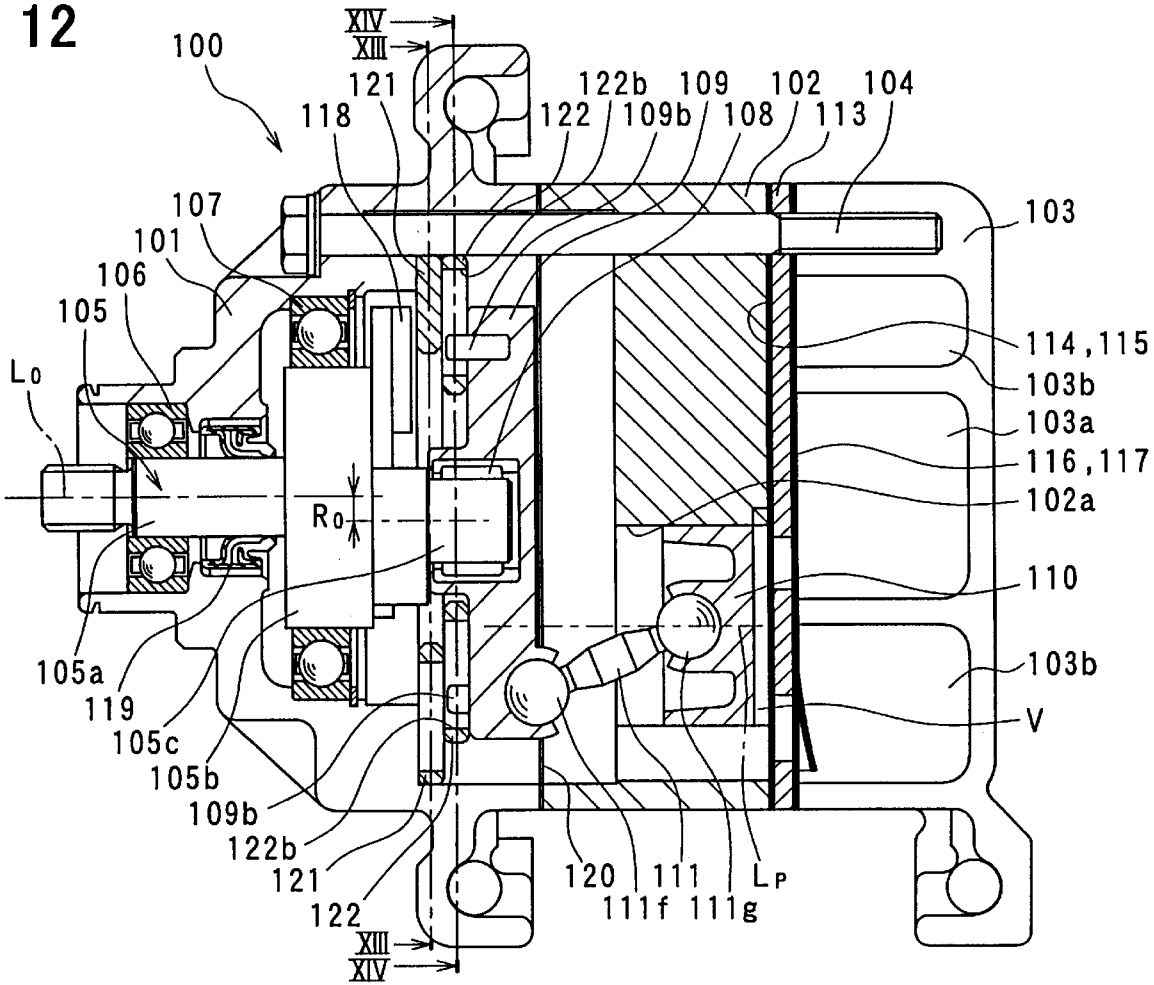
FIG. 12 is a cross-sectional view of a compressor according to Embodiment 4 of the present invention.

In the above-described embodiments, the link 111 for connecting the revolving member 109 and the piston 110 is controlled so as to swing only in the surface S2 parallel to the swing surface S1 by a pin (piston pin 110*a* and pivot pin lid) disposed parallel to a surface S3 orthogonal to the longitudinal direction of the shaft 105. In the present embodiment, however, as shown in FIG. 12, one link (connecting rod) 111, the revolving member 109 and the piston 110 are connected by spherical-shape sliding joint portions 111*f* and 11*g*. At the same time, a center of the sliding joint portion 111*f* (a connecting portion of the revolving member 109 and the link 111) reciprocates in a radial direction of the shaft 105 only on one side (in the present embodiment, an outer side in the radial direction of the shaft 105) without crossing over an axial line Lp of the piston.

In the present embodiment, the center of the sliding joint portion 111*f* reciprocates in the radial direction of the shaft 105 only on one side without crossing over the piston axial line Lp, and thus, the piston 110 reciprocates once as the shaft 105 rotates once.

In the present embodiment, the link 111 and the revolving member 109 and the piston 110 are connected by the spherical-shaped sliding joint portions 111*f* and 111*g*. Accordingly, at the link 111, the revolving member 109 cannot revolve around the rotation center Lo without rotating with respect to the housing (front housing 101).

In view of this, in the present embodiment, a rotation prevention mechanism R is constituted of two disks (a fixed disk 121 and a movable disk 122) which control the revolving member 109 so as to revolve around the rotation center Lo without rotating with respect to the housing (front housing 101).

Figure 13:
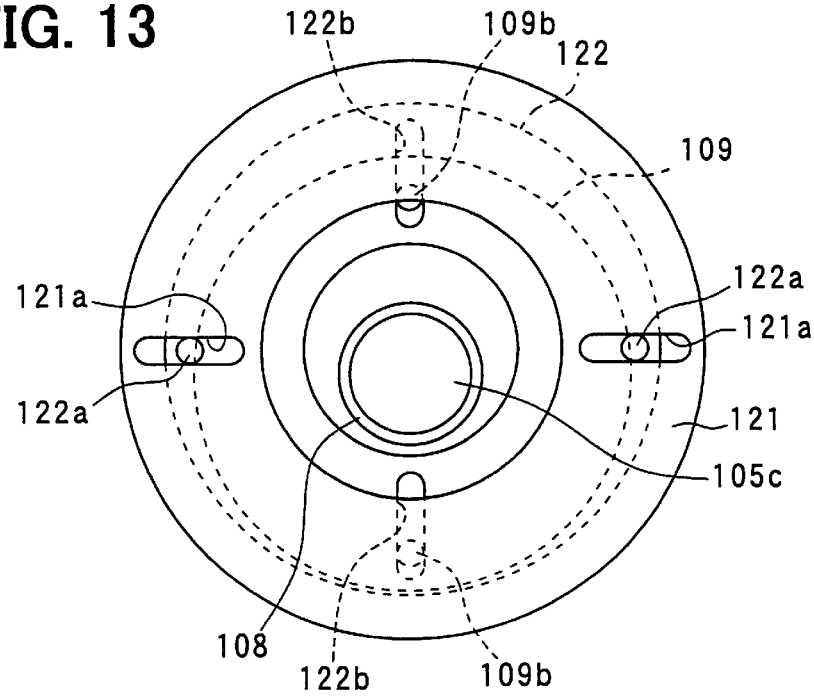
FIG. 13 is a cross-sectional view taken along XIII—XIII of FIG. 12.

Specifically, the fixed disk 121 is fitted into the housing (front housing 101) to be fixed thereto, and as shown in FIG. 13, a plurality of long holes 121*a* (two apertures in the present embodiment) extending in the radial direction of the fixed disk 121 are provided. On the other hand, the movable disk (movable member) 122 is provided with a pin portion 122*a* which is inserted into the long holes 121*a* of the fixed disk 121 so as to be displaced by sliding along a major axial direction of the long holes 121*a*.

Figure 14:
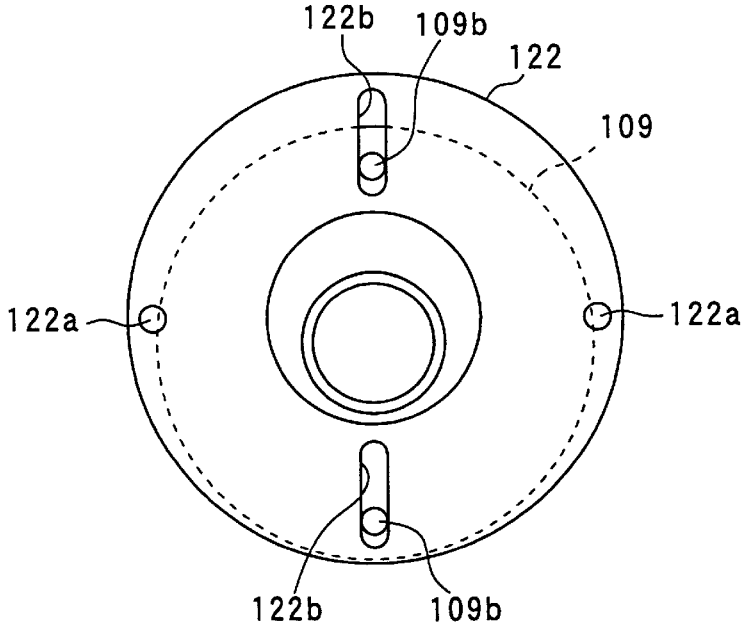
FIG. 14 is a cross-sectional view taken along XIV—XIV of FIG. 12.
Figure 15A:
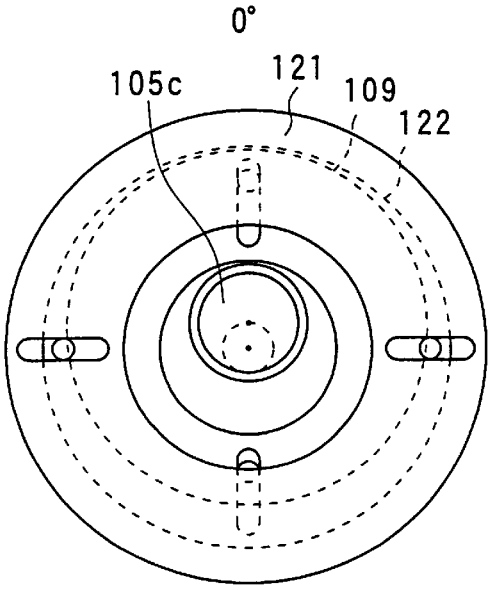
FIG. 15A is a cross-sectional view corresponding to the cross-sectional view taken along XIII—XIII of FIG. 12 when a rotation angle is 0°.
Figure 15B:
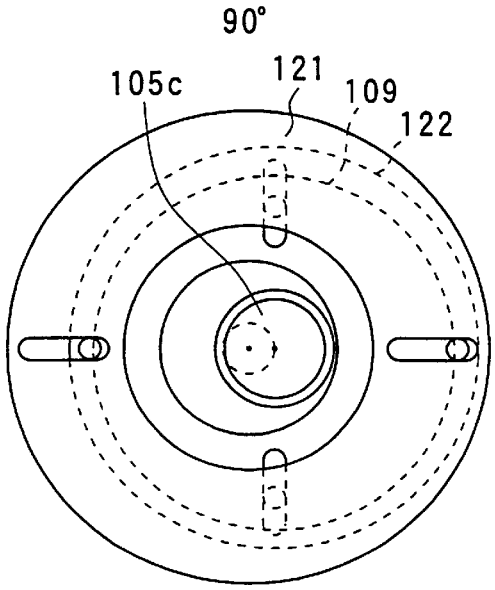
FIG. 15B is a cross-sectional view corresponding to the cross-sectional view taken along XIII—XIII of FIG. 12 when a rotation angle is 90°.
Figure 15C:
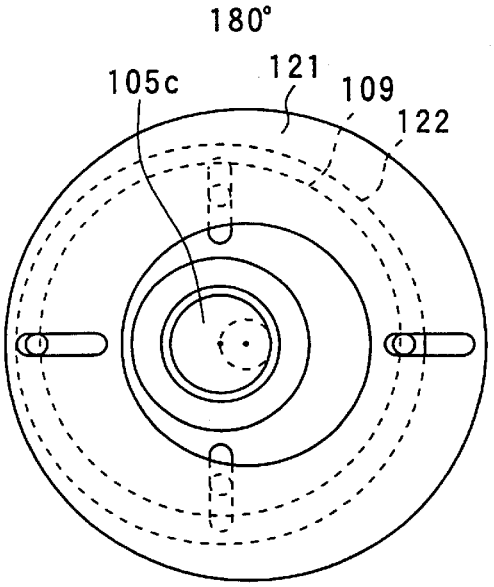
FIG. 15C is a cross-sectional view corresponding to the cross-sectional view taken along XIII—XIII of FIG. 12 when a rotation angle is 180°.
Figure 15D:
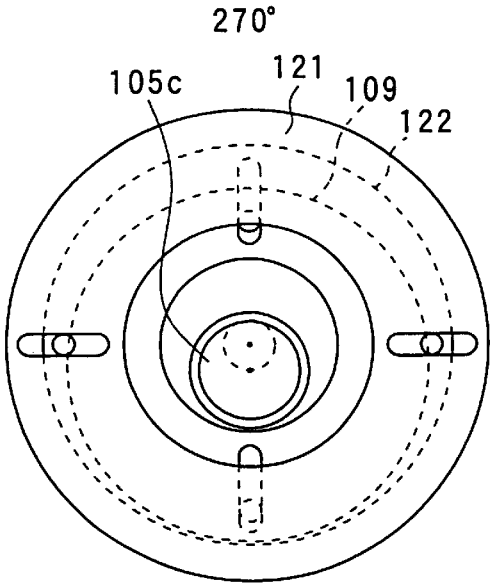
FIG. 15D is a cross-sectional view corresponding to the cross-sectional view taken along XIII—XIII of FIG. 12 when a rotation angle is 270°.

As shown in FIG. 14, there are provided a plurality of long holes 122*b* (two apertures in the present embodiment) extending in a direction that is in a radial direction of the movable disk 122 as well as a direction intersecting with the major axial direction of the long holes 121*a* of the fixed disk 121 (i.e., in the present embodiment, a direction shifted by 90° with respect to the major axial direction). At the same time, a pin portion 109*b* is provided in the revolving member 109, the pin portion 109*b* being inserted into the long holes 122*b* of the movable disk 122 so as to be able to be displaced by sliding along the major axial direction of the long holes 122*b*.

Thereby, the revolving member 109 can be displaced only in the major axial direction of the long holes 122*b* with respect to the movable disk 122, while the movable disk 122 can be displaced only in the major axial direction of the long holes 121*a* with respect to the fixed disk 121 (housing). Thus, when the shaft 105 rotates, the revolving member 109 revolves around the rotation center Lo having the eccentric amount Ro as its revolving radius without rotating (revolving) with respect to the housing (front housing 101) centered about the crank portion 105*c*, as shown in FIG. 15.

In the present embodiment, the center of the sliding joint portion 111*f* is constructed so as to reciprocate in the radial direction of the shaft 105 only on one side of the piston axial line Lp without crossing the piston axial line. Alternatively, by controlling the link 111 so that the center of the sliding joint portion 111*f* reciprocates only in the radial direction of the shaft 105, the center of the sliding joint portion 111*f* can reciprocate in the radial direction of the shaft 105 so as to move back and forth over both sides by crossing over the axial line Lp of the piston. Consequently, when the shaft 105 rotates once, the piston 110 can make reciprocating motion twice.

[Embodiment 5]

In the present embodiment, the compressor 100 according to Embodiment 1 is applied to a variable volume compressor that can change a theoretical discharge volume (geometric discharge volume determined by a product of a stroke of the piston 110 and a cross-sectional area of the cylinder bore 102*a*) that is discharged when the shaft 105 rotates once. Thus, hereinbelow, the present embodiment will be described mainly with regard to points of differences between the compressor 100 according to Embodiment 1.

Figure 16:
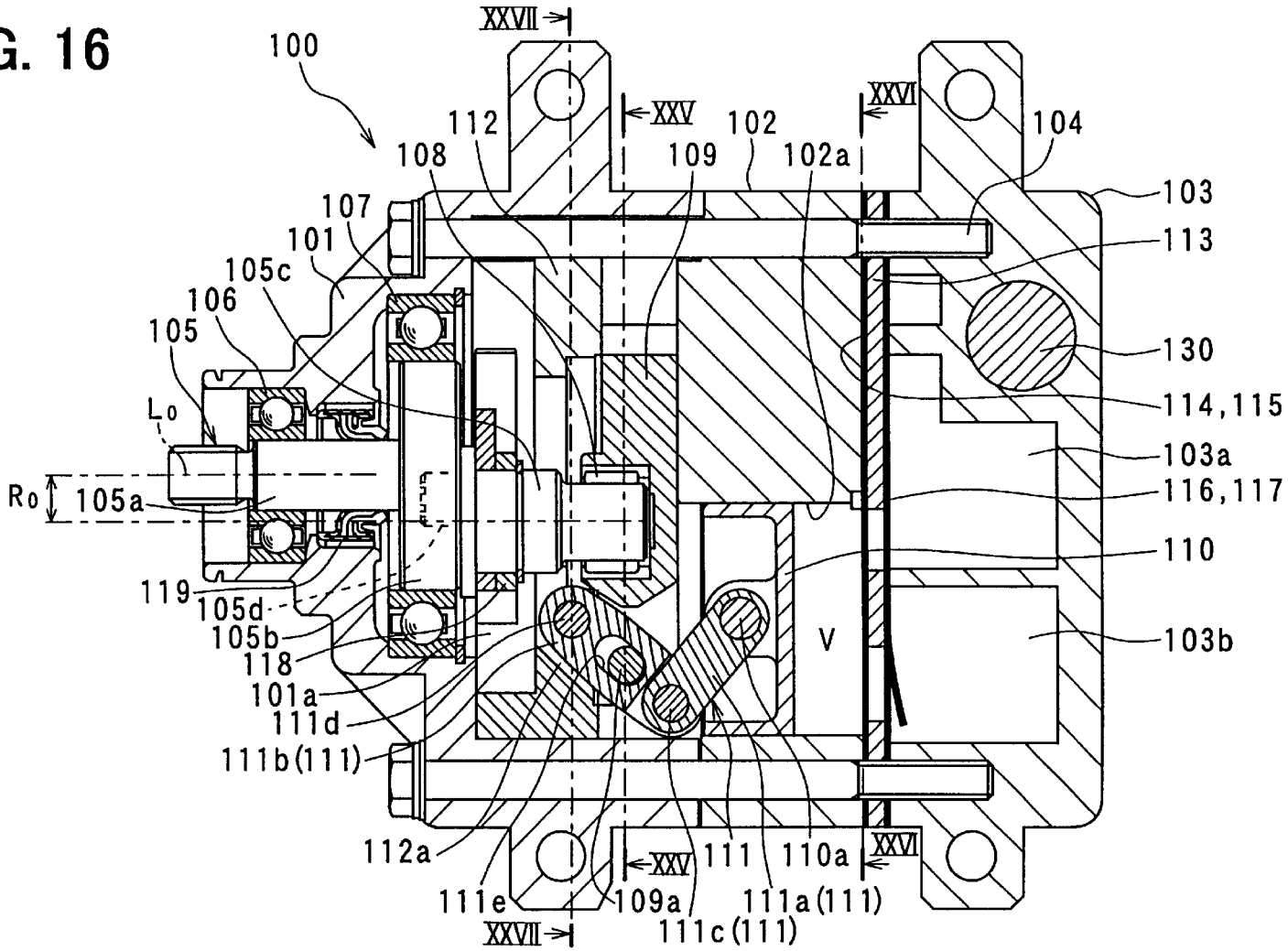
FIG. 16 is a cross-sectional view of a compressor according to Embodiment 5 of the present invention.

FIG. 16 is a cross-sectional view of the compressor 100 according to the present embodiment. What is most different from the compressor 100 of Embodiment 1 (FIG. 2) is that the crank portion 105*c* is swingably connected to the shaft 105 (large opening portion 105*b*) and a balance weight 118 swings by mechanically interlocking with the swing motion of the crank portion 105*c*. Also, a pressure in a space 101*a* can be variably controlled, the space 110*a* being near the link 111 which lies within the front housing 101 and the cylinder block 102. (Hereinbelow, the space 110*a* is referred to as a controlled pressure chamber (a crank chamber), and the pressure is referred to as a controlled pressure Pc).

Figure 17:
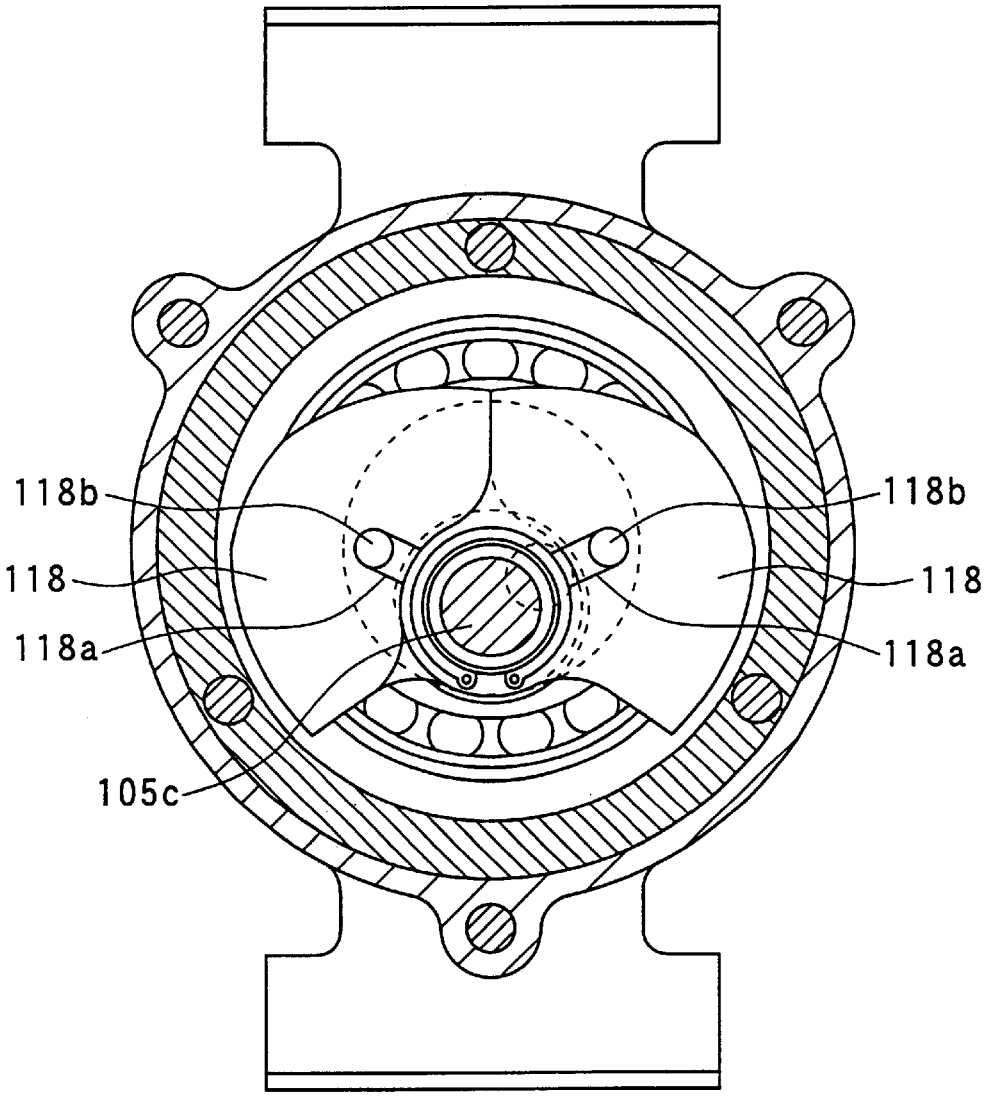
FIG. 17 is a diagram illustrating operation of balance weights of a compressor according to Embodiment 5 of the present invention.

Specifically, a swing pin 105*d* integrated to the crank portion 105*c* is slidably and rotatably inserted into a hole portion formed in the shaft 105 (the large opening portion 105*b*). At the same time, as shown in FIG. 17, two pieces of balance weights 118 formed in a generally fan-like shape is rotatably mounted to the crank portion 105*c*. Long holes 118*a* are provided to the two balance weights 118, and pins 118*b* sliding within the long holes 118*a* are integrated with and fixed to the shaft 105 (the large opening portion 105*b*) by press-fitting.

Figure 18:
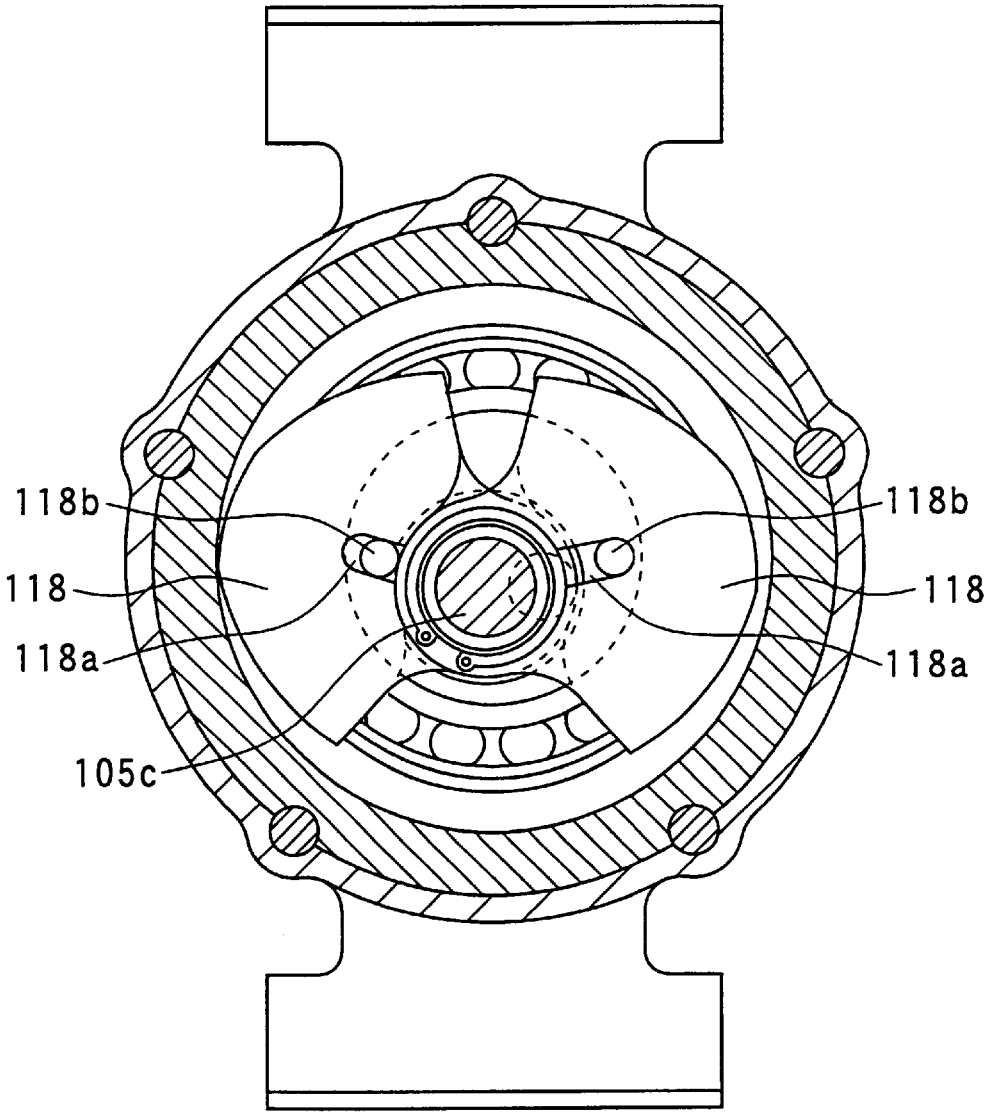
FIG. 18 is a diagram illustrating operation of balance weights of a compressor according to Embodiment 5 of the present invention.
Figure 19:
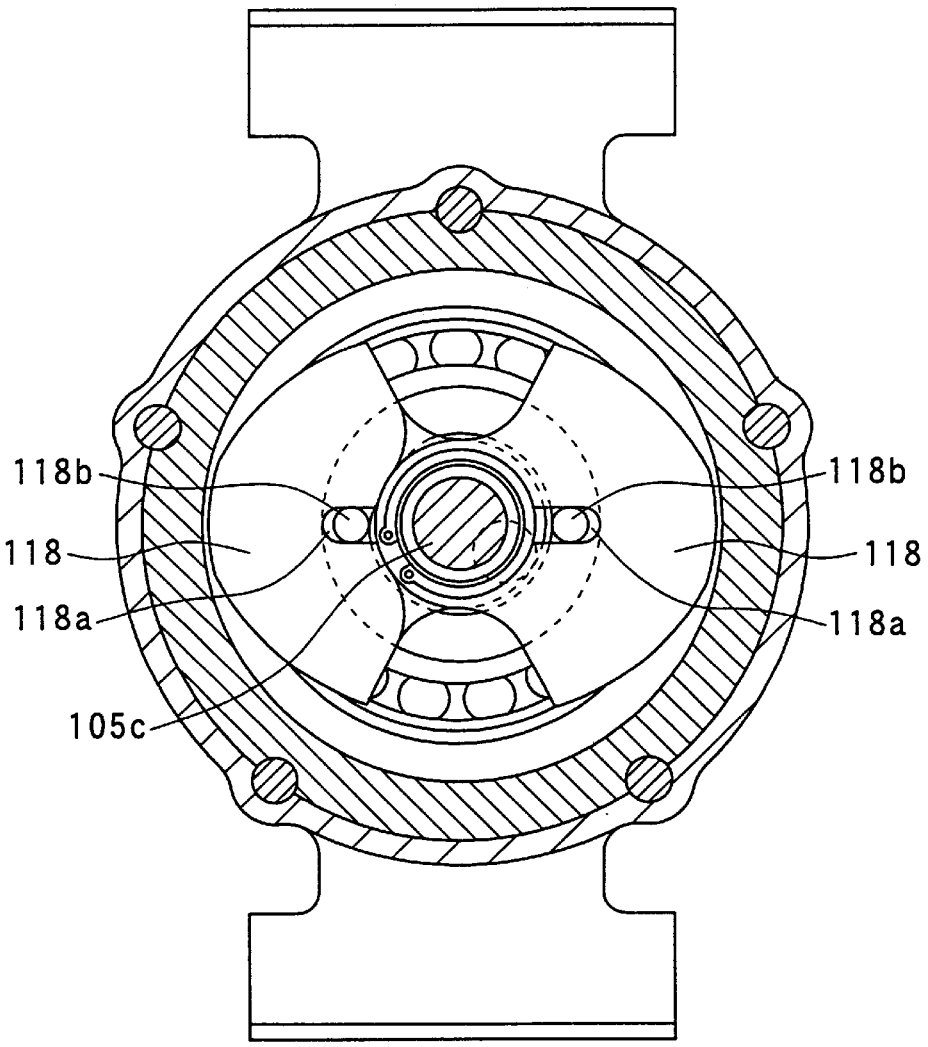
FIG. 19 is a diagram illustrating operation of balance weights of a compressor according to Embodiment 5 of the present invention.
Figure 20A:
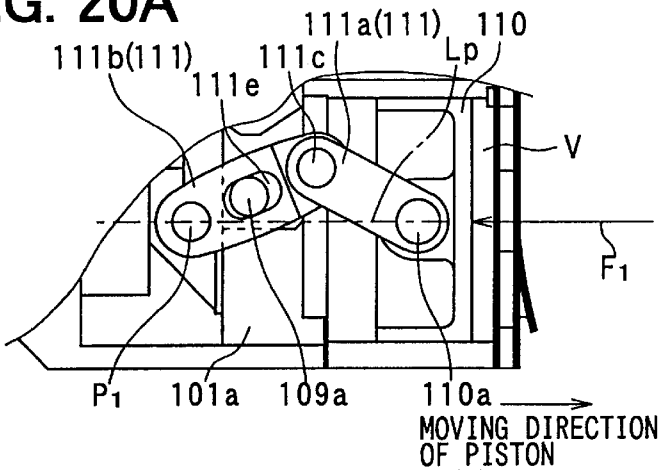
FIG. 20A is a diagram illustrating forces acting on a revolving member in a compressor according to Embodiments of the present invention.
Figure 20B:
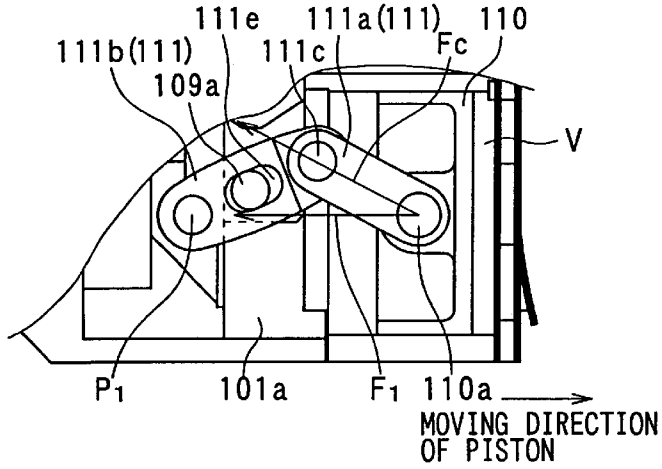
FIG. 20B is a diagram illustrating forces acting on a revolving member in a compressor according to Embodiments of the present invention.
Figure 20C:
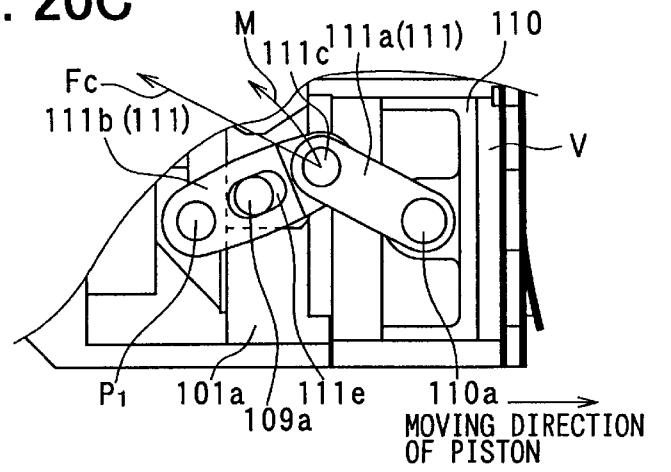
FIG. 20C is a diagram illustrating forces acting on a revolving member in a compressor according to Embodiments of the present invention.
Figure 20D:
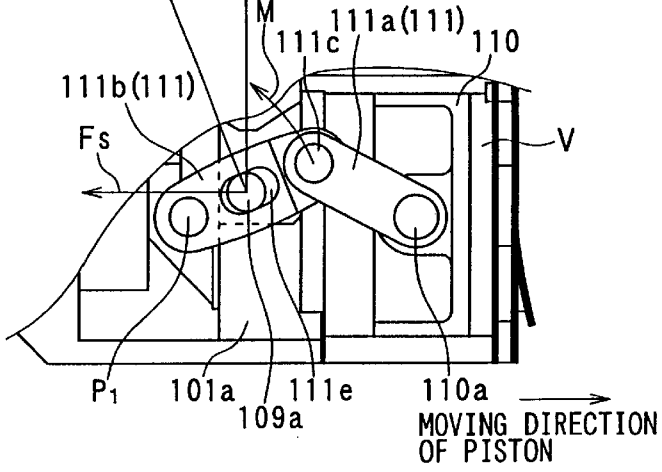
FIG. 20D is a diagram illustrating forces acting on a revolving member in a compressor according to Embodiments of the present invention.

At that time, a size and a position of the long hole 118*a* and a position of the pin 118*b* is set, as shown in FIGS. 17 to 19, so that when the center of the crank portion 105*c* matches the rotational center of the shaft 105, gravity points of the two balance weights 118 are symmetrically centered about the crank portion 105*c* so that centrifugal force of one of the balance weights 118 cancels out the centrifugal force of the other (see FIG. 19). When the center of the crank portion 109*c* is shifted from the rotation center of the shaft 105, gravity points of the two balance weights 118 are asymmetrical with respect to the center of the crank portion 105*c* (see FIGS. 17 and 18).

The controlled pressure chamber 101*a* communicates with an intake side of the compressor 100 (an intake chamber 103*a*) all the time via a depressurizing means (not shown) with an aperture ratio for generating a predetermined pressure loss of a diaphragm or the like being fixed. Additionally, there is communication with a discharge side of the compressor 100 (a discharge chamber 103*b*) all the time via a pressure controlling valve 130 (see FIG. 16) for regulating (decreasing) the discharge pressure of the compressor 100.

In the present embodiment, the pressure controlling valve 130 employs a mechanical valve for controlling a degree of the regulating pressure mechanically corresponding to a pressure (coolant temperature) within an evaporator 400. Alternatively, it may be an electrical valve.

Next, a characteristic operation of the present embodiment will be described. When the shaft 105 rotates, as described above, the piston 110 reciprocates by the revolving member 109 revolving around the rotation center Lo. During a compression stroke of the piston 110 (i.e., when the piston 110 moves from the bottom dead center toward the top dead center), the piston 110 receives a compression reactive force F1 from the coolant of the activation chamber V.

At that time, during the compression stroke (except at the top dead center), an axis line of the link 111 (the first link 111*a*) is inclined with respect to the piston axis line Lp as shown in FIGS. 20A–20D, whereby the revolving member 109 receives from the link 111 a force Fr along a vertical direction (radial direction of the shaft 105) as well as a force Fs along a horizontal direction (a direction parallel to the piston axis line Lp). Specifically, the first link 111 exerts, on the node pin 111*c*, a force Fc with a directional component parallel to the axis line of the first link 111*a* among the compression reactive force F1 (see FIG. 20B), and the force Fc exerts a moment M having a swing center P1 as its center in coordination with the second link 111*b* (see FIG. 20C). Therefore, the sliding pin 109*a* fixed to the revolving member 109 receives the forces Fr and Fs from the link 111 connected to the piston 110 in the compression stroke.

When the center of the sliding pin 109*a* and the center of the crank portion 105*c* is projected on a plane passing through a center axial of the shaft 105 and the piston axis line Lp (hereinafter, the plane is referred as a projecting surface), the center of the sliding pin 109*a* projected on the projecting surface (hereinafter, such center is referred as a projected pin center) reciprocate in a direction orthogonal to the piston axis line Lp projected on the projecting surface (hereinafter, such axis line is referred as a projected piston axis line). Additioanlly, the center of the crank portion 105 projected on the projecting surface (hereinafter, the center is referred to as a projected crank center) reciprocates in a direction orthogonal to a central axis of the shaft 105 projected on the projection surface (hereinafter, the axis is referred as a projected central axis).

At that time, when the piston 110 is at top dead center, the axis line of the link 111 matches the piston axis line Lp (see FIGS. 5 and 7). Thus, when the piston is at top dead center, the projected pin center is positioned on the projected piston axis line, and the projected crank center is positioned on the projected central axis. Specifically, the force Fr acts on the sliding pin 109*a* when the projected crank center is in a position shifted from the projected central axis, and the force Fr faces the projected crank center from the projected central axis. Thus, the force Fr acts on the revolving member 109 as a force in a direction that increases the eccentric amount Ro (i.e., a direction in which the revolving member 109 moves away from the rotation center Lo).

It should be understood that the description related to the force Fr is not only for the present embodiment, but it is applicable to above-described embodiments, and other embodiments described below. Specifically, the compression reactive force Fl exerts a force Fr on the revolving member 109, the force Fr being in the direction increasing the eccentric amount Ro (i.e., the direction in which the revolving member 109 moves away from the rotation center 109).

On a link 111 side of the piston 110, there is subject, the pressure (controlling pressure Pc) within the controlling pressure chamber 101*a*, the controlling pressure Pc being of a direction opposite to the compression reactive force F1. Thus, the revolving member 109 is acted upon by a force in a direction that reduces the eccentric amount Ro by the controlling pressure Pc (see FIG. 21). Accordingly, the magnitude of the force Fr decreases or increases on a proportional basis due to a difference between the controlling pressure Pc and a pressure in the activation chamber V. Hereinafter, the force Fr determined by the difference between the controlling pressure Pc and the pressure in the activation chamber V is referred to as an eccentric force Fr. A direction for increasing the eccentric amount Ro is referred as a positive direction while a direction for decreasing the eccentric amount Ro is referred as a negative direction.

Now, the maximum pressure in the activation chamber V generally equals a discharge pressure of the compressor, and the minimum pressure therein generally equals an intake pressure of the compressor. Likewise, the maximum pressure of the controlling pressure Pc is slightly lower than the discharge pressure of the compressor while the minimum pressure generally equals the intake pressure of the compressor. Thus, the magnitude and direction of the eccentric force Fr changes depending on the controlling pressure Pc and whether the piston 110 is experiencing a compression stroke or an intake stroke.

Figure 22:
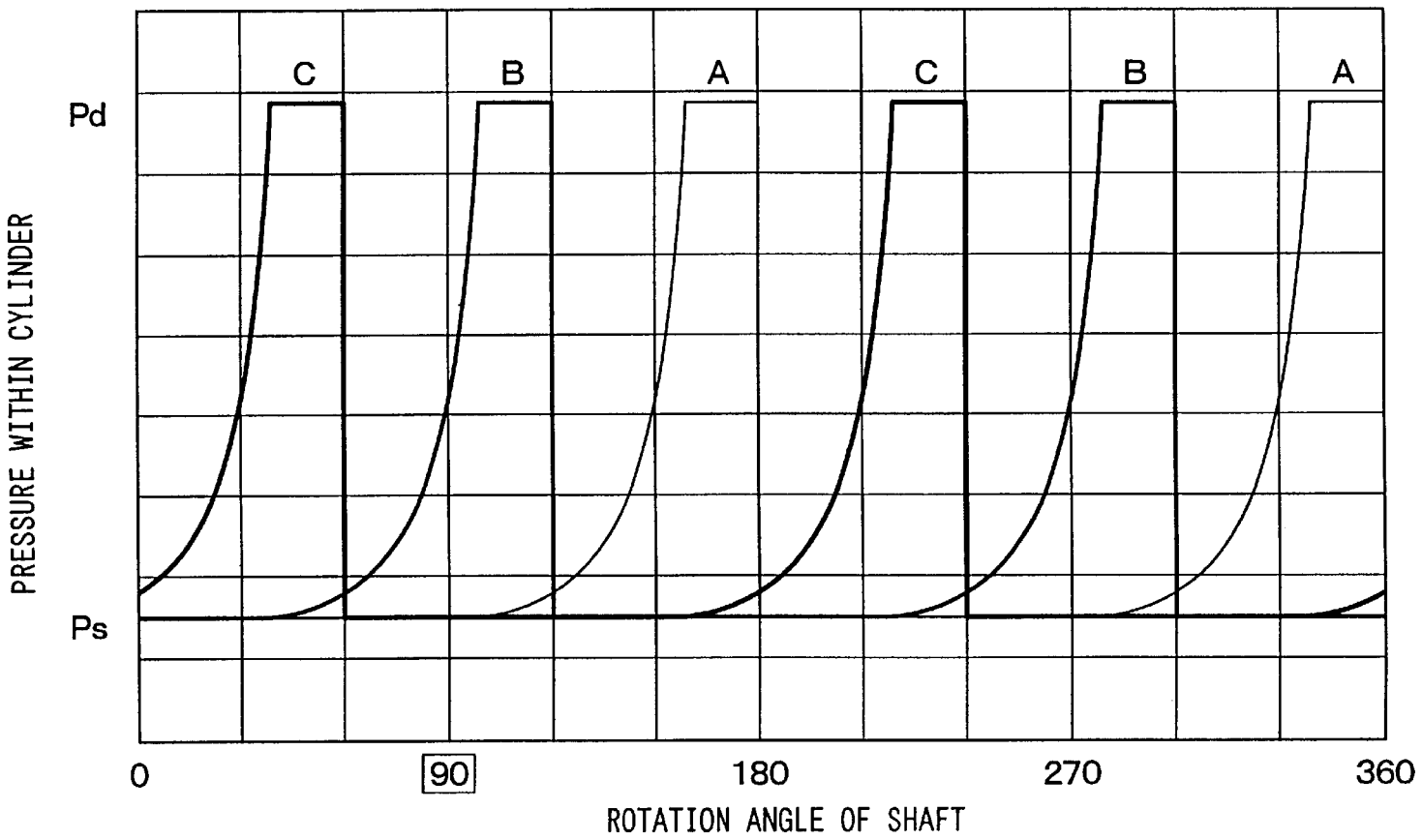
FIG. 22 is a graph showing pressure within a cylinder of a compressor according to Embodiment 5 of the present invention.

Moreover, as shown in FIG. 22, because each cylinder (three cylinders in the present embodiment) is in a different stroke, the eccentric force Fr acting on the revolving member 109 is a resultant force of the eccentric force Fr of each cylinder.

Figure 23:
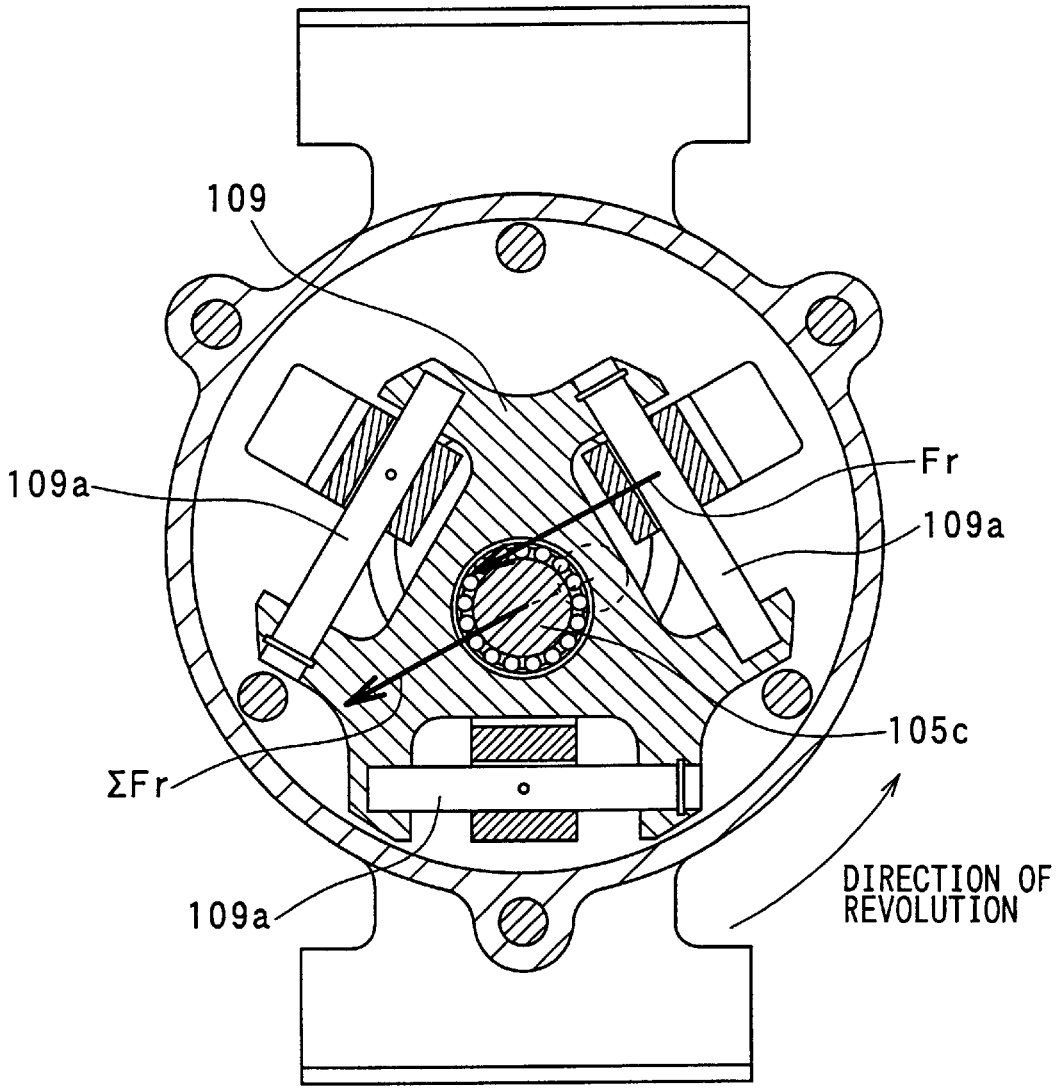
FIG. 23 is a diagram showing an eccentric force Fr and resultant forces thereof ΣFr when controlling pressure Pc is at the minimum pressure when a rotation angle of the shaft is 90° in a compressor according to Embodiments of the present invention.
Figure 24:
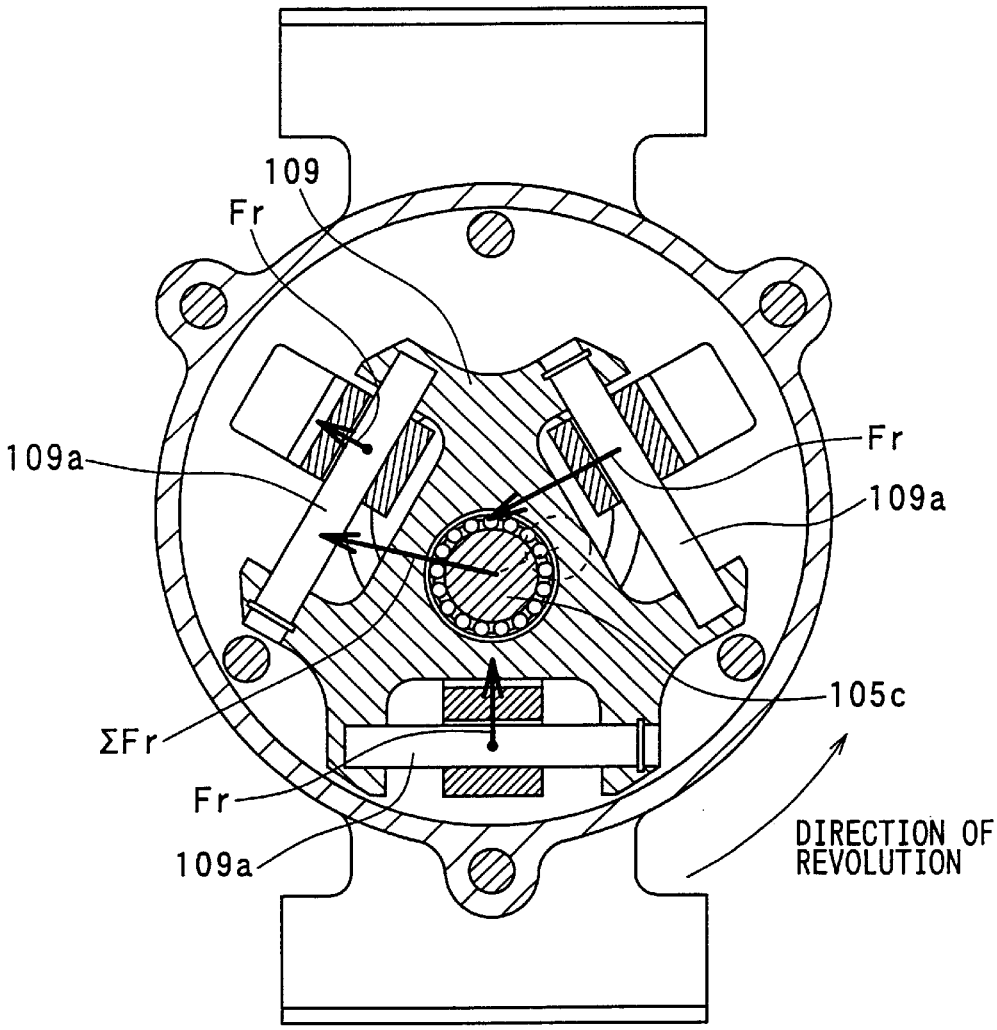
FIG. 24 is a diagram showing an eccentric force Fr and resultant forces thereof ZFr when controlling pressure Pc is at the intermediate pressure when a rotation angle of the shaft is 90° in a compressor according to Embodiments of the present invention.

FIG. 23 shows an eccentric force Fr and a resultant force ΣFr thereof, when the controlling pressure Pc is at its minimum pressure when the rotation angle of the shaft 105 is at 90°. FIG. 24 shows eccentric forces Fr and a resultant force ΣFr thereof, when the controlling pressure Pc is at an intermediate pressure when the rotation angle of the shaft 105 is at 90°. In the state shown in FIG. 23, the eccentric resultant force ΣFr is in the positive direction (i.e., in a direction increasing the eccentric amount Ro) and in the state shown in FIG. 24, the eccentric resultant force ΣFr is in the negative direction (i.e., in a direction decreasing the eccentric amount RO).

When the revolving member 109 revolves, a locus of the projected pin center is a line segment. In the present embodiment, similar to Embodiment 1, the center of the sliding pin 109 moves back and forth on both side of the piston axis line Lp centered thereabout, whereby the locus of the projected pin center intersects with the projected piston axis line at the mid-point.

Accordingly, when the projected pin center is positioned at the mid-point of the locus of the projected pin center, the piston 110 is positioned at top dead center. Likewise, when the projected pin center is positioned at the end point of the locus of the projected pin center, the piston 110 is positioned at bottom dead center. Thus, the stroke of the piston 110 increases proportionately with a length of (a half of) the locus of the projected pin center.

At that time, the length of (a half of) the locus of the projected pin center, that is, an amplitude of a radial directional component of the shaft 105 of a motion transferred to the link 111 from the revolving member 109 when the revolving member 109 revolves, increases proportionately with the eccentric amount Ro. Thus, the stroke of the piston 110 can be increased or decreased by increasing or decreasing the eccentric amount Ro.

From that described above, by controlling a pressure difference between the controlling pressure Pc and a pressure in the activation chamber V by regulating the controlling pressure Pc, the eccentric amount Ro can be increased or decreased in response thereto. Thus, it is possible to change the discharge volume by changing the stroke of the piston 110.

When the controlling pressure Pc is the discharge pressure, the discharge amount becomes 0, thus a pressure difference between the discharge pressure and the intake pressure is 0 because the discharge volume becomes 0. Accordingly, a pressure difference between the controlling pressure Pc and the pressure in the activation chamber V also becomes 0, thus even if the pressure controlling valve 130 is closed thereafter (i.e., the controlling pressure Pc=the intake pressure), the discharge volume will not increase. Therefore, in the present embodiment, a force in a direction increasing the eccentric amount Ro by an actuator or elastic means such as springs (not shown) is slightly exerted on the revolving member 109 (the crank portion 105*c*).

Figure 25:
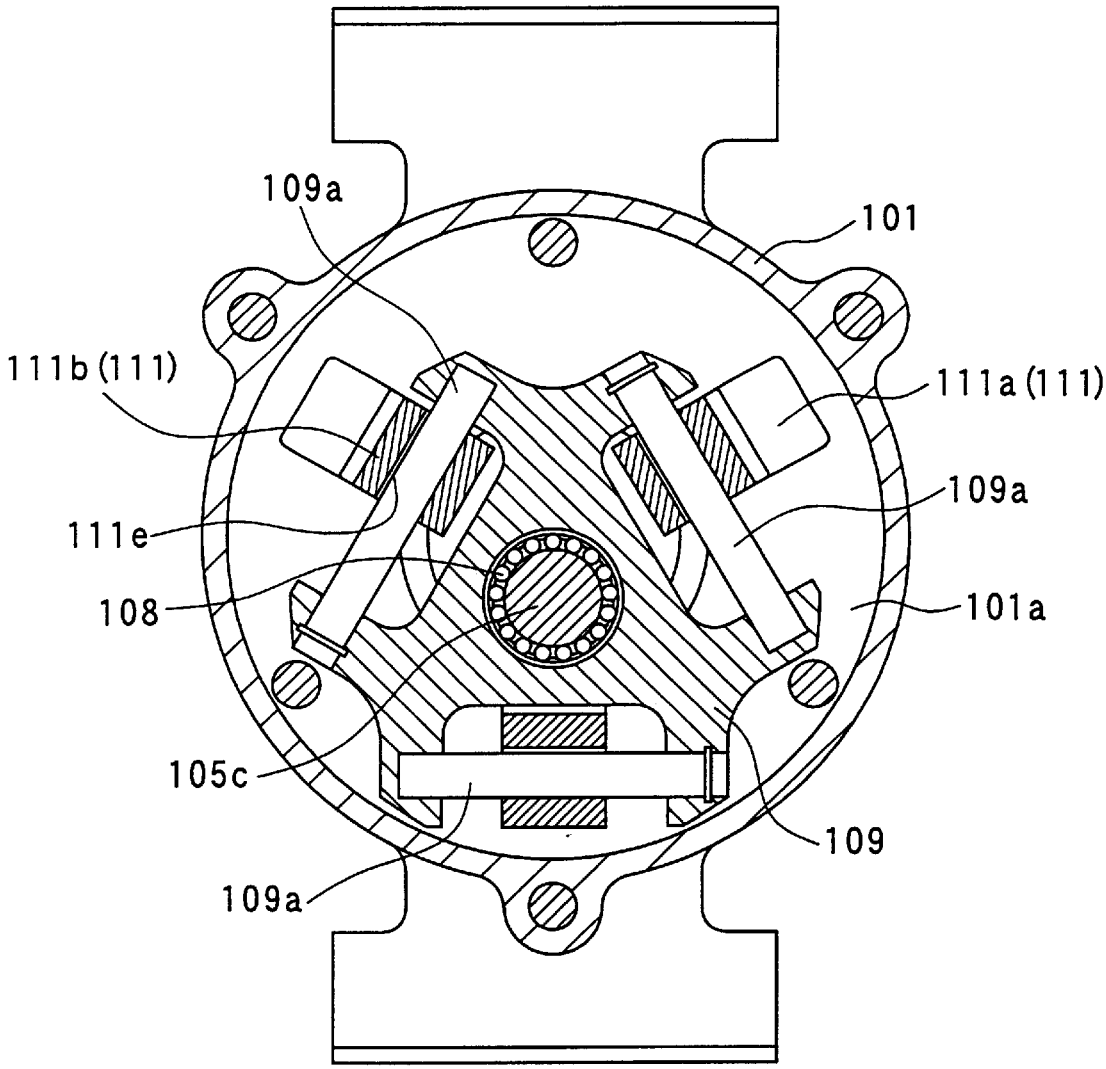
FIG. 25 is a cross-sectional view taken along XXV—XXV of FIG. 16 when a compressor according to Embodiment 5 of the present invention is at its maximum volume.
Figure 26:
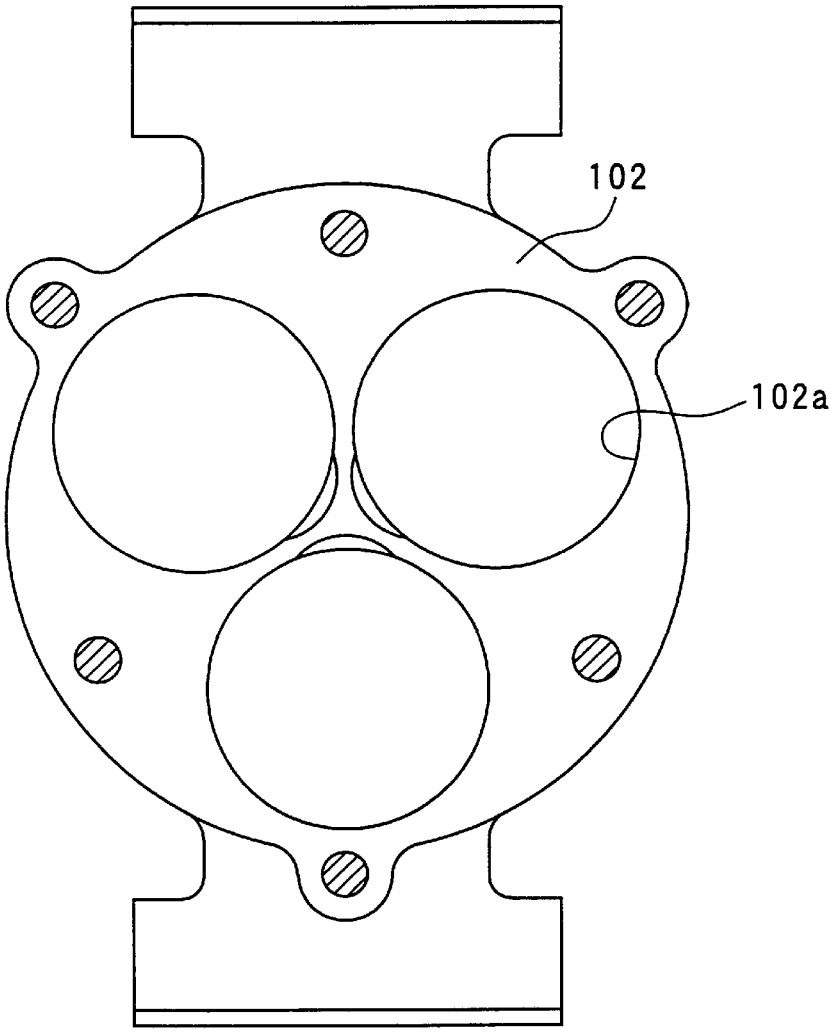
FIG. 26 is a cross-sectional view taken along XXVI—XXVI of FIG. 16 when a compressor according to Embodiment 5 of the present invention is at its maximum volume.
Figure 27:
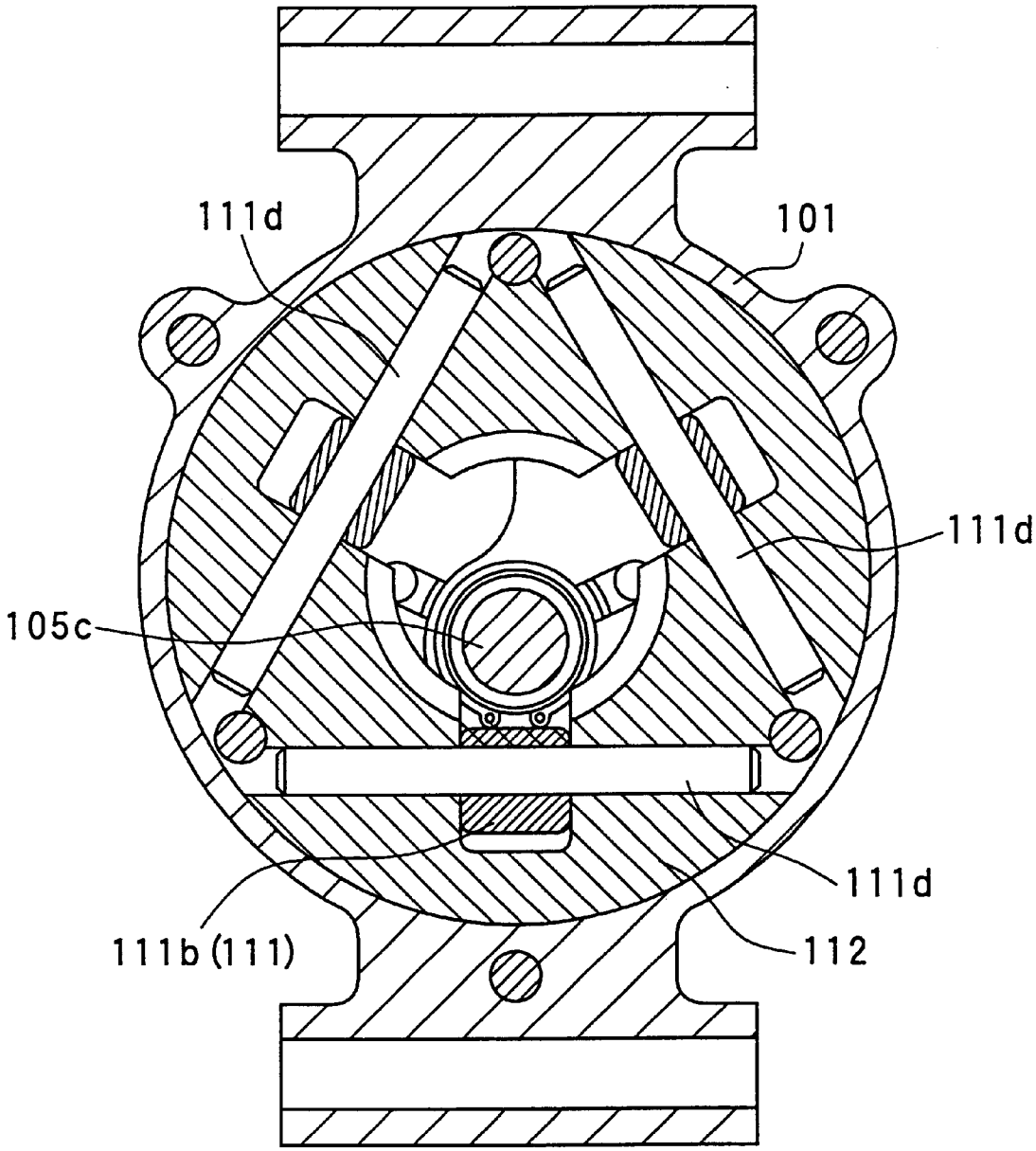
FIG. 27 is a cross-sectional view taken along XXVII—XXVII of FIG. 16 when a compressor according to Embodiment 5 of the present invention is at its maximum volume.
Figure 28:
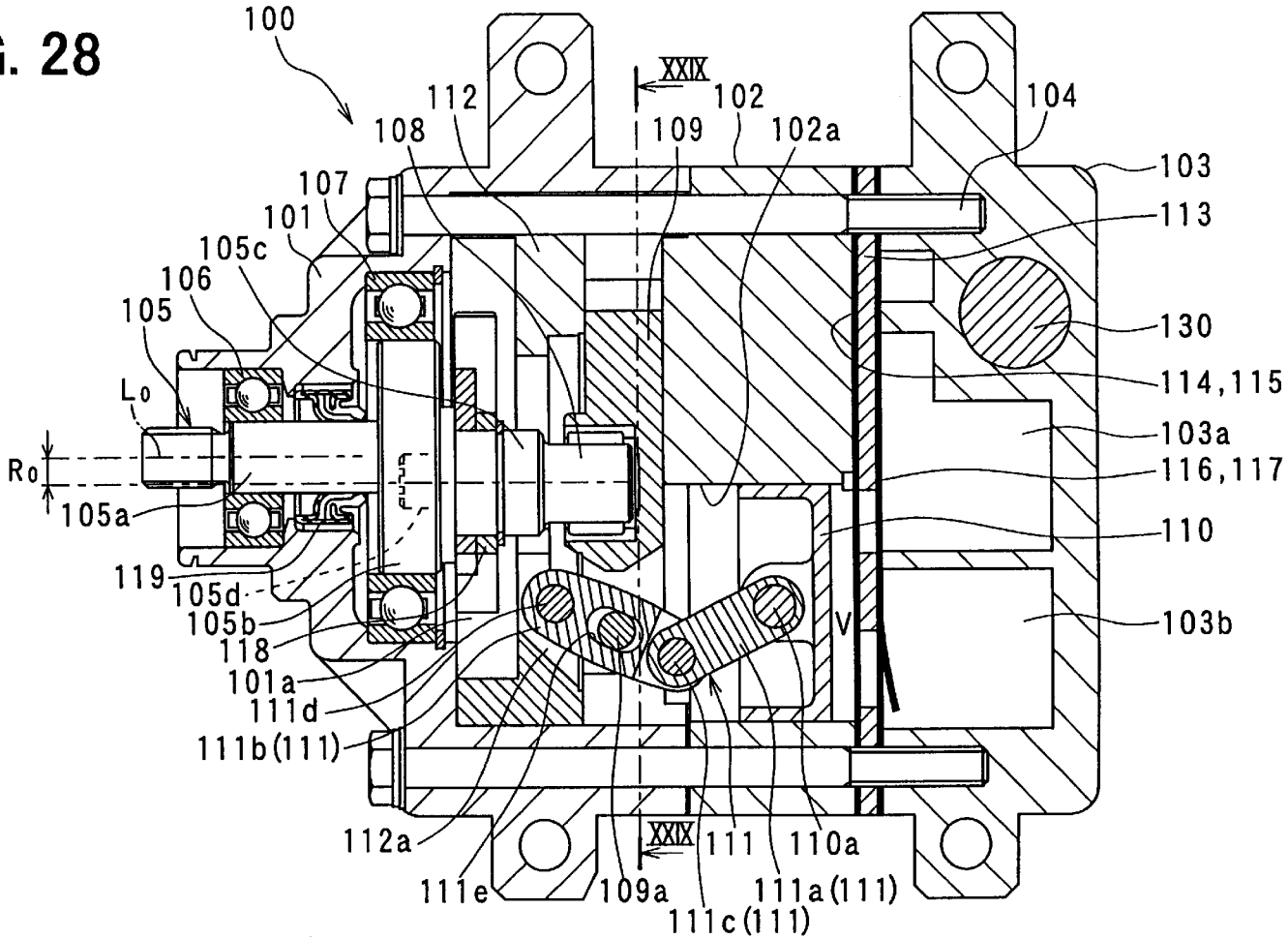
FIG. 28 is a cross-sectional view showing a compressor 100 when a compressor according to Embodiment 5 of the present invention is at its intermediate volume.
Figure 29:
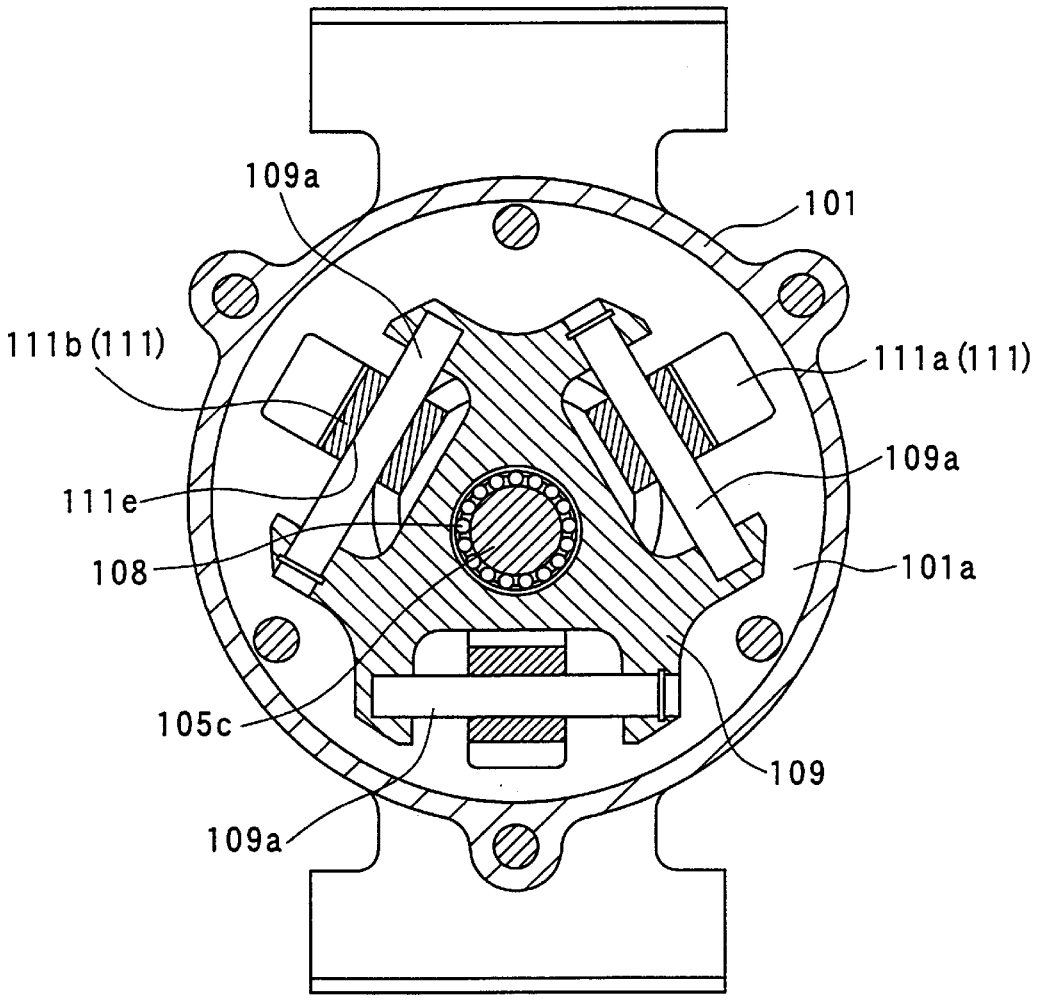
FIG. 29 is a cross-sectional view taken along XXIX—XXIX of FIG. 28.
Figure 30:
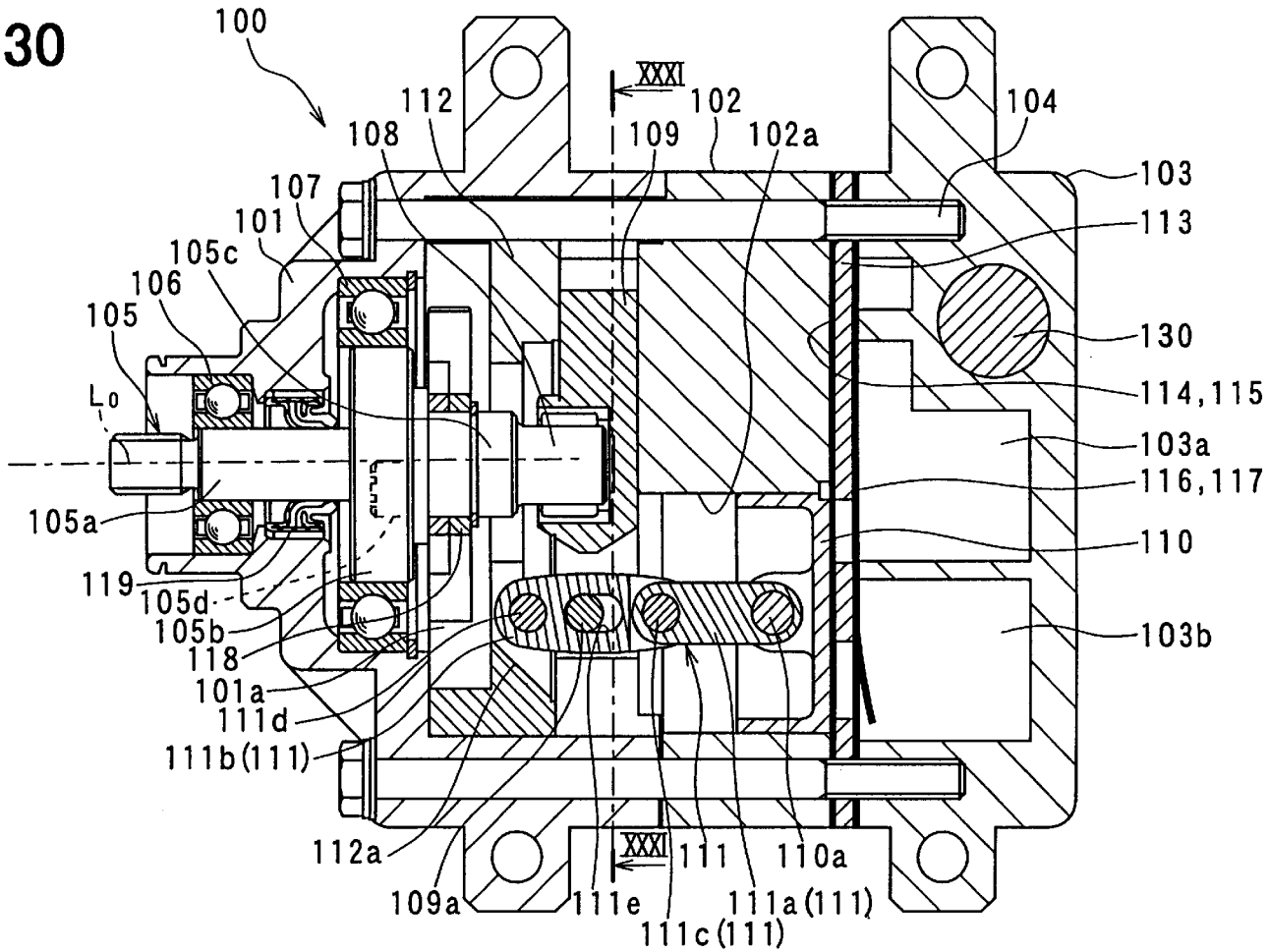
FIG. 30 is a cross-sectional view showing a compressor 100 when a compressor according to Embodiment 5 of the present invention is at its minimum volume.
Figure 31:
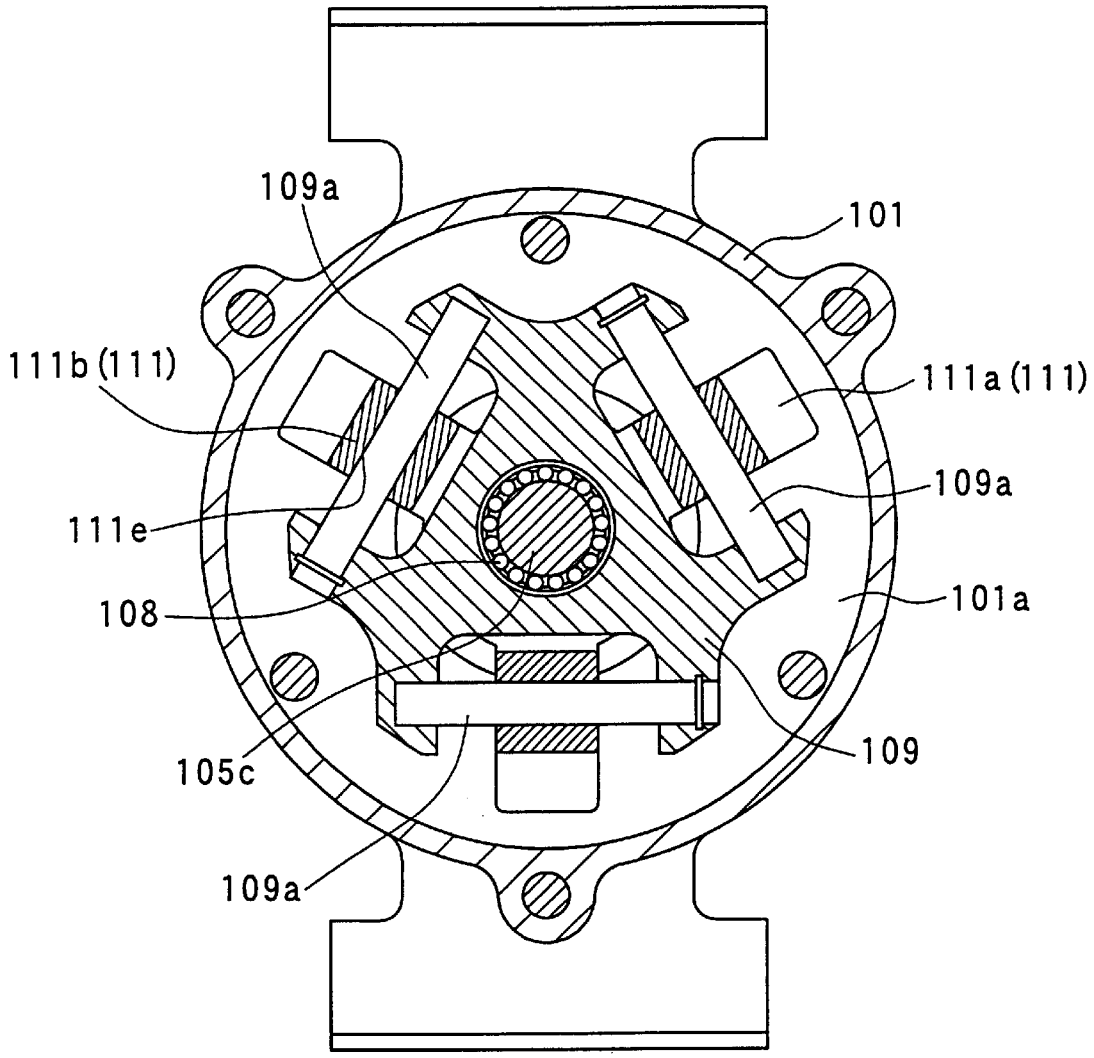
FIG. 31 is a cross-sectional view taken along XXXI—XXXI of FIG. 30.

FIG. 25 is a cross-sectional view taken along XXV—XXV of FIG. 16 when the volume is at its maximum (a state shown in FIG. 16). FIG. 26 is a cross-sectional view taken along XXVI—XXVI of FIG. 16 when the volume is at its maximum (a state shown in FIG. 16). FIG. 27 is a cross-sectional view taken along XXVII—XXVII of FIG. 16 when the volume is at its maximum (a state shown in FIG. 16). Moreover, FIG. 28 is a cross-sectional view showing the compressor 100 at the intermediate volume, and FIG. 29 is a cross-sectional view taken along XXIX—XXIX of FIG. 28. Likewise, FIG. 30 is a cross-sectional view showing the compressor 100 when the volume is at its minimum, and FIG. 31 is a cross-sectional view taken along XXXI—XXXI of FIG. 30.

Next, characteristics of the present embodiment will be described. In a swash plate compressor as a variable volume compressor (JP-B No. 02-061627, for example), the stroke of the piston is variably controlled by changing an inclined angle of the swash plate for reciprocating the piston. However, even if the inclined angle of the swash plate changes, the swash plate rotates integrally with the shaft, and thus, even if the discharge volume decreases, the swash plate slides along a shoe connecting the piston and the swash plate with a speed similar to a case where the volume is at its maximum.

Thus, if the compression task (pumping task) is decreased as the discharge volume decreases, mechanical loss caused by friction between the swash plate and the shoe would not decrease. In view of this, in the present embodiment, as shown in FIGS. 20D to 21D, a great amount of force is exerted on a contact surface of the sliding pin 109*a* and the link 111 (the long hole 111*e*), whereby friction loss between the sliding pin 109*a* and the link 111 (a long hole 111*e*) takes up a great ratio among an entire mechanical loss.

At that time, relative (sliding) speed of the sliding pin 109*a* relative to the link 111 (the long hole 111*e*) increases proportionately with the number of revolutions of the shaft 105 (a revolving (reciprocating) number of the revolving (reciprocating) member 110) and the eccentric amount Ro, and thus, when the eccentric amount Ro decreases as the discharge volume decreases, the friction loss between the sliding pin 109*a* and the link 111 (the long hole 111*e*) decreases proportionately therewith. Therefore, in the present embodiment, in response to a decrease of the discharge volume (compression), the mechanical loss of the compressor can be reduced. Thus, if the discharge volume is decreased when rotation speed of the shaft is high, it is possible to reduce the mechanical loss while preventing the sliding portion from burning due to frictional heat.

In the present embodiment, when the eccentric amount Ro changes, the centrifugal force exerted on the shaft 105 caused by the revolution of the revolving member 109 changes. Moreover, as described above, the two balance weights 118 are displaced by mechanically interlocking with the displacement of the crank portion 105*c* (a change of the eccentric amount Ro), whereby in response to a change in the eccentric amount Ro, an inertial moment of the balance weight 118 can be changed.

Therefore, even if the centrifugal force exerted on the shaft 105 from the revolving member 109 changes due to a change of the eccentric amount Ro, the centrifugal force of the revolving member 109 can be efficiently cancelled, and thus, it is possible to prevent a large vibration from generating even if the discharge volume of the compressor 100 changes.

[Embodiment 6]

The present embodiment is similar to the compressor 100 according to Embodiment 2 (see FIG. 8) having a structure similar to Embodiment 5 modified to a variable volume compressor. The structure and controlling method for variably controlling the discharge volume is the same as Embodiment 5.

Figure 32:
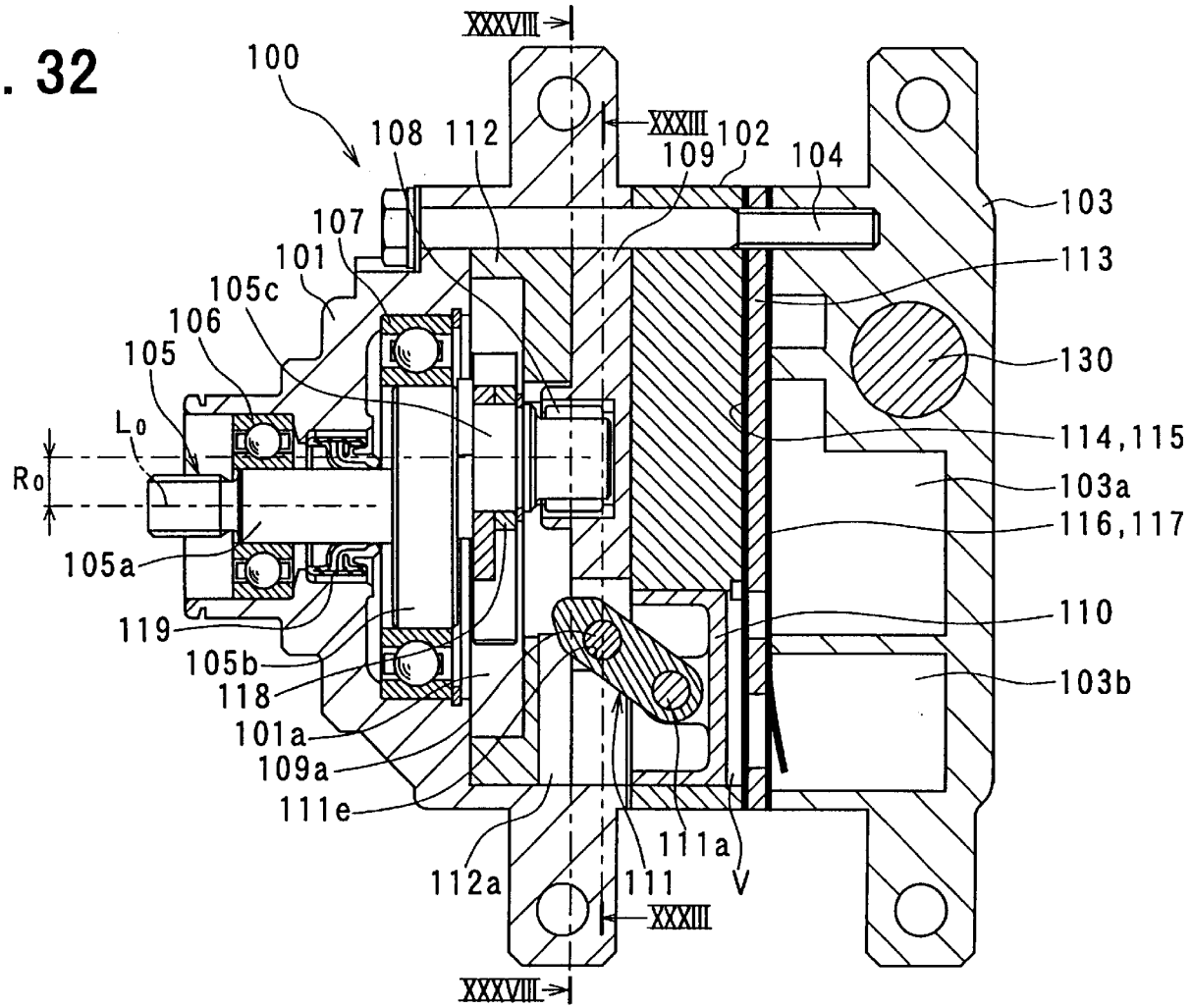
FIG. 32 is a cross-sectional view showing the piston being in the bottom dead center position when a compressor according to Embodiment 6 of the present invention is at its maximum volume.
Figure 33:
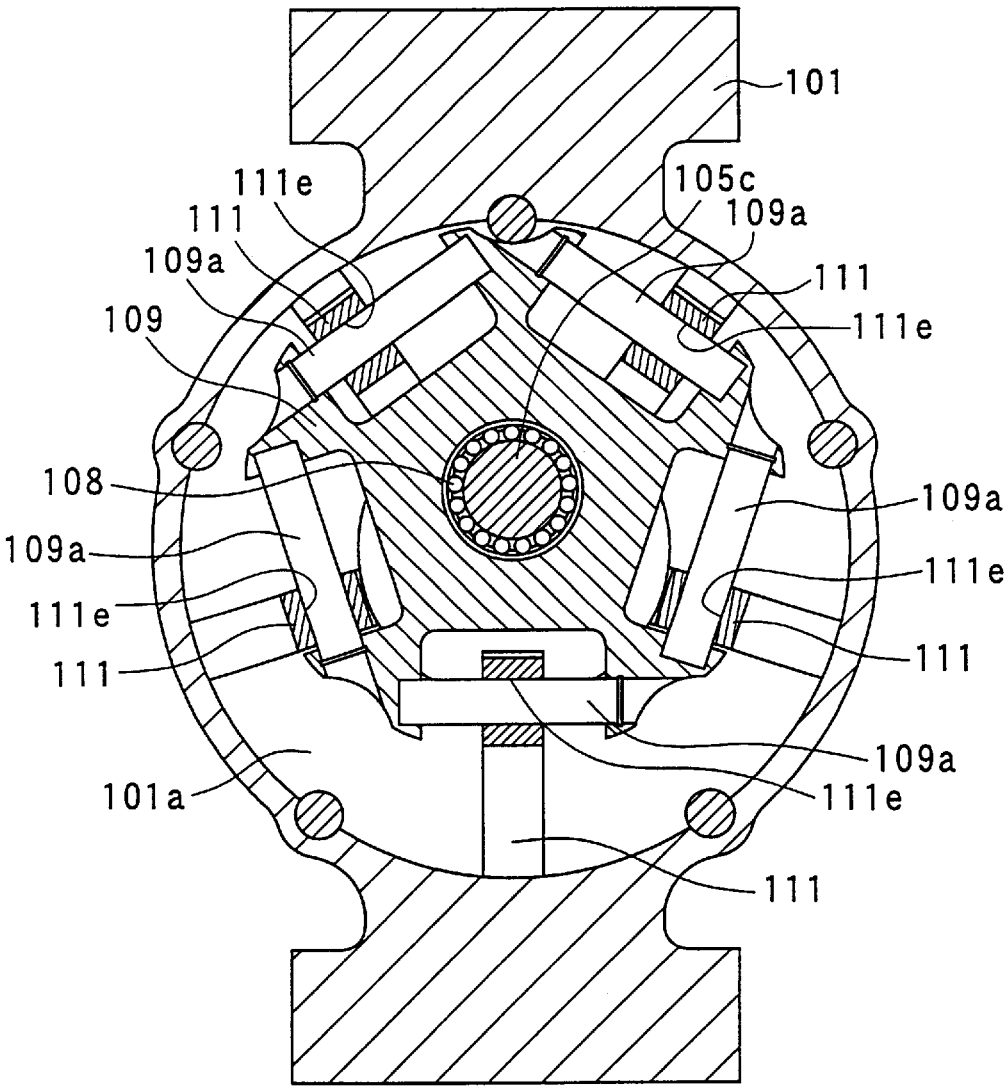
FIG. 33 is a cross-sectional view taken along XXXIII—XXXIII of FIG. 32.
Figure 34:
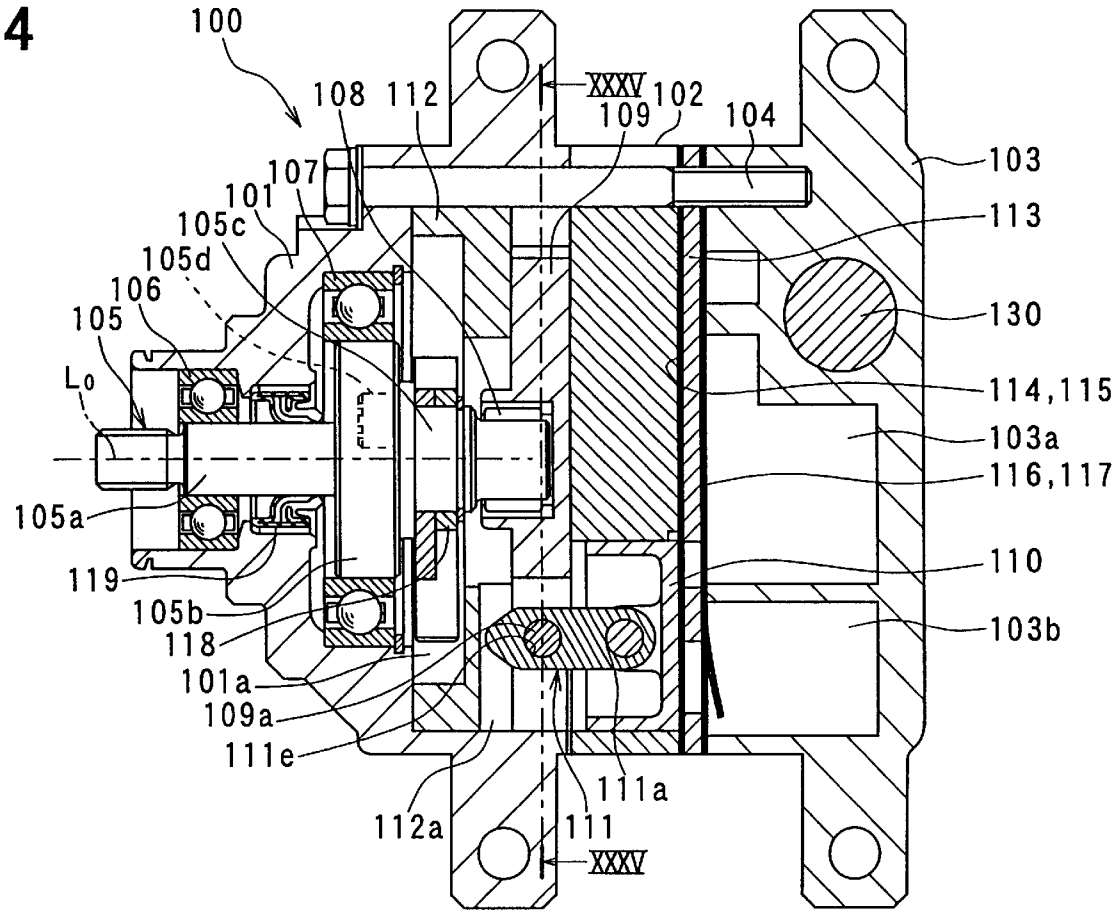
FIG. 34 a cross-sectional view showing the piston being in the top dead center position when a compressor according to Embodiment 6 of the present invention is at its maximum volume.
Figure 35:
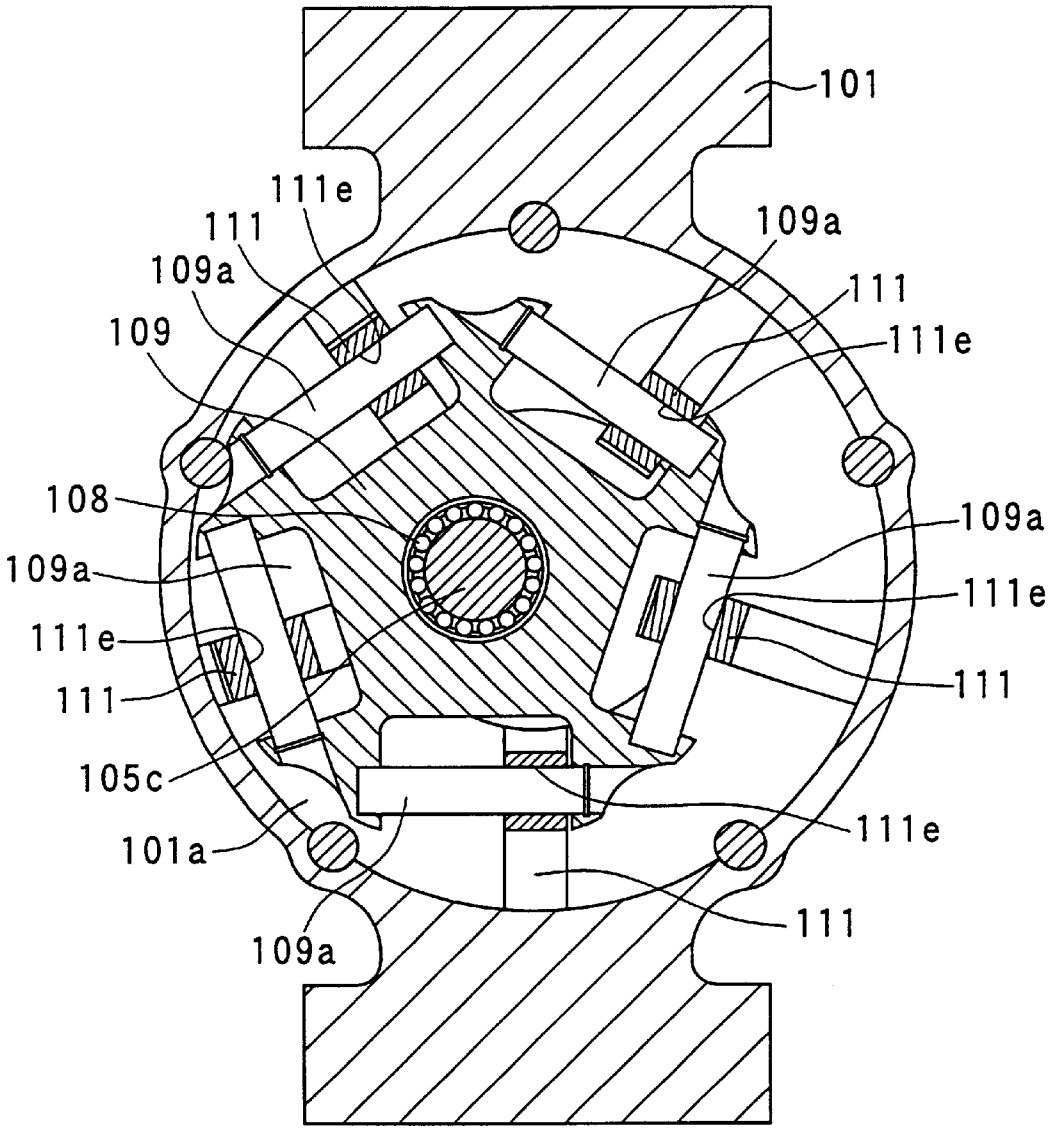
FIG. 35 is a cross-sectional view taken along XXXV—XXXV of FIG. 34.

FIG. 32 is a cross-sectional view showing the piston being in the bottom dead center position when the compressor 100 according to the present embodiment is at its maximum volume. FIG. 33 is a cross-sectional view taken along XXXIII—XXXIII of FIG. 32. FIG. 34 a cross-sectional view showing the piston being in the top dead center position when the compressor 100 according to the present embodiment is at its maximum volume. FIG. 35 is a cross-sectional view taken along XXXV—XXXV of FIG. 34.

Figure 36:
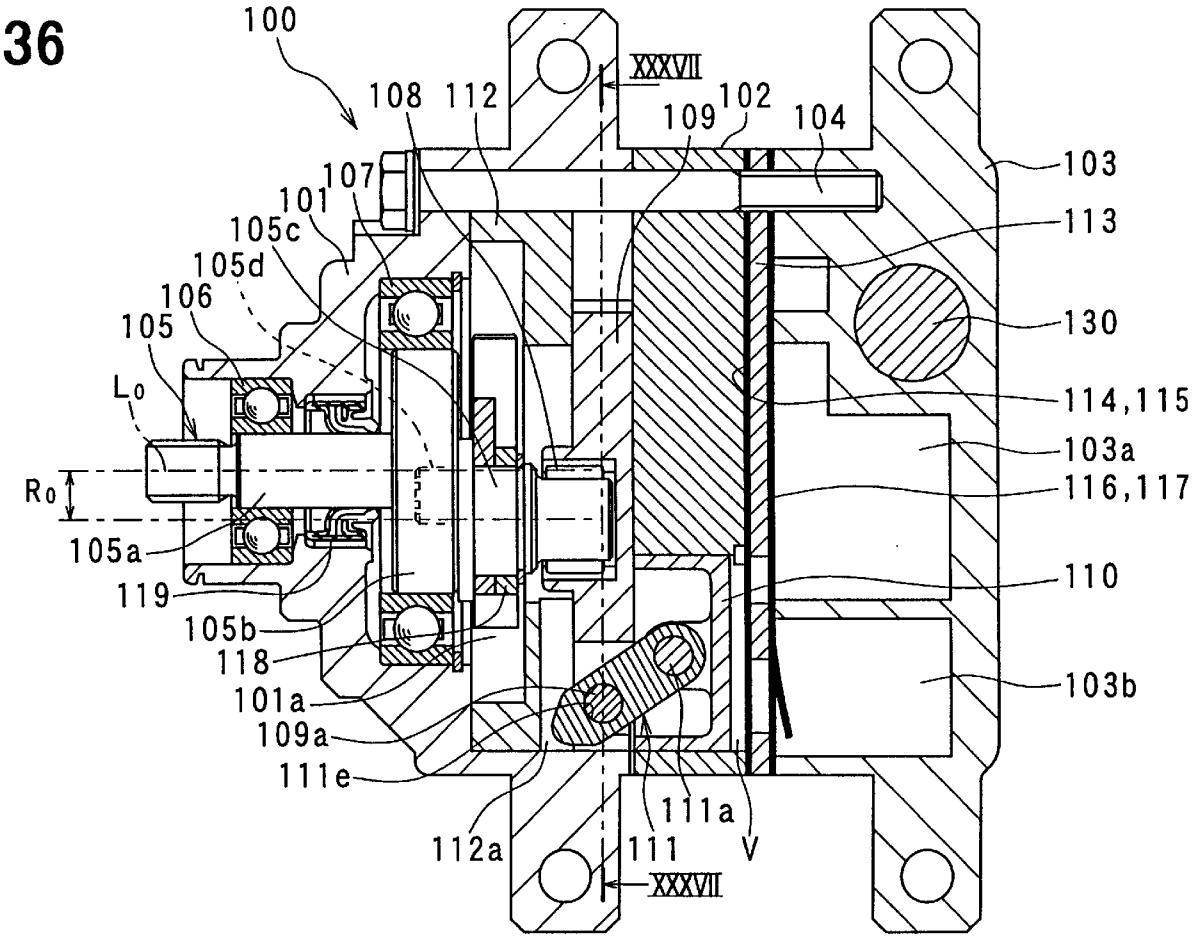
FIG. 36 is a cross-sectional view showing the piston being in the bottom dead center position when a compressor according to Embodiment 6 of the present invention is at its maximum volume.
Figure 37:
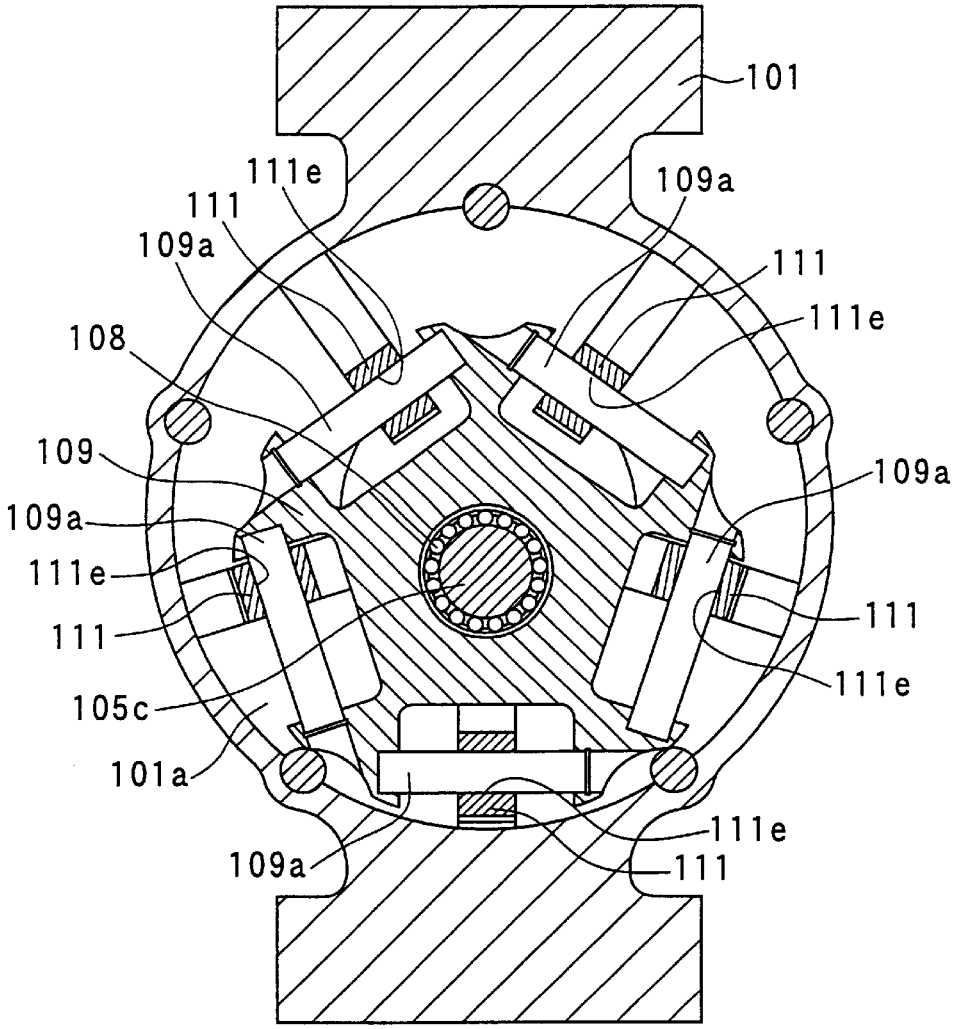
FIG. 37 is a cross-sectional view taken along XXXVII—XXXVII of FIG. 36.
Figure 38:
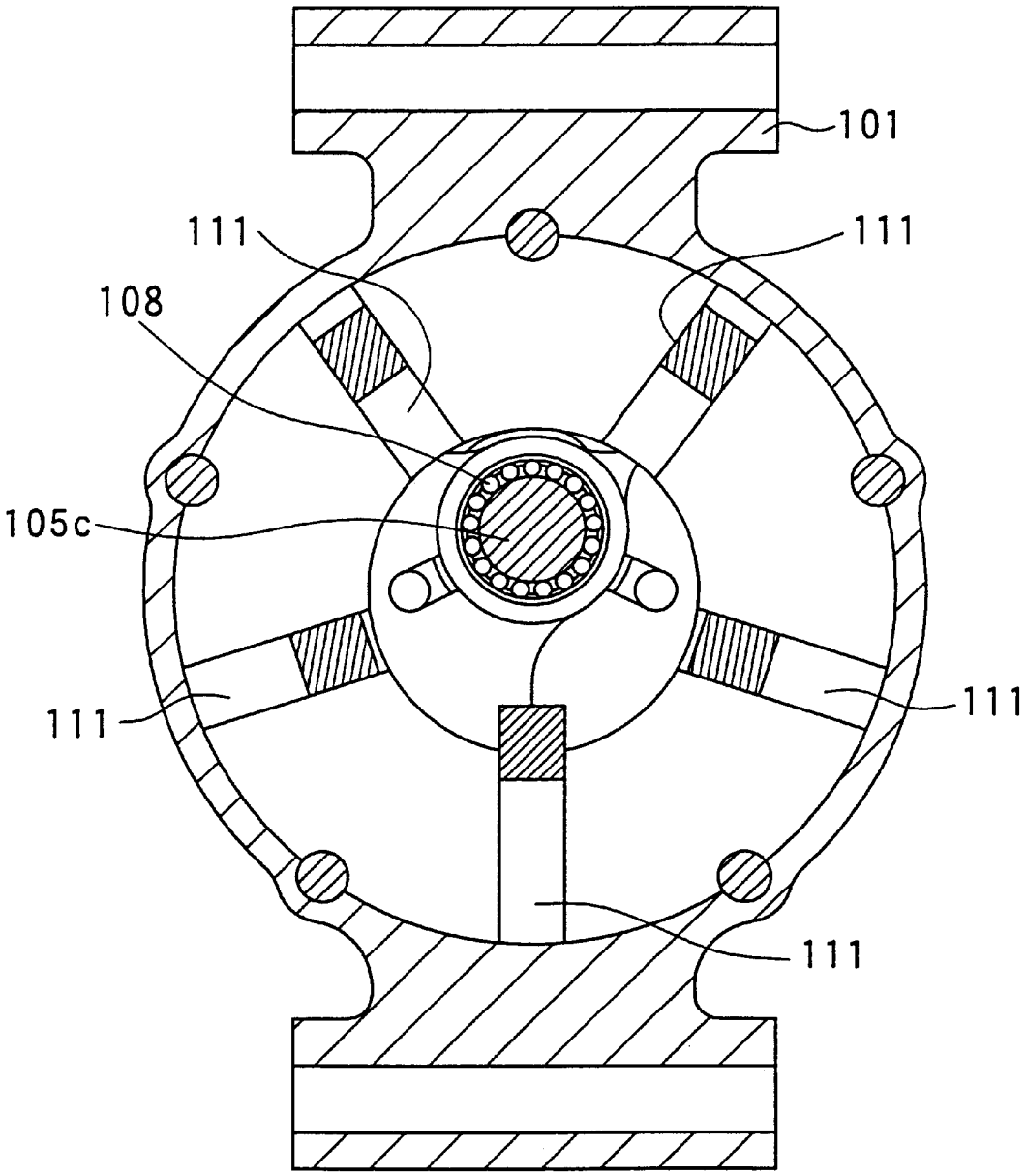
FIG. 38 is a cross-sectional view taken along XXXVIII—XXXVIII of FIG. 32.

Moreover, FIG. 36 is a cross-sectional view showing the piston being in the bottom dead center position when the compressor 100, according to the present embodiment, is at its maximum volume. FIG. 37 is a cross-sectional view taken along XXXVII—XXXVII of FIG. 36. FIG. 38 is a cross-sectional view taken along XXXVIII—XXXVIII of FIG. 32.

[Embodiment 7]

Figure 39:
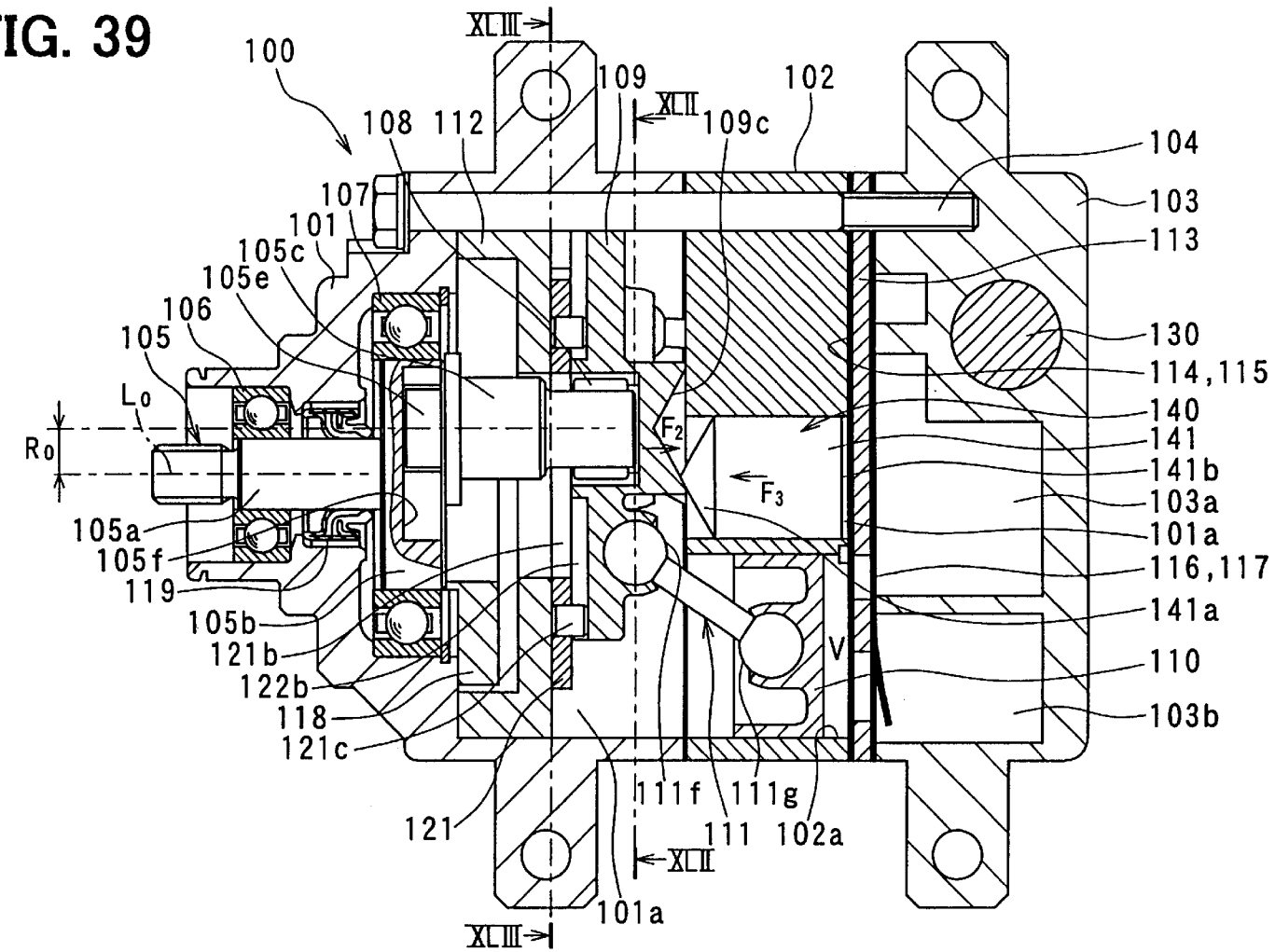
FIG. 39 is a cross-sectional view of a compressor according to Embodiment 7 of the present invention.

The present embodiment modifies the compressor 100 according to Embodiment 4 (see FIG. 12) to a variable volume type. In Embodiments 5 and 6, by controlling a pressure difference between a pressure exerting on the piston 110 from the link 111 side (controlling pressure Pc) and a pressure exerting on the piston 110 from an opposite side of the link 111, a stroke controlling means is constructed for controlling the stroke of the piston 110 by controlling forces exerted on the revolving member 109 from the piston 110. In the present embodiment, as shown in FIG. 39, the stroke controlling means is constructed by having an actuator 140 for moving the revolving member 109 in the radial direction of the shaft 105.

Specifically, the revolving member 109 is provided with a cone-shaped concave portion 109*c*, and a controlling piston 141 having a cone-shaped convex portion 141*a* having the same shape as the conical surface of the concave portion 109*c* is swingably disposed within the cylinder block 102. At that time, a center line of the concave portion 109*c* matches with the center line of the crank portion 105*c*, and a center line of the convex portion 141*a* matches the center line of the shaft 105 (rotation center Lo). Also, a controlling pressure chamber 101*a* is provided on a side of surface 141*b* opposite to the convex portion 141*a* of the controlling piston 141 constituting the actuator 140.

In Embodiments 5 and 6, the eccentric amount Ro is changed by the revolving member 109 revolving around the swing pin 105*d*. In the present embodiment, in place of the swing pin 105*d*, a slide pin 105*e* having width across flat is used, and a groove portion 105*f* having a width equal to the width across flat is provided to the large opening portion 105*e* so that the eccentric amount Ro changes by the sliding pin 105*e* sliding along the groove portion 105*f*.

Next, characteristic operation (operation of the stroke controlling means) of the compressor 100 according to the present embodiment will be described. A wall surface of the concave portion 109*c* and a wall surface of the convex portion 141*a* is inclined with respect to the center line of the shaft 105 (the rotation center LO), whereby when the revolving member 109 attempts in the direction where the eccentric amount Ro gets greater by the force Fr by the compression reactive force F1, the revolving member 109 attempts to move the controlling piston 141 in a direction where a volume of the controlling pressure chamber 101*a* is to be reduced.

On the other hand, the controlling piston 141 attempts to move in a direction where the volume of the controlling pressure chamber 101 is enlarged by the controlling pressure Pc. Specifically, the actuator 140 (a controlling piston 141) exerts on the revolving member 109, a force F3 opposite to a force F2 that the compression reactive force F1 exerts on the revolving member 109, whereby the eccentric amount Ro of the revolving member 109 is in a position where the force F2 and the force F3 are balanced. Therefore, by variably controlling the controlling pressure Pc, it is possible to control the eccentric amount Ro.

Figure 40:
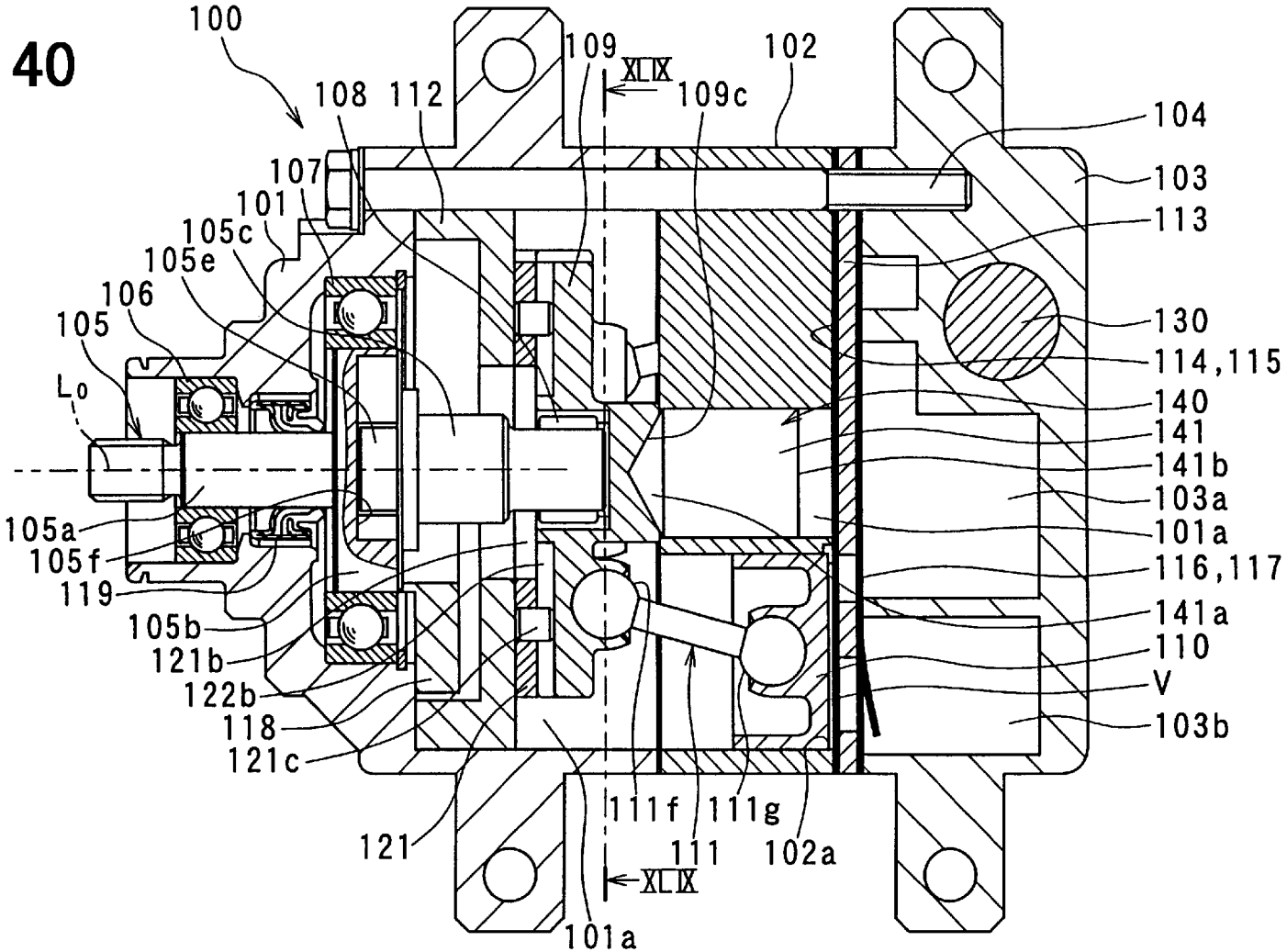
FIG. 40 is a cross-sectional view of when the discharge volume is at its minimum by setting the controlling pressure Pc to the maximum pressure in a compressor according to Embodiment 7 of the present invention.
Figure 41:
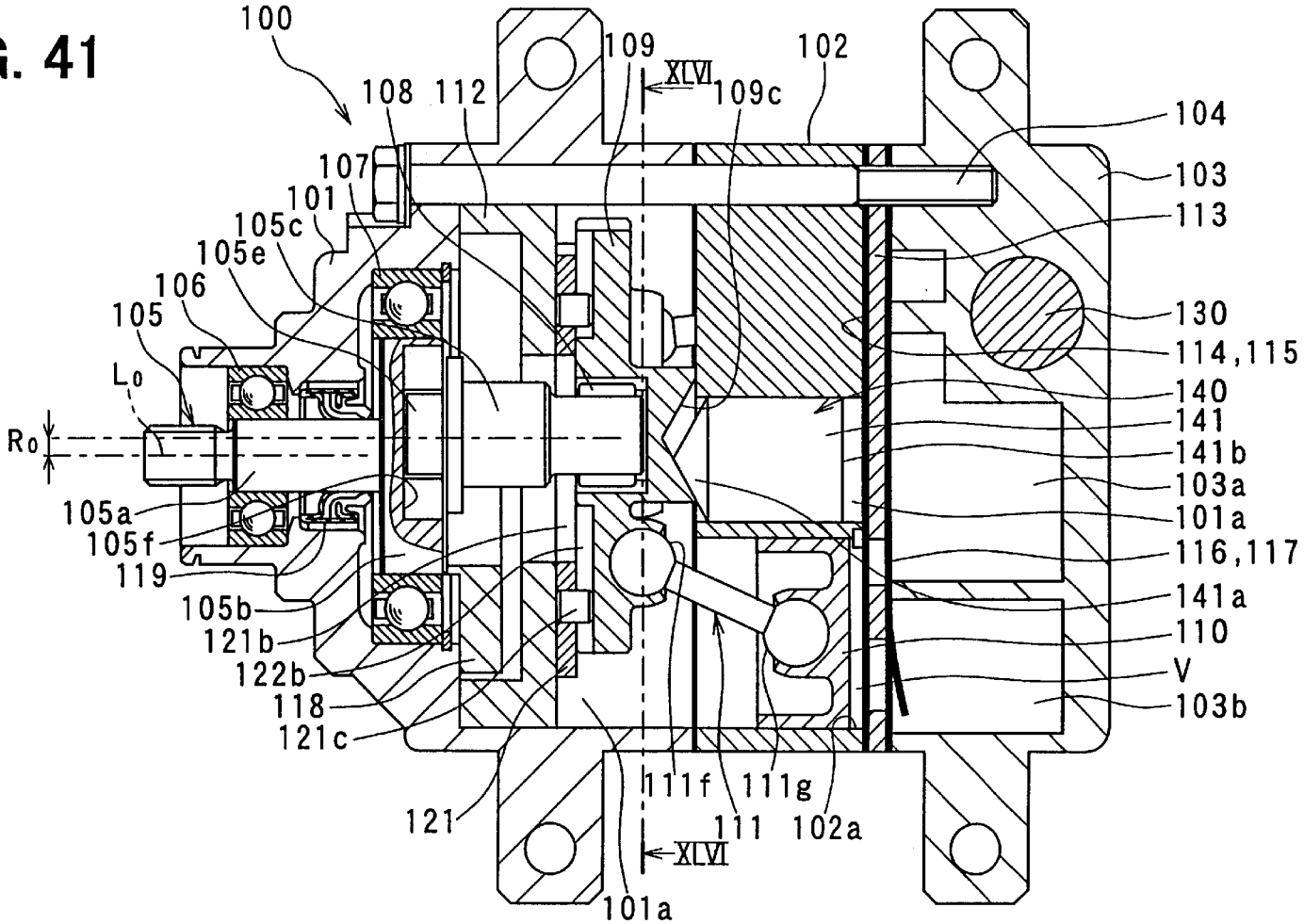
FIG. 41 is a cross-sectional view of when the controlling pressure Pc is at an intermediate pressure in a compressor according to Embodiment 7 of the present invention.

It should be understood that FIG. 39 is a cross-sectional view of the discharge volume when it is at its maximum, accomplished by setting the controlling pressure to the minimum pressure (intake pressure). FIG. 40 is a cross-sectional view of the discharge volume when it is at its minimum accomplished by setting the controlling pressure Pc to the maximum pressure (discharge pressure). FIG. 41 is a cross-sectional view when the controlling pressure is at an intermediate pressure.

Figure 42:
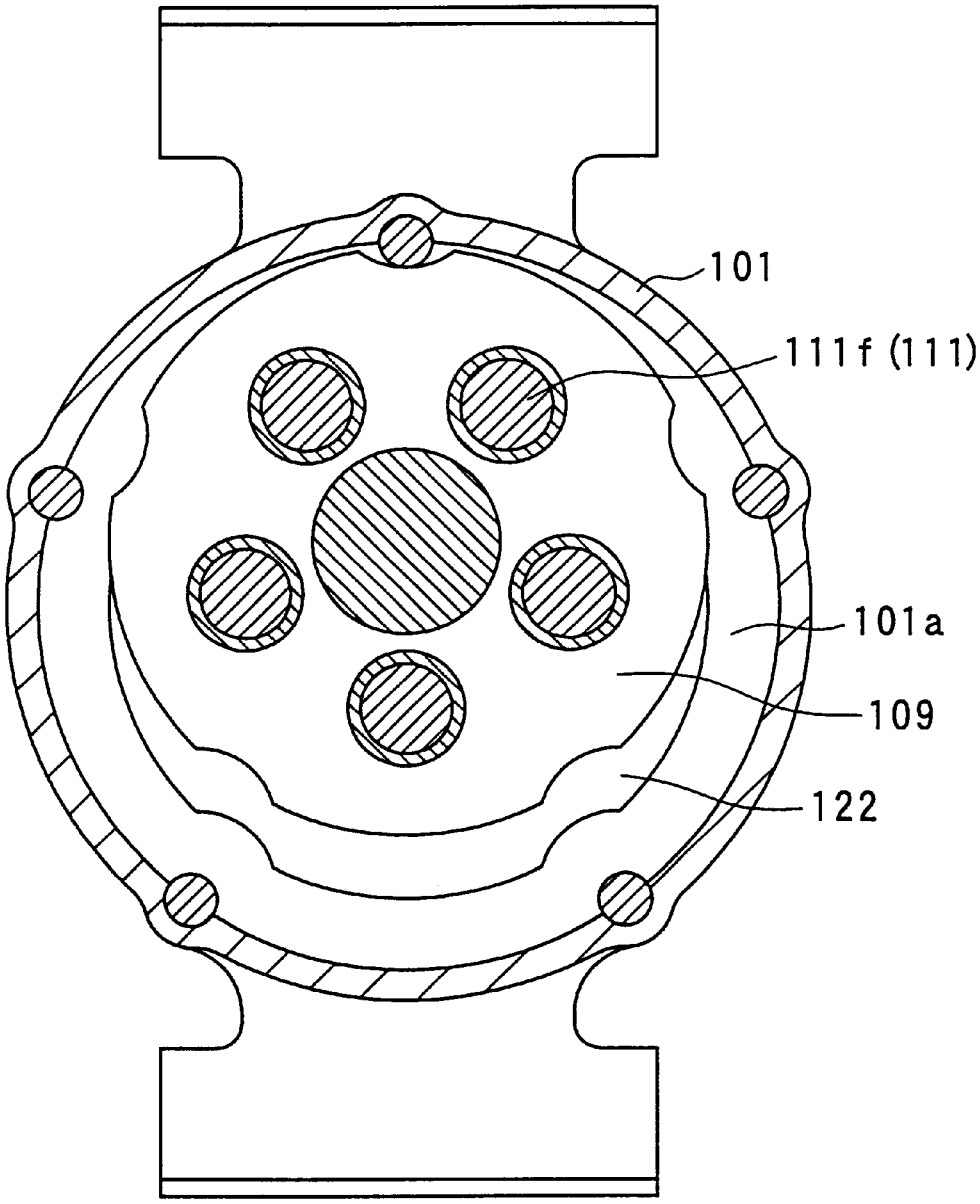
FIG. 42 is a cross-sectional view taken along XLII—XLII of FIG. 39.
Figure 43:
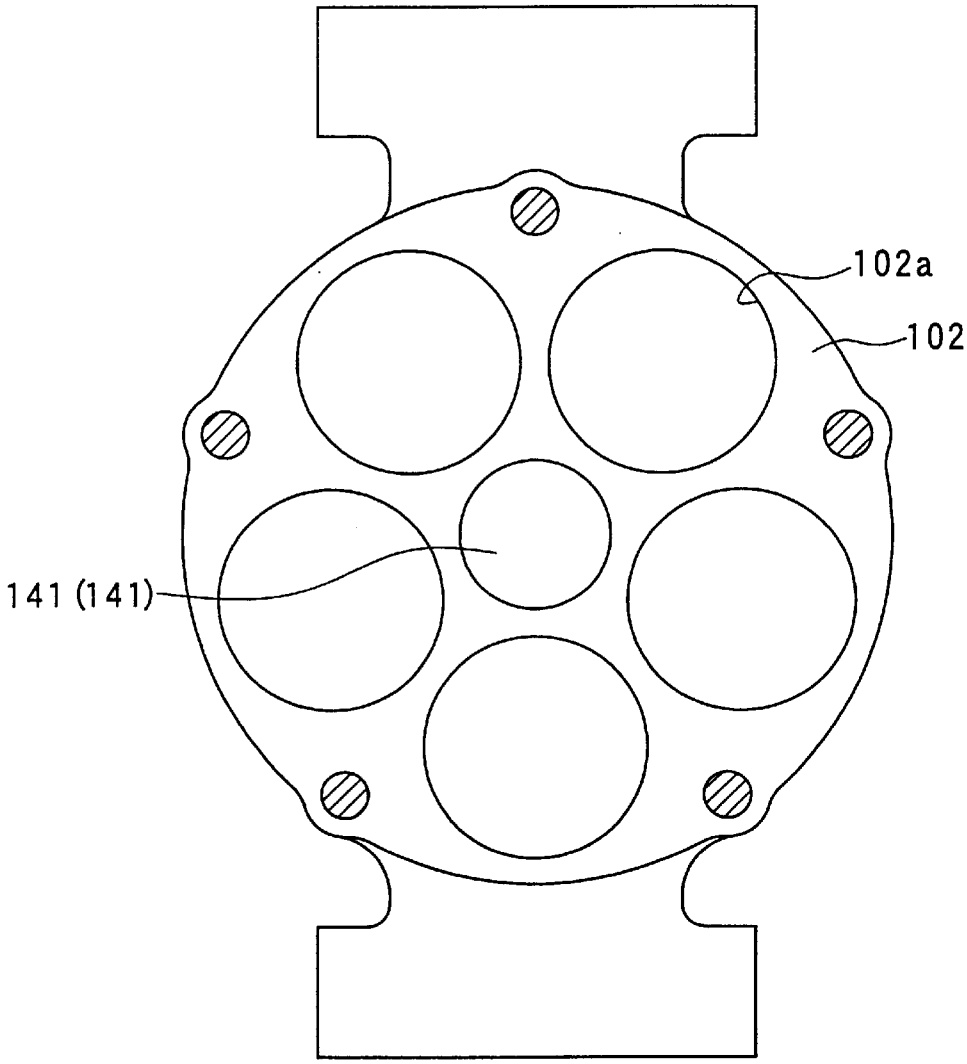
FIG. 43 is a cross-sectional view taken along XLIII—XLIII of FIG. 39.
Figure 44:
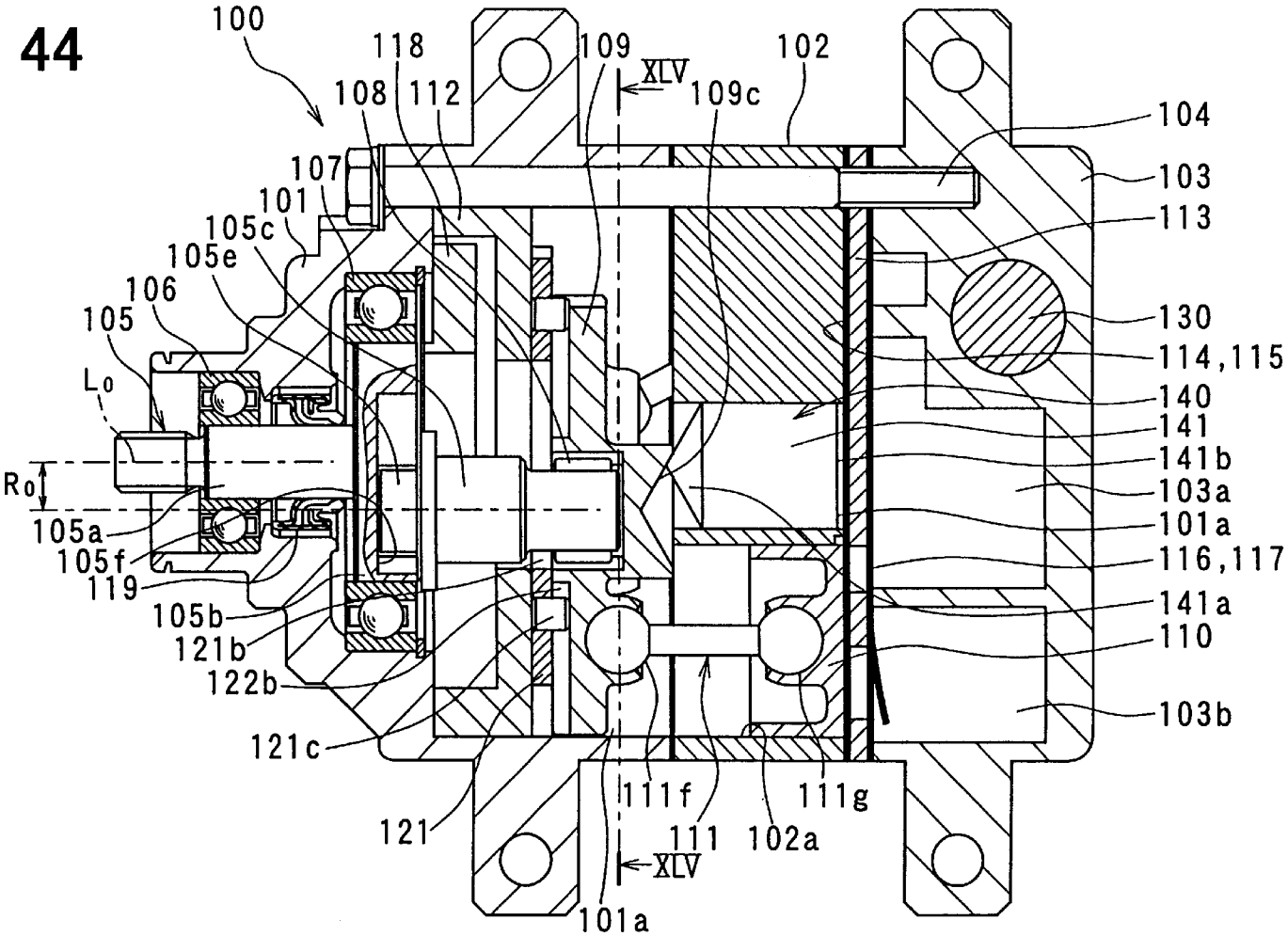
FIG. 44 is a cross-sectional view showing the piston at the top dead center position when the compressor according to Embodiment 7 of the present invention is at the maximum volume.
Figure 45:
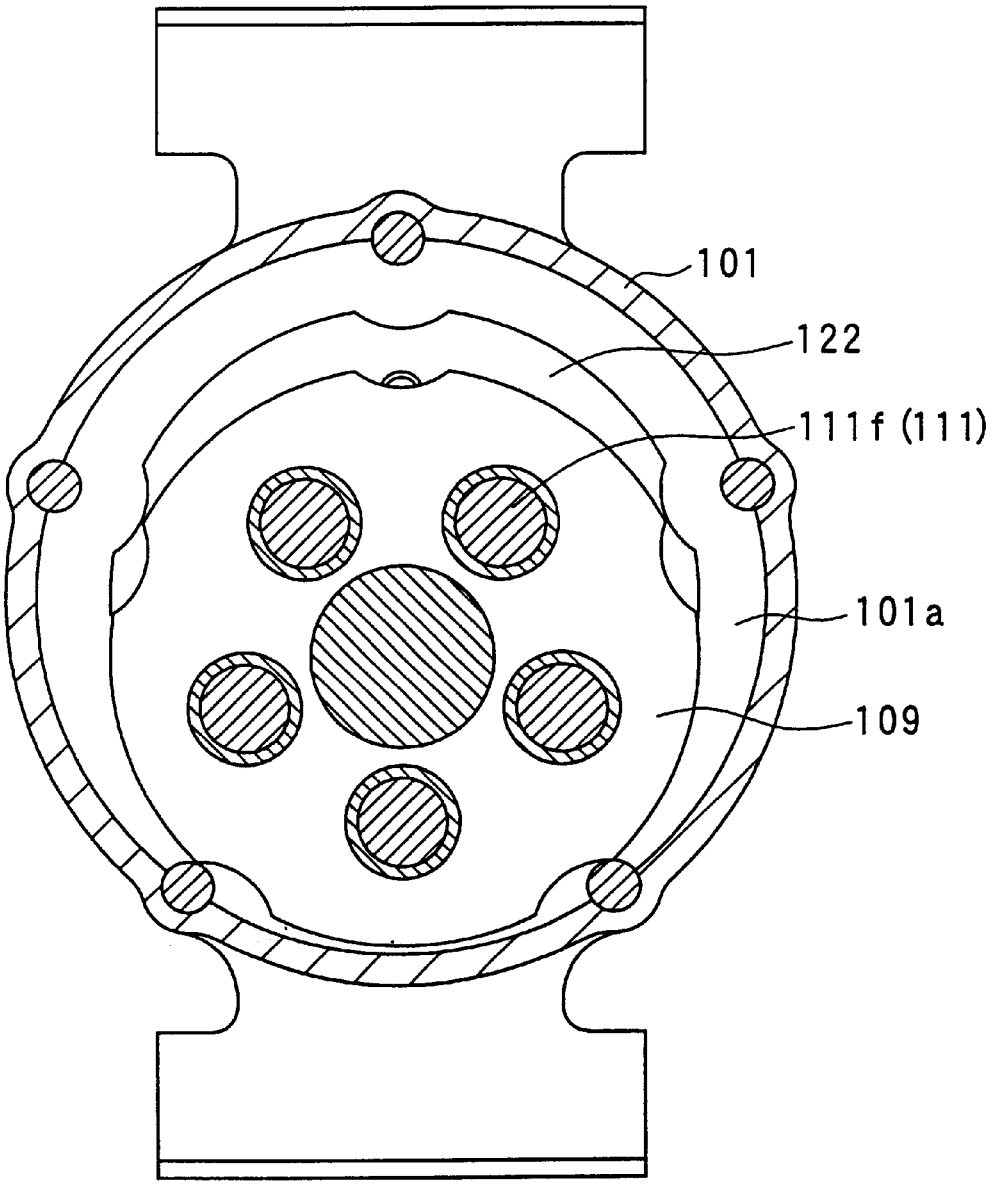
FIG. 45 is a cross-sectional view taken along XLV—XLV of FIG. 44.
Figure 46:
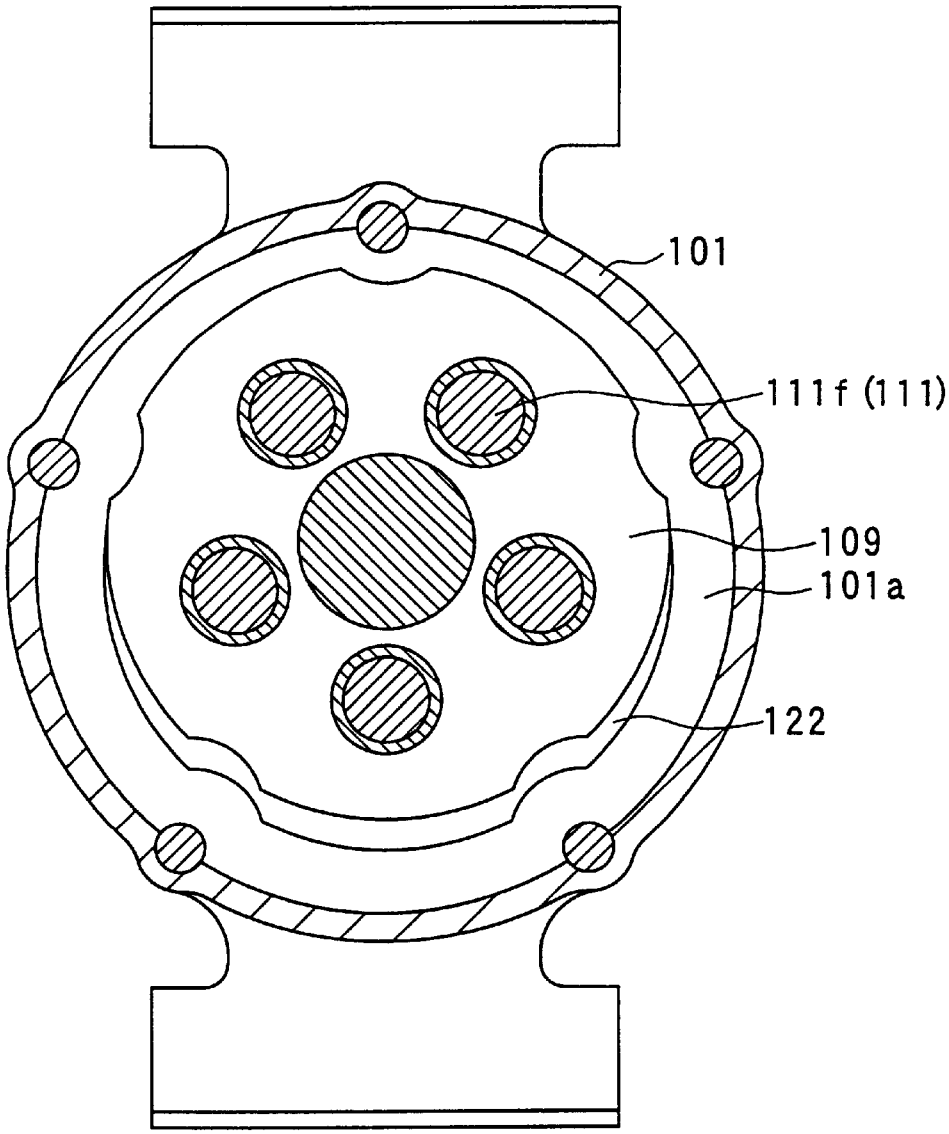
FIG. 46 is a cross-sectional view taken along XLVI—XLVI of FIG. 41.

Moreover, FIG. 42 is a cross-sectional view taken along XLII—XLII of FIG. 39. FIG. 43 is a cross-sectional view taken along XLIII—XLIII of FIG. 39. FIG. 44 is a cross-sectional view showing the piston at the top dead center position when the compressor 100 according to the present embodiment is at its maximum volume. FIG. 45 is a cross-sectional view taken along XLV—XLV of FIG. 44. FIG. 46 is a cross-sectional view taken along XLVI—XLVI of FIG. 41.

Figure 47:
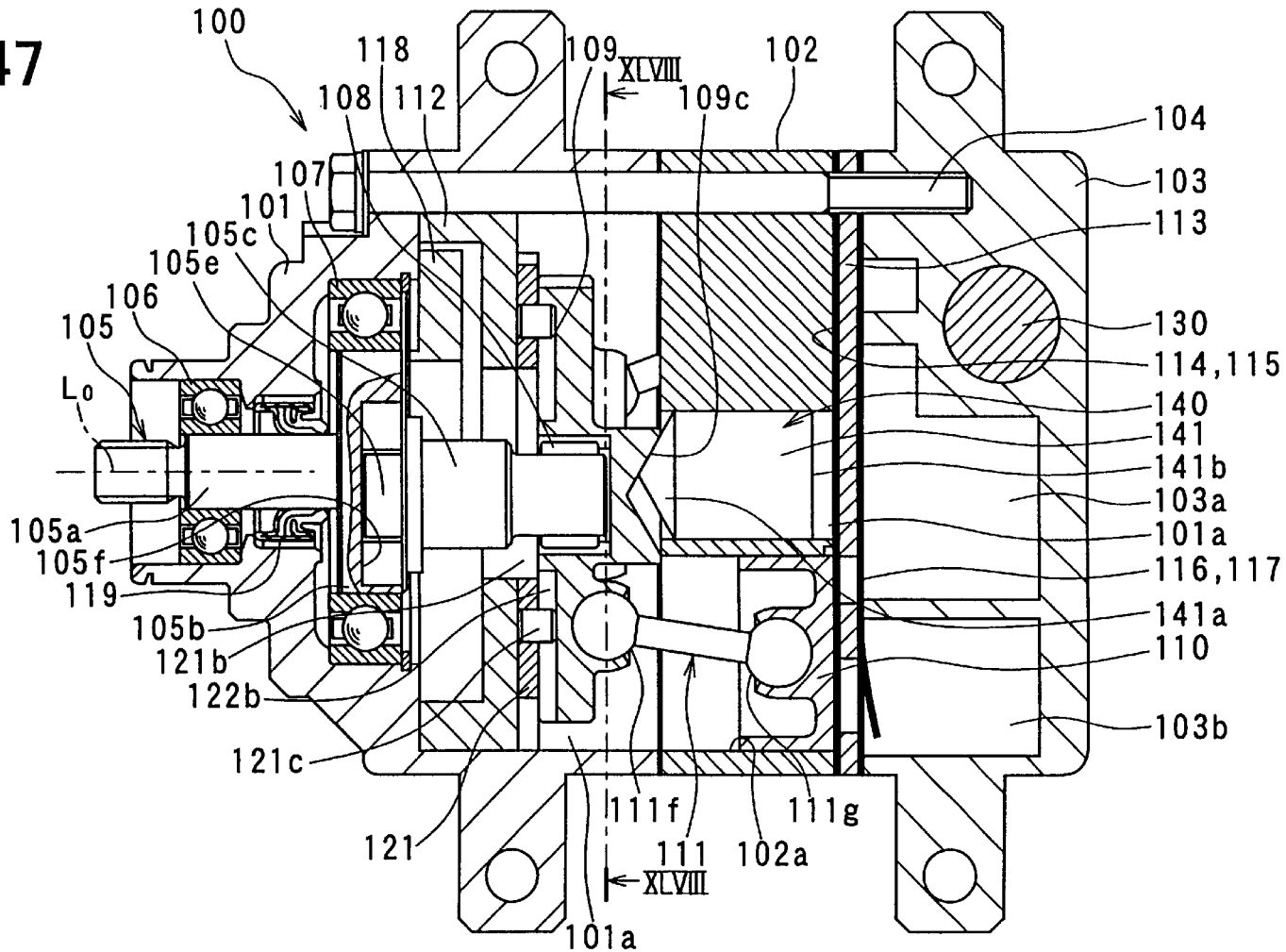
FIG. 47 is a cross-sectional view showing the piston at the top dead center position when a compressor according to Embodiment 7 of the present invention is at the intermediate volume.
Figure 48:
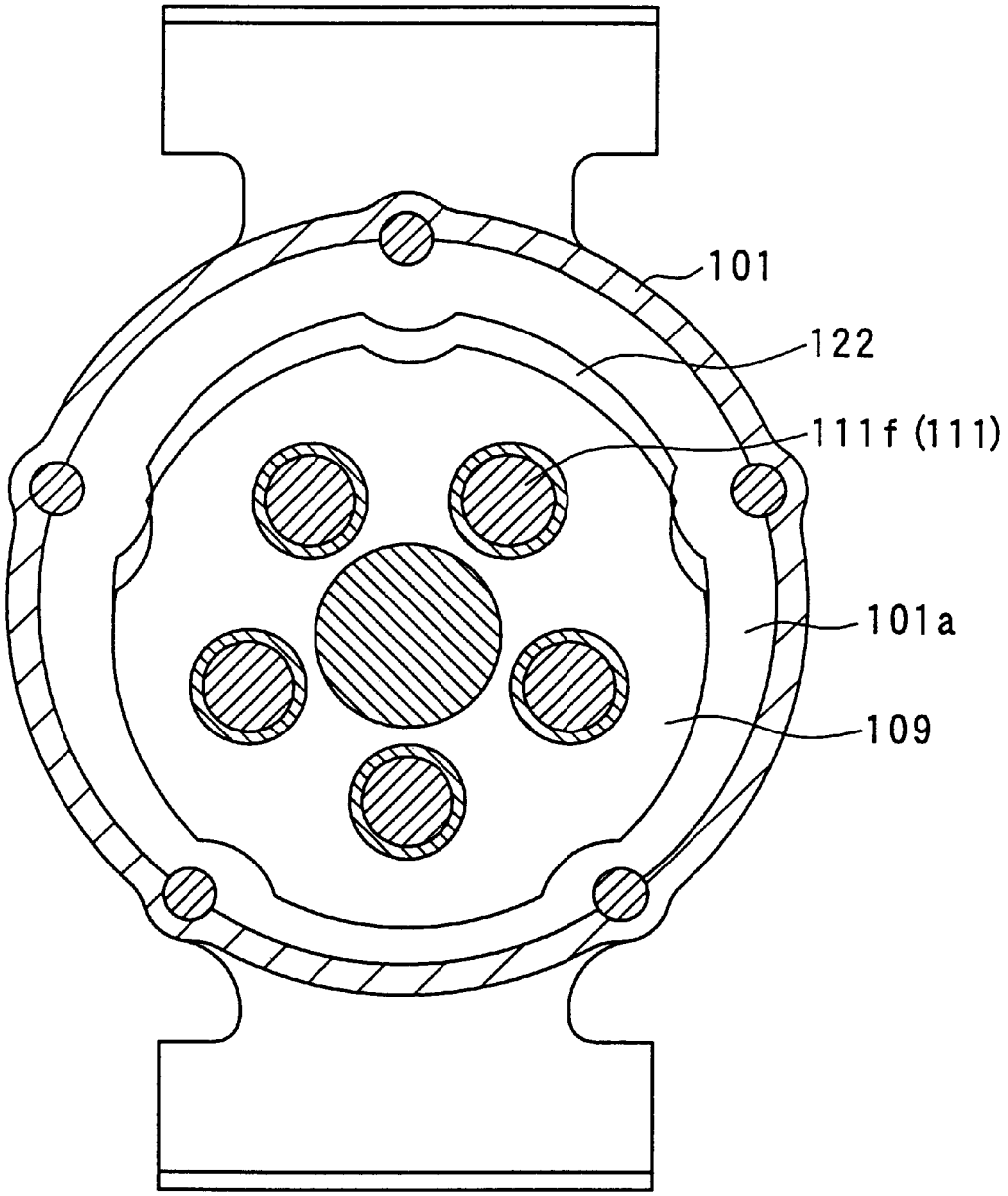
FIG. 48 is a cross-sectional view taken along XLVIII—XLVIII of FIG. 47.
Figure 49:
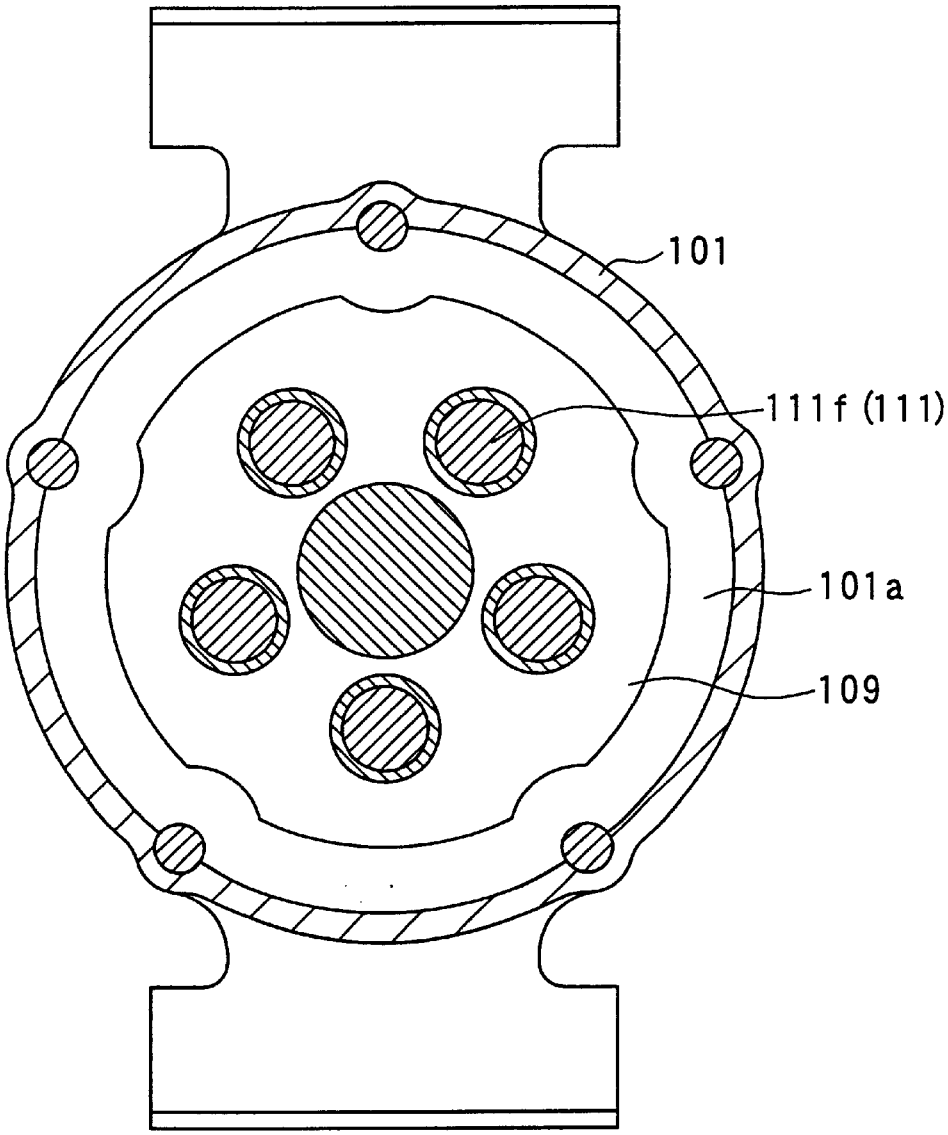
FIG. 49 is a cross-sectional view taken along XLIX—XLIX of FIG. 40.

Furthermore, FIG. 47 is a cross-sectional view showing the piston at the top dead center position when the compressor 100 according to the present embodiment is at the intermediate volume. FIG. 48 is a cross-sectional view taken along XLVIII—XLVIII of FIG. 47. FIG. 49 is a cross-sectional view taken along XLIX—XLIX of FIG. 40.

Figure 50:
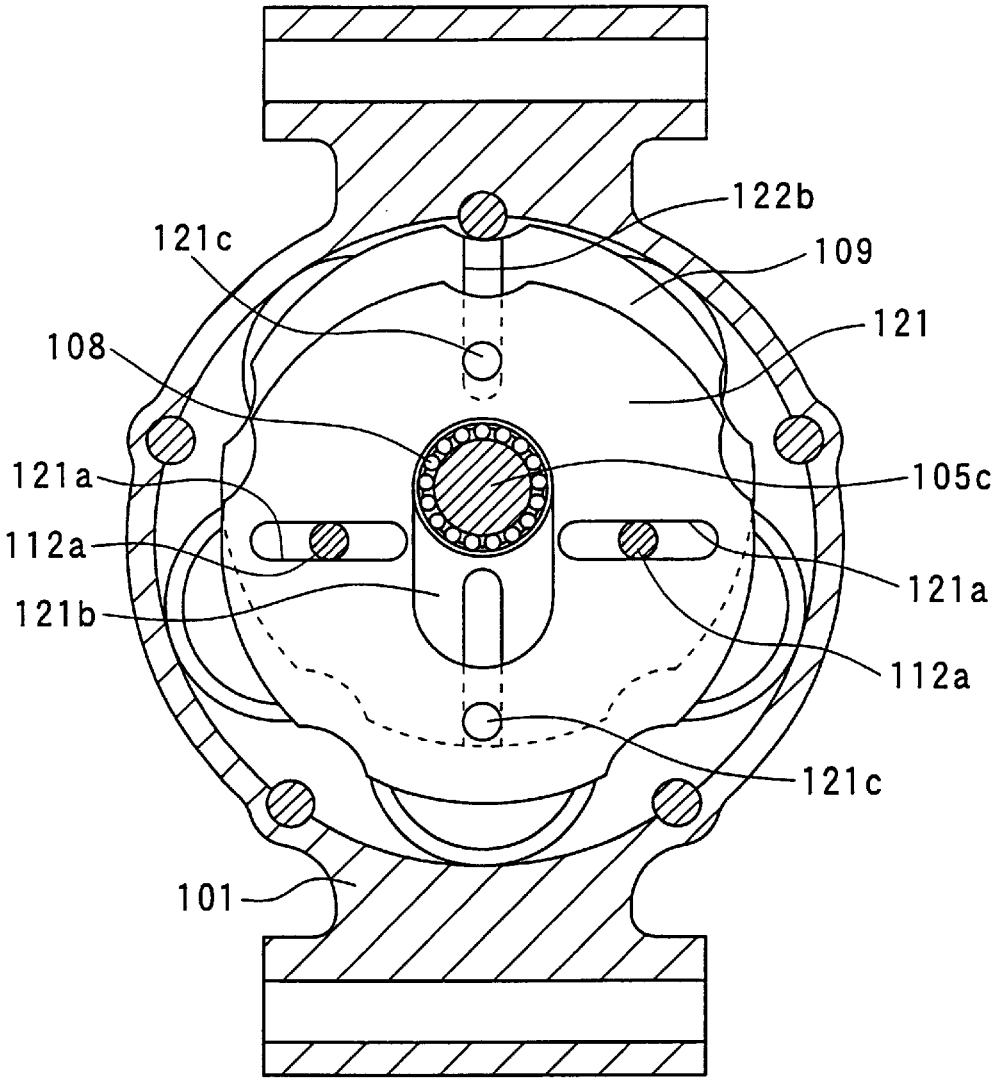
FIG. 50 is a diagram illustrating operation of a rotation prevention mechanism in a compressor according to Embodiment 7 of the present invention.
Figure 51:
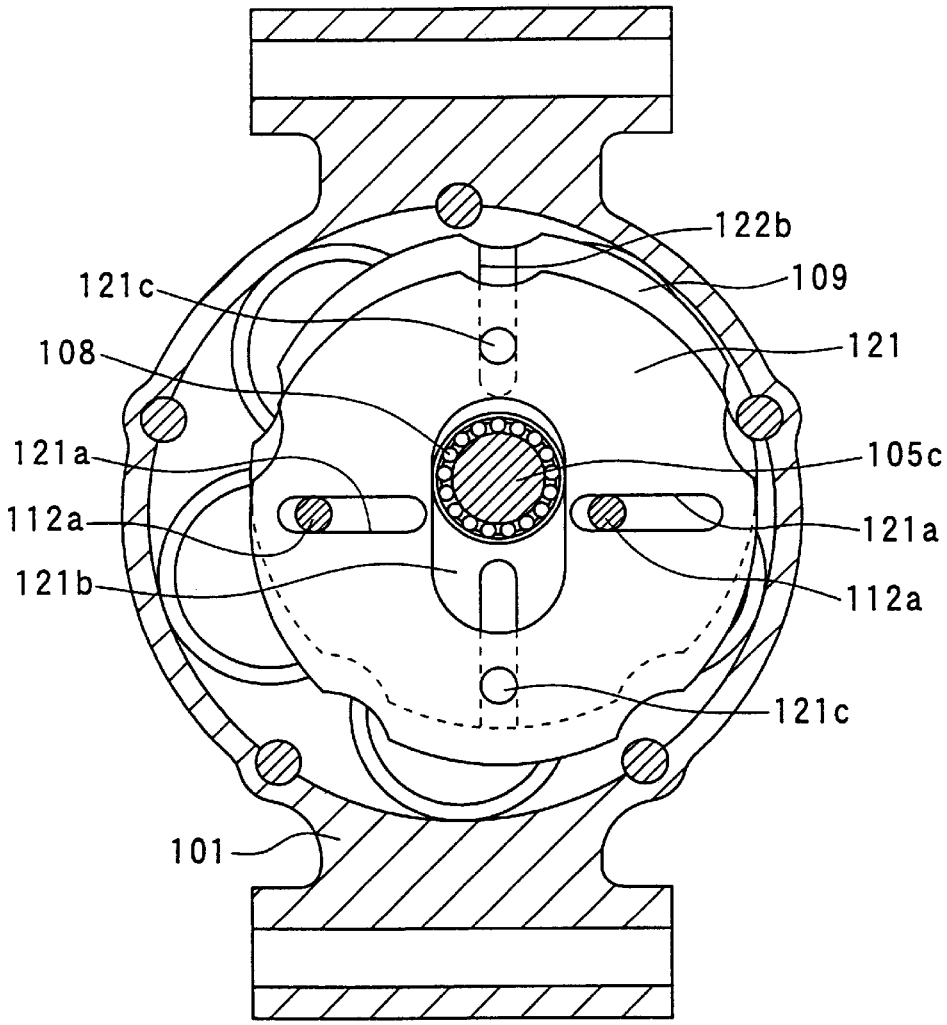
FIG. 51 is a diagram illustrating operation of a rotation prevention mechanism in a compressor according to Embodiment 7 of the present invention.
Figure 52:
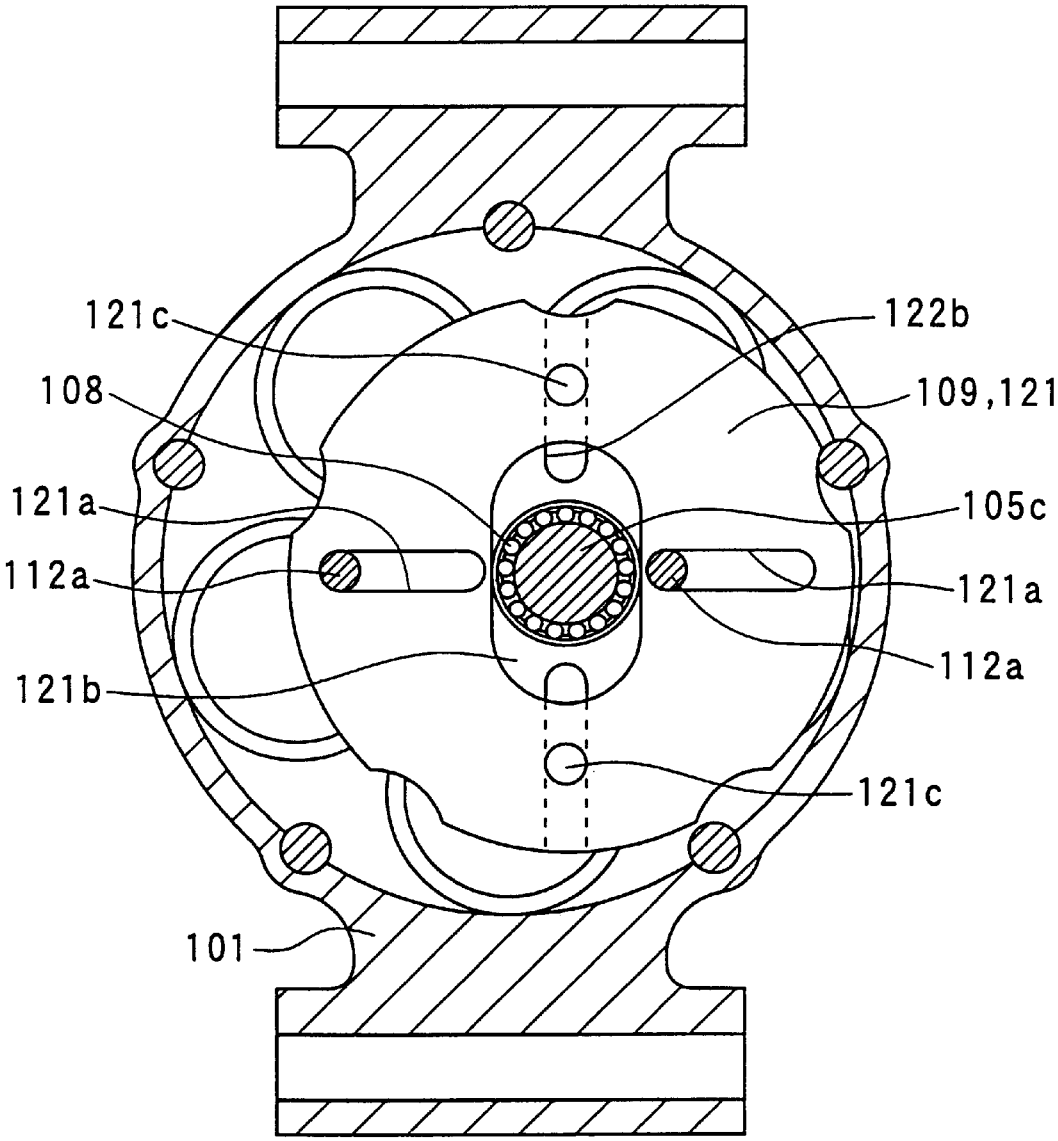
FIG. 52 is a diagram illustrating operation of a rotation prevention mechanism in a compressor according to Embodiment 7 of the present invention.
Figure 53:
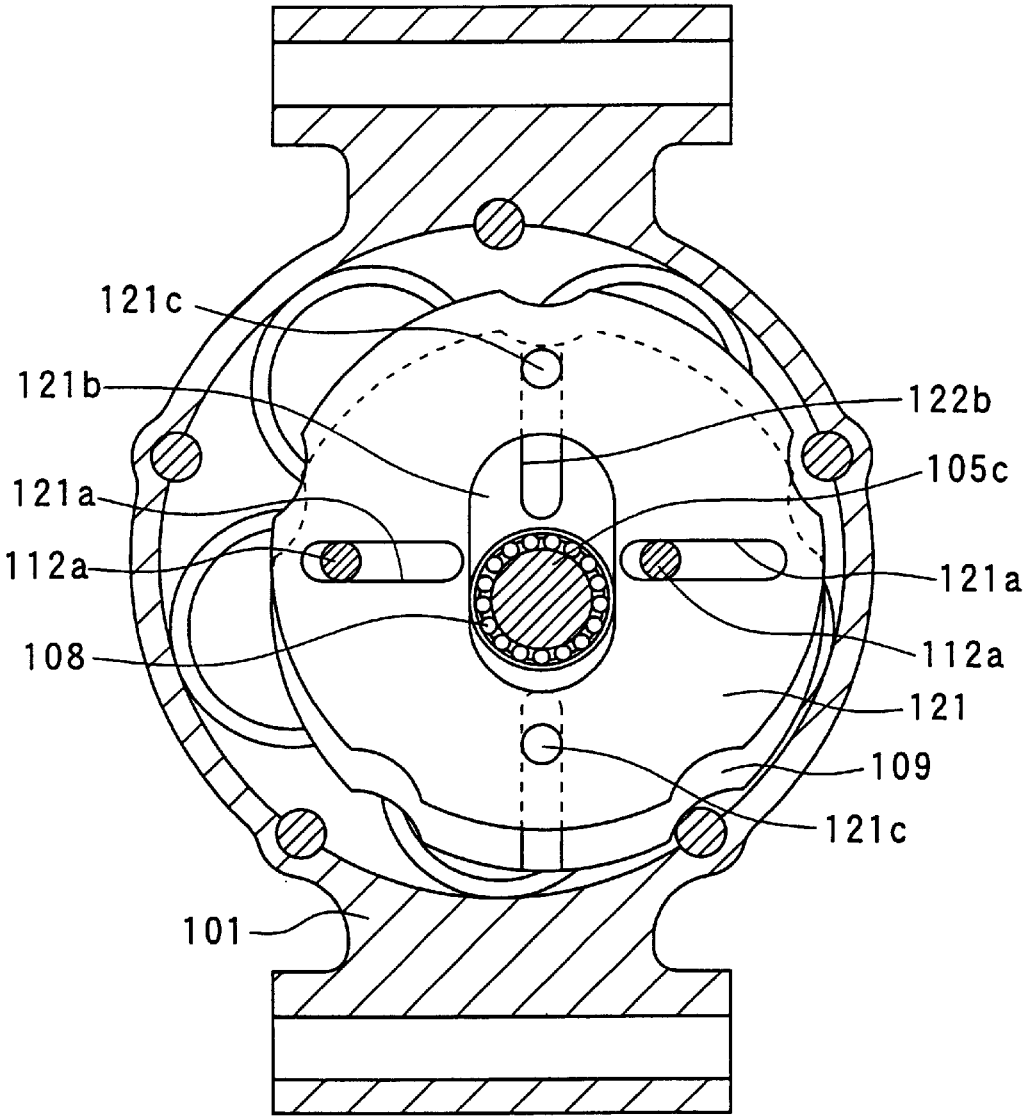
FIG. 53 is a diagram illustrating operation of a rotation prevention mechanism in a compressor according to Embodiment 7 of the present invention.
Figure 54:
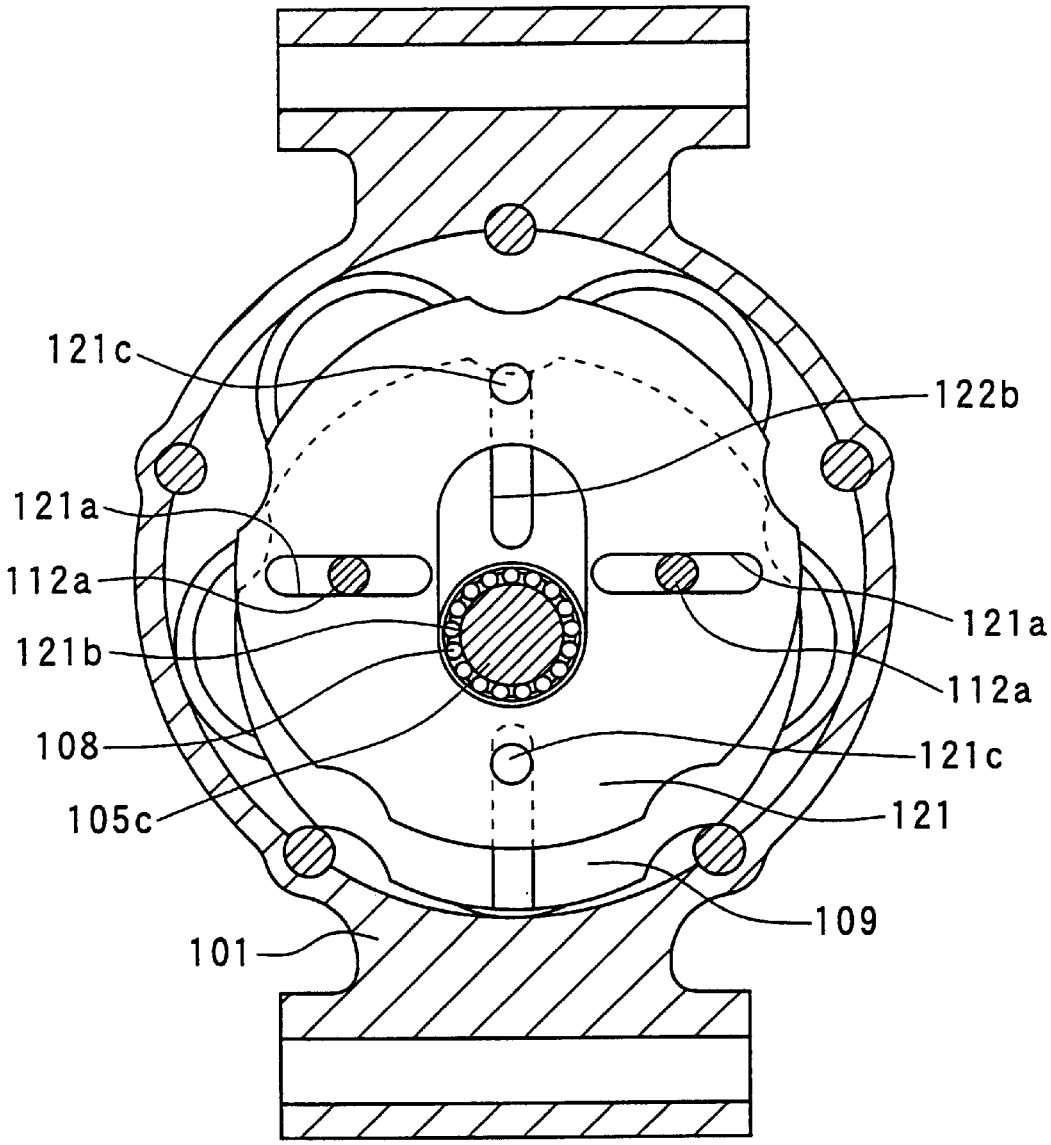
FIG. 54 is a diagram illustrating operation of a rotation prevention mechanism in a compressor according to Embodiment 7 of the present invention.
Figure 55:
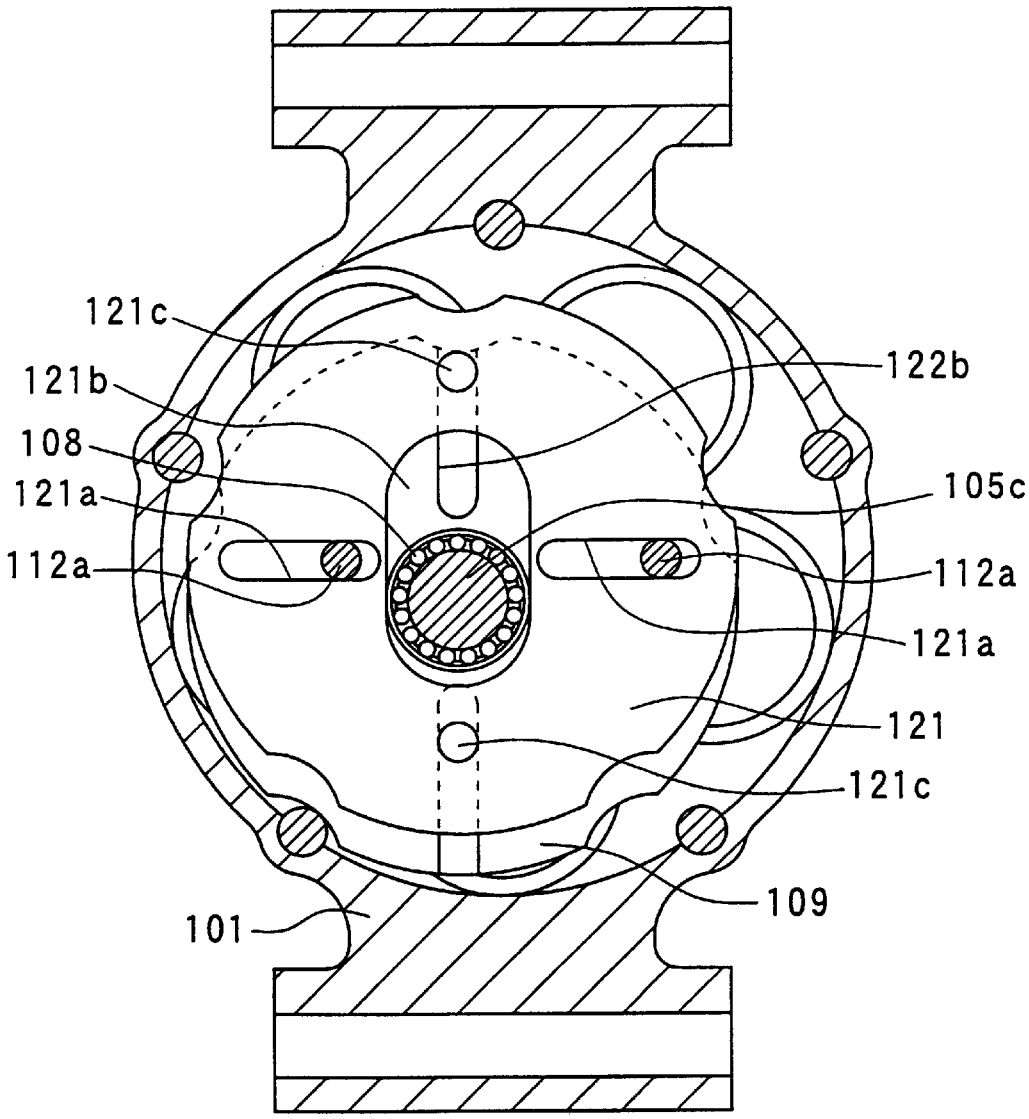
FIG. 55 is a diagram illustrating operation of a rotation prevention mechanism in a compressor according to Embodiment 7 of the present invention.
Figure 56:
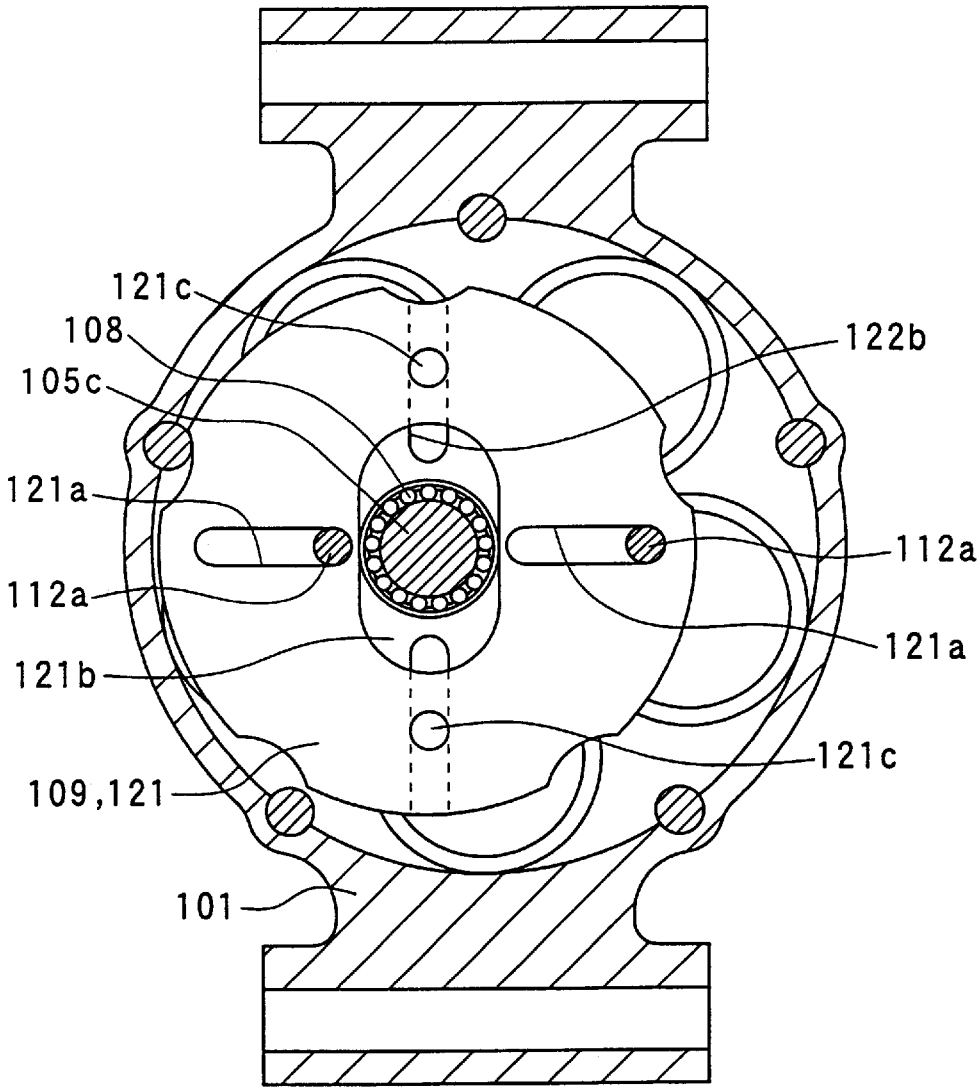
FIG. 56 is a diagram illustrating operation of a rotation prevention mechanism in a compressor according to Embodiment 7 of the present invention.
Figure 57:
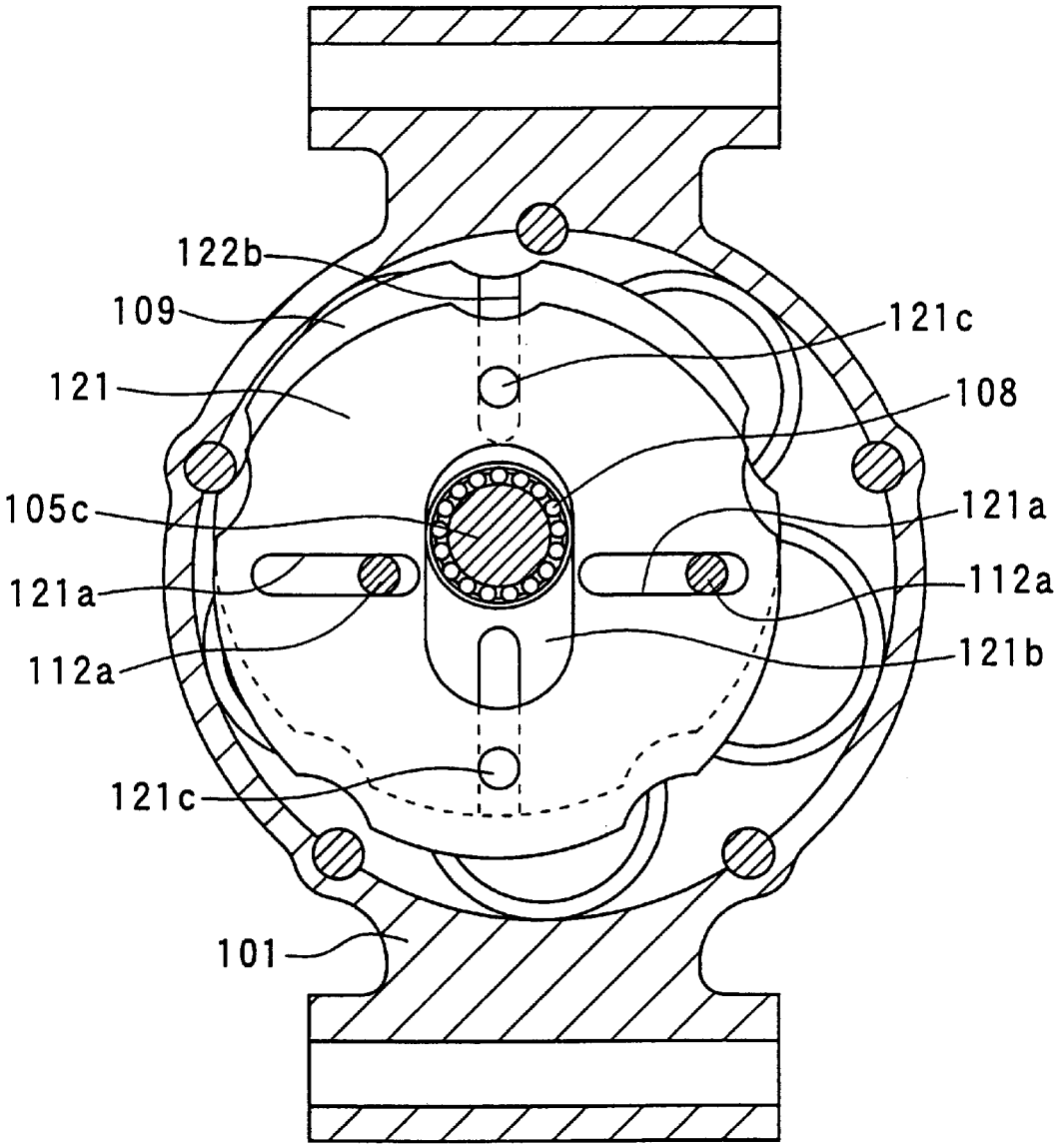
FIG. 57 is a diagram illustrating operation of a rotation prevention mechanism in a compressor according to Embodiment 7 of the present invention.

FIGS. 50 to 57 are diagrams showing operation of the rotation prevention mechanism R. In Embodiment 4, the fixed disk 121 is fixed so as not to be displaced directly with respect to the housing (the front housing 101). In the present embodiment, however, as shown in FIG. 50, a long hole 121*b* generally equal to a diameter of the crank portion 105*c* (the bearing 108) is provided on the disk 121, and by fixing the pin portion 112*a* sliding in the long hole 121*a* of the disk 121 to the fixed disk 112 by means of press-fitting and the like, the disk 121 reciprocates only in one direction (top-to-bottom direction in this figure) with respect to the center of the crank portion 105*c*.

At that time, in the present embodiment, the movable disk 122 is integrated with the revolving member 109 and a long hole (long groove) 122*b* of the movable disk 122 is provided to the revolving member 109. By the long hole 122*b* and the pin portion 121*c*, the revolving member 109 is regulated so as to be displaced with respect to the disk 121 in a major axis of the long hole 121*b*. Therefore, when the center of the crank portion 105*c* revolves around the shaft 105, the center of the revolving member 109 and the disk 121 revolves around the shaft 105 without rotating around its center.

In the present embodiment, the balance weights 118 are a fixed type similar to Embodiments 1 to 4 which do not change the inertial moment. Alternatively, similarly to Embodiments 5 and 6, by the pin 118*b* provided to the shaft 105 and the long hole 118*a* provided to the balance weight 118, a balancer controlling means for changing the inertial moment of the balance weight 118 may be provided.

[Other Embodiments]

In the above-described embodiments, the present invention has been applied to a compressor, but the present invention is not limited thereto and can be applied to other fluid machinery such as hydraulic pumps and the like.

In the above-described embodiments, compressors (fluid machinery) are driven by gaining motive energy externally, but the present invention is not limited thereto, and alternatively, for example, it can be applied to so-called sealed-type compressors or the like having the compressor and a power motor connected thereto as an integrated power source.

Moreover, in the above-described embodiments, a motion conversion mechanism for changing the revolving motion of the revolving member 109 to the reciprocating motion of the piston 110 is constituted of the link 111 (the first and second links 111 and 111*b*, respectively), but the present invention is not limited thereto, and the conversion mechanism can be constituted of other means.

In the above-described embodiments, a stroke changing mechanism for increasing (changing) a stroke of the piston is constituted of the first and the second links 111*a* and 111*b*, respectively, but the present invention is not limited thereto, and the stroke changing mechanism can be accomplished by other means.

Furthermore, in the above-described embodiment, the center of the sliding pin 109*a* moves back and forth, both sides centered about the piston axial line Lp, so that while the revolving member 109 revolves once, the piston 110 reciprocates twice within the cylinder bore 102*a* in the direction parallel to the longitudinal direction of the shaft 105, thus accomplishing a double-speed mechanism. However, the present invention is not limited to the above, and the double-speed mechanism may be achieved by other structures.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fluid pumping machine comprising:

a shaft that rotates;

a revolving member that revolves by being driven by the shaft and oscillates around a rotation center of the shaft in a cross-sectional plane to a longitudinal direction of the shaft;

a piston that reciprocates in a direction parallel to a longitudinal direction of the shaft (105); and a link having a first end pivotably connected to the piston while a second end of the link is pivotably connected to the revolving member;

wherein, when the revolving member revolves, the piston reciprocates as the link moves with respect to the piston.

2. A fluid pumping machine comprising:

a shaft that rotates;

a revolving member that is driven by the shaft and revolves around a rotation center of the shaft in a plane orthogonal to a longitudinal direction of the shaft;

a piston that reciprocates in a direction parallel to the longitudinal direction of the shaft; and a link having a first end pivotably connected to the piston while a second end is pivotably connected to the revolving member;

wherein, of motion transferred to the link from the revolving member, at a time when the revolving member revolves, only a radial directional component of the shaft is transferred to the link.

3. A fluid machine according to claim 2, wherein the link is constructed so as to swing with respect to the piston so that a connecting position of the link with the revolving member passes through a center of the piston and reciprocates from both sides of the piston axial line and is parallel to the longitudinal direction of the shaft.

4. A fluid machine comprising:

a housing;

a shaft that rotates within the housing;

a revolving member that is driven by the shaft and revolves in a plane orthogonal to a longitudinal direction of the shaft;

a piston that reciprocates in a direction parallel to the longitudinal direction of the shaft; and a link having a first end pivotably connected to the piston while a second end is pivotably connected to the revolving member;

wherein, a connecting portion of the link with the revolving member swings with respect to the revolving member only in a plane parallel to a swinging plane of the link with respect to the piston.

5. A fluid machine according to claim 4, wherein the link is constructed so as to swing with respect to the piston so that a connecting position of the link with the revolving member passes through a center of the piston and reciprocates from both sides of the piston axial line and is parallel to the longitudinal direction of the shaft.

6. A fluid machine comprising:

a plurality of housings;

a shaft that rotates within the housings;

a revolving member that is driven by the shaft and revolves in a plane orthogonal to a longitudinal direction of the shaft;

a piston that reciprocates in a direction parallel to the longitudinal direction of the shaft;

a link having a first end pivotably connected to the piston while a second end is pivotably connected to the revolving member, and a regulating link swingably connected to the revolving member with a first end fixed to the housing so as to swing only in a plane parallel to a swinging plane of the link, while a second end is movable with respect to the revolving member in a direction orthogonal to the swinging plane.

7. A fluid machine according to claim 6, wherein the link is constructed so as to swing with respect to the piston so that a connecting position of the link with the revolving member passes through a center of the piston and reciprocates from both sides of the piston axial line and is parallel to the longitudinal direction of the shaft.

8. A fluid machine comprising:

housings;

a shaft that rotates within the housings;

a revolving member that is driven by the shaft and revolves in a plane orthogonal to a longitudinal direction of the shaft;

a piston that reciprocates in a direction parallel to the longitudinal direction of the shaft; and a linkage having a first end pivotably connected to the piston and a second end pivotably connected to the revolving member, wherein, the linkage is constituted of a first link and a second link rotatably connected to each other, a first end of the first link is pivotably connected to the piston and a second end of the first link is rotatably connected to a connecting portion provided on a first end of the second link, a second end of the second link has a swing center fixed to the housings so that the second link can swing in a plane parallel to a swinging plane of the first link with respect to the piston, and the second link is pivotably connected to the revolving member at a portion between the swing center and the connecting portion of the second link while being movable in a direction orthogonal to the swinging plane with respect to the revolving member.

9. A fluid machine according to claim 8, wherein the link is constructed so as to swing with respect to the piston so that a connecting position of the link with the revolving member passes through a center of the piston and reciprocates from both sides of the piston axial line and is parallel to the longitudinal direction of the shaft.

10. A fluid machine comprising:

a plurality of housings;

a shaft that rotates within the housings;

a revolving member that revolves by being driven by the shaft;

a rotation prevention mechanism for preventing the revolving member from rotating with respect to the housings, a piston that reciprocates in a direction parallel to the longitudinal direction of the shaft; and a link having a first end movably connected to the piston while a second end is movably connected to the revolving member, wherein when the revolving member revolves, the piston reciprocates by the link swinging with respect to the piston.

11. A fluid machine according to claim 10, wherein the rotation prevention mechanism is constructed between the housing and the revolving member.

12. A fluid machine according to claim 11, wherein the rotation prevention mechanism is constructed in such a manner that the revolving member can be displaced relative to a movable member, which can be displaced only in one direction with respect to the housing, in a direction intersecting with a displacement direction of the movable member.

13. A fluid machine comprising:

a shaft that rotates;

a revolving member that revolves by being driven by the shaft;

a piston that reciprocates in a direction parallel to a longitudinal direction of the shaft; and a link having one end movably connected to the piston while another end movably connected to the revolving member, wherein, at the link, the revolving member is prevented from rotating with respect to the housings, and at the same time, the piston reciprocates due to a revolving motion of the revolving member.

14. A fluid machine comprising:

a shaft that rotates;

a revolving member that revolves by being driven by the shaft and oscillates around a rotation center of the shaft in a cross-sectional plane to a longitudinal direction of the shaft; and a piston that reciprocates in a direction parallel to a longitudinal direction of the shaft, wherein, along with the revolving movement of the revolving member, the piston reciprocates.

15. A fluid machine according to claim 14, wherein when the revolving member makes one revolution, the piston reciprocates twice.

16. A fluid machine comprising:

a shaft that rotates;

a revolving member connected to a portion of the shaft eccentric from a rotation center of the shaft and driven by the shaft to revolve;

a piston that reciprocates in a direction parallel to a longitudinal direction of the shaft;

a conversion mechanism for converting a revolving motion of the revolving member to a reciprocating motion of the piston; and a stroke controlling means for controlling a stroke of the piston by variably controlling an eccentric amount of the eccentric portion.

17. A fluid machine according to claim 16, wherein the stroke controlling means controls the stroke of the piston by controlling a force exerted on the revolving member from the piston by controlling a pressure difference between a pressure acting on the piston from a link side and a pressure acting on the piston from an opposite side of the link.

18. A fluid machine according to claim 16, wherein the link has a structure in which when a compression reactive force acts on the piston, a force that moves the revolving member away from a rotation center of the shaft is exerted, and the stroke controlling means controls the stroke of the piston by controlling a force exerted on the revolving member from the piston by controlling a pressure difference between a pressure acting on the piston from a link side and a pressure acting on the piston from an opposite side of the link.

19. A fluid machine according to claim 16, wherein the stroke controlling means comprises an actuator for moving the revolving member in a radial direction of the shaft.

20. A fluid machine according to claim 19, wherein the link has a structure in which when a compression reactive force acts on the piston, a force that moves the revolving member away from the rotation center of the shaft is exerted, and the actuator exerts a force on the revolving member, the force opposing a force that the compression reactive force exerts on the revolving member via the link.

21. A fluid machine according to claim 20, wherein the fluid machine has a balancer for canceling a centrifugal force that the revolving member exerts on the shaft by a revolving motion of the revolving member, and a balancer controlling means for changing an inertial moment of the balancer by interlocking with the operation of the stroke controlling means.

22. A fluid machine according to claim 21, wherein the balancer controlling means changes the inertial moment of the balancer by displacing a position of a gravity point of a plurality of weights with respect to the shaft.

23. A fluid machine comprising:

a shaft that rotates;

a revolving member driven by the shaft so as to revolve around a rotation center of the shaft in a plane orthogonal to a longitudinal direction of the shaft;

a piston that reciprocates in a direction parallel to a longitudinal direction of the shaft;

a link having a first end swingably connected to the piston while a second end is movably connected to the revolving member, a transferring mechanism for transferring a radial directional component of the shaft to the link of a motion transferred to the link from the revolving member when the revolving member revolves; and a stroke controlling means for controlling a stroke of the piston by variably controlling an amplitude of the radial directional component of the shaft of a motion transferred to the link from the revolving member when the revolving member revolves.

24. A fluid machine according to claim 23, wherein the stroke controlling means controls the stroke of the piston by controlling a force exerted on the revolving member from the piston by controlling a pressure difference between a pressure acting on the piston from a link side and a pressure acting on the piston from an opposite side of the link.

25. A fluid machine according to claim 23, wherein the link has a structure in which when a compression reactive force acts on the piston, a force that moves the revolving member away from a rotation center of the shaft is exerted, and the stroke controlling means controls the stroke of the piston by controlling a force exerted on the revolving member from the piston by controlling a pressure difference between a pressure acting on the piston from a link side and a pressure acting on the piston from an opposite side of the link.

* * * * *